US008749538B2

(12) United States Patent
Webster et al.

(10) Patent No.: US 8,749,538 B2
(45) Date of Patent: Jun. 10, 2014

(54) DEVICE AND METHOD OF CONTROLLING BRIGHTNESS OF A DISPLAY BASED ON AMBIENT LIGHTING CONDITIONS

(75) Inventors: James R. Webster, San Jose, CA (US); Russel A. Martin, Menlo Park, CA (US); Jennifer L. Gille, Menlo Park, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 336 days.

(21) Appl. No.: 13/278,490

(22) Filed: Oct. 21, 2011

(65) Prior Publication Data

US 2013/0100096 A1 Apr. 25, 2013

(51) Int. Cl.
*G09G 5/00* (2006.01)

(52) U.S. Cl.
USPC ..... 345/207; 345/102; 345/699

(58) Field of Classification Search
USPC ..... 345/102, 207, 699
See application file for complete search history.

(56) References Cited

U.S. PATENT DOCUMENTS

| | | | |
|---|---|---|---|
| 3,977,022 | A | 8/1976 | Sunstein |
| 4,044,213 | A | 8/1977 | Kinney |
| 4,380,024 | A | 4/1983 | Olofsson |
| 4,559,535 | A | 12/1985 | Watkins et al. |
| 4,564,836 | A | 1/1986 | Vuilleumier et al. |
| 4,847,603 | A | 7/1989 | Blanchard |
| 4,878,741 | A | 11/1989 | Fergason |
| 5,061,049 | A | 10/1991 | Hornbeck |
| 5,062,689 | A | 11/1991 | Koehler |
| 5,093,652 | A | 3/1992 | Bull et al. |
| 5,096,279 | A | 3/1992 | Hornbeck et al. |
| 5,142,405 | A | 8/1992 | Hornbeck |
| 5,233,385 | A | 8/1993 | Sampsell |
| 5,233,459 | A | 8/1993 | Bozler et al. |

(Continued)

FOREIGN PATENT DOCUMENTS

| | | | |
|---|---|---|---|
| EP | 0830032 | A2 | 3/1998 |
| EP | 1091342 | A2 | 4/2001 |

(Continued)

OTHER PUBLICATIONS

"What Ambient Light Sensing Can Do for HDTVs: How ALS can save energy and improve image quality", TAOS, Inc., 8 pgs., Jan. 2010.

(Continued)

*Primary Examiner* — Premal Patel
(74) *Attorney, Agent, or Firm* — Knobbe, Martens, Olson & Bear LLP

(57) ABSTRACT

This disclosure provides systems, methods and apparatus, including computer programs encoded on computer storage media, for controlling brightness of a display based on ambient light conditions. In one aspect, a display device can include a reflective display and an auxiliary light source configured to provide supplemental light to the display. The display device further can include a sensor system configured to determine an illuminance of ambient light, and a controller configured to adjust the auxiliary light source to provide an amount of supplemental light to the display based at least in part on the determined illuminance. In one aspect, the amount of supplemental light remains substantially the same or substantially increases in response to increasing illuminance when the illuminance is below a first threshold, and substantially decreases in response to increasing illuminance when the illuminance is above a second threshold that is greater than or equal to the first threshold.

61 Claims, 25 Drawing Sheets

(56) References Cited

U.S. PATENT DOCUMENTS 5,243,894 A 9/1993 Minovitch
5,278,652 A 1/1994 Urbanus et al.
5,280,277 A 1/1994 Hornbeck
5,319,491 A 6/1994 Selbrede
5,339,116 A 8/1994 Urbanus et al.
5,359,345 A 10/1994 Hunter
5,452,024 A 9/1995 Sampsell
5,461,411 A 10/1995 Florence et al.
5,493,439 A 2/1996 Engle
5,497,172 A 3/1996 Doherty et al.
5,510,824 A 4/1996 Nelson
5,517,347 A 5/1996 Sampsell
5,523,803 A 6/1996 Urbanus et al.
5,526,051 A 6/1996 Gove et al.
5,548,301 A 8/1996 Kornher et al.
5,724,062 A 3/1998 Hunter
5,731,802 A 3/1998 Aras et al.
5,745,193 A 4/1998 Urbanus et al.
5,745,281 A 4/1998 Yi et al.
5,760,760 A 6/1998 Helms
5,771,321 A 6/1998 Stern
5,784,189 A 7/1998 Bozler et al.
5,794,761 A 8/1998 Renaud et al.
5,835,255 A 11/1998 Miles
5,835,256 A 11/1998 Huibers
5,914,804 A 6/1999 Goossen
5,952,992 A 9/1999 Helms
5,973,315 A 10/1999 Saldana et al.
5,986,796 A 11/1999 Miles
6,008,929 A 12/1999 Akimoto et al.
6,034,807 A 3/2000 Little et al.
6,040,937 A 3/2000 Miles
6,046,840 A 4/2000 Huibers
6,057,878 A 5/2000 Ogiwara et al.
6,069,676 A 5/2000 Yuyama
6,172,797 B1 1/2001 Huibers
6,201,633 B1 3/2001 Peeters et al.
6,213,615 B1 4/2001 Siitari
6,225,991 B1 5/2001 McKnight
6,249,269 B1 6/2001 Blalock et al.
6,288,824 B1 9/2001 Kastalsky
6,300,154 B2 10/2001 Clark et al.
6,323,834 B1 11/2001 Colgan et al.
6,329,974 B1 12/2001 Walker et al.
6,388,388 B1 5/2002 Weindorf et al.
6,388,648 B1 5/2002 Clifton et al.
6,388,661 B1 5/2002 Richards
6,424,329 B1 7/2002 Okita
6,567,063 B1 5/2003 Okita
6,597,419 B1 7/2003 Okada et al.
6,600,474 B1 7/2003 Heines et al.
6,633,301 B1 10/2003 Dallas et al.
6,650,455 B2 11/2003 Miles
6,657,611 B1 12/2003 Sterken et al.
6,671,078 B2 12/2003 Flanders et al.
6,674,562 B1 1/2004 Miles
6,680,792 B2 1/2004 Miles
6,701,039 B2 3/2004 Bourgeois et al.
6,762,741 B2 7/2004 Weindorf
6,762,743 B2 7/2004 Yoshihara et al.
6,775,048 B1 8/2004 Starkweather et al.
6,795,064 B2 9/2004 Walker et al.
6,798,935 B2 9/2004 Bourgeois et al.
6,844,959 B2 1/2005 Huibers et al.
6,873,311 B2 3/2005 Yoshihara et al.
6,879,307 B1 4/2005 Stern
6,900,072 B2 5/2005 Patel et al.
6,906,847 B2 6/2005 Huibers et al.
6,911,964 B2 6/2005 Lee et al.
6,969,635 B2 11/2005 Patel et al.
6,980,349 B1 12/2005 Huibers et al.
6,982,820 B2 1/2006 Tsai
7,025,464 B2 4/2006 Beeson et al.
7,042,618 B2 5/2006 Selebrede et al.
7,046,221 B1 5/2006 Malzbender
7,050,219 B2 5/2006 Kimura
7,057,790 B2 6/2006 Selbrede
7,092,142 B2 8/2006 Selebrede et al.
7,113,339 B2 9/2006 Taguchi et al.
7,119,944 B2 10/2006 Patel et al.
7,123,216 B1 10/2006 Miles
7,123,796 B2 10/2006 Steckl et al.
7,126,738 B2 10/2006 Miles
7,198,982 B2 4/2007 Patel et al.
7,215,459 B2 5/2007 Huibers et al.
7,218,437 B2 5/2007 Selbrede
7,227,677 B2 6/2007 Ravnkilde et al.
7,271,790 B2 9/2007 Hudson et al.
7,274,416 B2 9/2007 Feenstra et al.
7,297,929 B2 11/2007 Cernasov et al.
7,315,294 B2 1/2008 Richards
7,327,510 B2 2/2008 Cummings et al.
7,463,227 B2 12/2008 Van et al.
7,492,356 B1 2/2009 Pruitt
7,524,097 B2 4/2009 Turnbull et al.
7,595,811 B2 9/2009 Matsuda
7,660,028 B2 2/2010 Lan
7,737,912 B2 6/2010 Graef et al.
7,786,420 B2 8/2010 Yan et al.
7,864,204 B2 1/2011 Overes
7,876,058 B2 1/2011 Price et al.
8,207,955 B2 6/2012 Morimoto
8,279,138 B1 10/2012 Margulis
2002/0006044 A1 1/2002 Harbers et al.
2002/0113808 A1 8/2002 Weindorf et al.
2003/0020672 A1 1/2003 Takatori
2003/0130562 A1 7/2003 Barbato et al.
2003/0231160 A1 12/2003 Yoshihara et al.
2004/0008288 A1 1/2004 Pate et al.
2004/0017337 A1 1/2004 Lin
2004/0054921 A1 3/2004 Land
2004/0080484 A1 4/2004 Heines et al.
2004/0188599 A1 9/2004 Viktorovitch
2004/0246275 A1 12/2004 Yoshihara et al.
2004/0263502 A1 12/2004 Dallas et al.
2005/0062708 A1 3/2005 Yoshihara et al.
2005/0067553 A1 3/2005 Agari et al.
2005/0073471 A1 4/2005 Selbrede
2005/0083352 A1 4/2005 Higgins
2005/0088102 A1 4/2005 Ferguson et al.
2005/0088404 A1 4/2005 Heines et al.
2005/0104804 A1 5/2005 Feenstra et al.
2005/0122560 A1 6/2005 Sampsell et al.
2005/0168431 A1 8/2005 Chui
2005/0190142 A1 9/2005 Ferguson
2005/0206991 A1 9/2005 Chui et al.
2005/0212734 A1 9/2005 Kimura
2006/0044246 A1 3/2006 Mignard
2006/0044928 A1 3/2006 Chui et al.
2006/0056178 A1 3/2006 Len-Li et al.
2006/0061559 A1 3/2006 King
2006/0066937 A1 3/2006 Chui
2006/0077148 A1 4/2006 Gally et al.
2006/0077149 A1 4/2006 Gally et al.
2006/0092182 A1 5/2006 Diefenbaugh et al.
2006/0152476 A1 7/2006 Van et al.
2006/0172745 A1 8/2006 Knowles
2006/0227085 A1 10/2006 Boldt, Jr. et al.
2006/0238443 A1 10/2006 Derichs
2006/0250325 A1 11/2006 Hagood et al.
2007/0047051 A1 3/2007 Selbrede et al.
2007/0047887 A1 3/2007 Selbrede
2007/0052735 A1 3/2007 Chou
2007/0120765 A1 5/2007 Misonou et al.
2007/0139405 A1 6/2007 Marcinkiewicz
2007/0146356 A1* 6/2007 Ladouceur ..... 345/207
2007/0146565 A1 6/2007 Jeon et al.
2007/0172171 A1 7/2007 Van et al.
2008/0001910 A1 1/2008 Lim
2008/0002062 A1 1/2008 Kim et al.
2008/0143844 A1 6/2008 Innocent
2008/0203279 A1* 8/2008 Kobashi ..... 250/216
2008/0238840 A1 10/2008 Raman et al.
2008/0288225 A1 11/2008 Djordjev

(56) References Cited

U.S. PATENT DOCUMENTS

| | | | | |
|---|---|---|---|---|
| 2008/0297466 | A1 | 12/2008 | Kunimori et al. | |
| 2008/0303806 | A1 | 12/2008 | Perrin | |
| 2008/0303918 | A1 | 12/2008 | Keithley | |
| 2009/0091560 | A1 | 4/2009 | Ferguson | |
| 2009/0225396 | A1* | 9/2009 | Sampsell | 359/292 |
| 2009/0235006 | A1 | 9/2009 | Desrosiers et al. | |
| 2009/0237382 | A1 | 9/2009 | Kunimori | |
| 2010/0103186 | A1 | 4/2010 | Luengen et al. | |
| 2010/0118008 | A1 | 5/2010 | Matsuoka | |
| 2010/0149145 | A1* | 6/2010 | Van Woudenberg et al. | 345/207 |
| 2010/0187422 | A1 | 7/2010 | Kothari et al. | |
| 2010/0188443 | A1 | 7/2010 | Lewis et al. | |
| 2010/0220109 | A1 | 9/2010 | Aoki et al. | |
| 2010/0245313 | A1 | 9/2010 | Lewis et al. | |
| 2011/0006690 | A1 | 1/2011 | Hoffman et al. | |
| 2011/0148751 | A1 | 6/2011 | Gally et al. | |
| 2011/0199350 | A1 | 8/2011 | Wilson | |
| 2012/0236042 | A1 | 9/2012 | Parmar et al. | |
| 2013/0050165 | A1 | 2/2013 | Northway et al. | |
| 2013/0100097 | A1 | 4/2013 | Martin | |

FOREIGN PATENT DOCUMENTS

| | | | |
|---|---|---|---|
| EP | 1217598 | A2 | 6/2002 |
| EP | 1640761 | | 3/2006 |
| EP | 1734502 | A1 | 12/2006 |
| EP | 1942680 | A2 | 7/2008 |
| EP | 2362372 | A1 | 8/2011 |
| FR | 2760559 | A1 | 9/1998 |
| GB | 2321532 | A | 7/1998 |
| JP | 09281917 | | 10/1997 |
| JP | 11 211999 | | 8/1999 |
| KR | 1020010099592 | | 11/2001 |
| WO | WO-0070597 | A1 | 11/2000 |
| WO | WO-2006017129 | A2 | 2/2006 |

OTHER PUBLICATIONS

Jaatinen, Timo; "Essentials of Mobile User Interface", SID Mobile Displays, San Diego, CA, 2007.

Kubota et al. "Measurement of Light Incident on Mobile Displays in Various Environments", Journal of the SID, 14/11, 2006, pp. 999-1002.

U.S. Appl. No. 13/278,516, filed Oct. 21, 2011.

Akimoto O. et al., "15.1: A 0.9-in UXGA/HDTV FLC Microdisplay," Society for Information Display, 2000, pp. 194-197.

Alt P.M., et al., "A Gray-Scale Addressing Technique for Thin-Film-Transistor/Liquid Crystal Displays," IBM J. Res. Develop., 36 (1), Jan. 1992, pp. 11-22.

Bergquist et al., "Field Sequential Colour Display with Adaptive Gamut", Society for Information Display, Digest of Technical Papers, 2006, pp. 1594-1597.

Boer W.D., "Active Matrix Liquid Crystal Displays", Elsevier Science & Technology Books, ISBN #0750678135, Aug. 2005, Publisher's annotation in 2 pages.

Chino E. et al., "25.1: Invited Paper: Development of Wide-Color-Gamut Mobile Displays with Four-primary-color LCDs," Society for Information Display, 37 (2), 2006, pp. 1221-1224.

Clark N. A., et al., "FLC Microdisplays", Ferroelectrics, 246, 2000, pp. 97-110.

Doherty D. et al., "Pulse Width Modulation Control of DLP Projectors", TI Technical Journal, Jul.-Sep. 1998, No. 3, pp. 115-121.

Feenstra J. et al., "Electrowetting Displays", Liquavista BV, http://www.liquavista.com/documents/electrowetting__displays__whitepaper.pdf, Retrieved on Aug. 17, 2006, pp. 1-16.

Hornbeck J. "Digital Light Processing TM: A New MEMS-Based Display Technology," Technical Digest of the IEEJ 14th Sensor Symposium, Jun. 4-5, 1996, pp. 22.

"Image technology colour management—Architecture, profile format, and data structure", Specification ICC.1:2004-10 (Profile version 4.2.0.0) International Color Consortium 2004, available at http:"L/vywy.y"color"pmdCCj.y4Z__ZQMT95,pcjf, May 22, 2006, in 112 pages.

International Search Report—PCT/US2012/057354—ISA/EPO—Dec. 18, 2012.

Konno, et al., "RGB color control system for LED backlights in IPS-LCD TVs. SID symposium digest of technical papers," Section 3-4, 2005, pp. 1380-1383.

Kunzman A. et al., "10.3 White Enhancement for Color Sequential DLP", Society for Information Display, Digest of Technical Papers, 1998, in 4 pages.

Kwon O. S., et al., "High Fidelity Color Reproduction of Plasma Displays under Ambient Lighting", IEEE Transactions on Consumer Electronics, Aug. 2009, 55(3), 1015-1020.

Lee, et al., "40.1: Distinguished Contributed Paper: Integrated Amorphous Silicon Color Sensor on LCD Panel for LED Backlight Feedback Control System", Society for Information Display, Digest of Technical Papers, 2005, pp. 1376-1379.

Manzardo, et al., "Optics and Actuators for Miniaturized Spectrometers," International Conference on Optical MEMS, 2003, 12(6), 23-24.

Markandey V. et al., "Video Processing for DLP Display Systems," Texas Instruments Corporation, Mar. 13, 1996, pp. 21-32.

Miles M.W., "A MEMS Based Interferometric Modulator (IMOD) for Display Applications" Proceedings of Sensors Expo, Oct. 21, 1997 © 1997 Helmer's Publishing, Inc., pp. 281-284 XP009058455.

Miles M.W., "A New Reflective FPD Technology using Interferometric Modulation," Journal of the SID, 1997, vol. 5(4), 379-382.

Miles M.W. et al., "Interferometric Modulation a MEMS Based Technology for the Modulation of Light," Final Program and Proceedings IS&T's 50th Annual Conference, 1997, pp. 674-677.

Miles M.W., "MEMS-Based Interferometric Modulator for Display Applications," Proceedings of SPIE Conference on Micromachined Devices and Components V, Sep. 1999, SPIE vol. 3876, pp. 20-28.

Pasricha S. et al., "Dynamic Backlight Adaptation for Low Power Handheld Devices" IEEE Design and Test v. 21, 2004, in 17 pages.

Ravnkilde J., et al., "Fabrication of Nickel Microshutter Arrays for Spatial Light Modulation", Mesomechanics, 2002, pp. 161-165. Also on their web site: http://www2.mic.dtu.dk/research/mems/publications/Papers/Dicon__Meso2002.pdf.

"RGB to XYZ", available from http://www.brucelindbloom.com/Egn RGB to XYZ .html, Jan. 7, 2011., in 2 pages.

RGB/XYZ Matrices, available from http://www.brucelindbloom.com/ Ecin RGB to XYZ Matrix.html, Dec. 20, 2011, in 4 pages.

Takatori, et al., "6.3: Field-Sequential Smectic LCD with TFT Pixel Amplifier," SID 01, 2001, Digest, pp. 48-51.

Wang F., et al., "Multivariable Robust Control for a Red-Green-Blue LED Lighting System", Power Electronics, IEEE Transactions on Feb. 2010, vol. 25(2), pp. 417-428, ISSN : 0885-8993.

Wang K., et al., "Highly Space-Efficient Electrostatic Zigzag Transmissive Micro-Optic Switches for an Integrated MEMS Optical Display System", Transducers 03 Conference, Jun. 8-12, 2003, vol. 1, pp. 572-575.

Wikipedia, "Color balance", available from htViten, Mar. 21, 2012, in 6 pages, Retrieved from the Internet: <http://en.wikipedia.org/wiki/Color__balance>.

* cited by examiner

Common Voltages

| Segment Voltages | $VC_{ADD_H}$ | $VC_{HOLD_H}$ | $VC_{REL}$ | $VC_{HOLD_L}$ | $VC_{ADD_L}$ |
|---|---|---|---|---|---|
| $VS_H$ | Stable | Stable | Relax | Stable | Actuate |
| $VS_L$ | Actuate | Stable | Relax | Stable | Stable |

Ambient Illumination (condition)

DEVICE AND METHOD OF CONTROLLING BRIGHTNESS OF A DISPLAY BASED ON AMBIENT LIGHTING CONDITIONS

TECHNICAL FIELD

This disclosure relates to devices and methods of controlling brightness of a display based on ambient lighting conditions.

DESCRIPTION OF THE RELATED TECHNOLOGY

Electromechanical systems include devices having electrical and mechanical elements, actuators, transducers, sensors, optical components (e.g., mirrors) and electronics. Electromechanical systems can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of substrates and/or deposited material layers, or that add layers to form electrical and electromechanical devices.

One type of electromechanical systems device is called an interferometric modulator (IMOD). As used herein, the term interferometric modulator or interferometric light modulator refers to a device that selectively absorbs and/or reflects light using the principles of optical interference. In some implementations, an interferometric modulator may include a pair of conductive plates, one or both of which may be transparent and/or reflective, wholly or in part, and capable of relative motion upon application of an appropriate electrical signal. In an implementation, one plate may include a stationary layer deposited on a substrate and the other plate may include a reflective membrane separated from the stationary layer by an air gap. The position of one plate in relation to another can change the optical interference of light incident on the interferometric modulator. Interferometric modulator devices have a wide range of applications, and are anticipated to be used in improving existing products and creating new products, especially those with display capabilities.

Interferometric modulators and conventional liquid crystal elements can be included into a reflective or transflective displays that can use ambient light as a light source. One or more sensors can detect the illuminance of the ambient light and adjust an auxiliary light source accordingly. The image displayed on a display can be affected not only by the overall illuminance, but also by the direction of the ambient light.

SUMMARY

The systems, methods and devices of the disclosure each have several innovative aspects, no single one of which is solely responsible for the desirable attributes disclosed herein.

One innovative aspect of the subject matter described in this disclosure can be implemented in a display device. For example, the display device can include an auxiliary light source, a sensor system, and a controller. The auxiliary light source can be configured to provide supplemental light to a reflective display. The sensor system can be configured to determine an illuminance of ambient light illuminating the reflective display. The controller can be in communication with the sensor system and configured to adjust the auxiliary light source to provide an amount of supplemental light to the reflective display. The amount of supplemental light can be based at least in part on the illuminance of the ambient light. For example, the amount of supplemental light can remain substantially the same on average or substantially increase on average in response to increasing illuminance of the ambient light when the illuminance of the ambient light is below a first threshold. In addition, the amount of supplemental light can substantially decrease on average in response to increasing illuminance of the ambient light when the illuminance of the ambient light is above a second threshold that is greater than or equal to the first threshold.

For at least some illuminances below the first threshold, the amount of supplemental light can increase with increasing illuminance of the ambient light, for example, by a rate in a range from about 0 nit/lux to about 0.05 nit/lux. In addition, for at least some illuminances above the second threshold, the amount of supplemental light can decrease with increasing illuminance of the ambient light, for example, by a rate in a range from about 0.01 nit/lux to about 0.05 nit/lux.

In various implementations of the display device, the controller can be configured to access a look-up table (LUT) or a formula that provides the amount of supplemental light to be provided. In some implementations, the LUT or the formula can be based on a model that is non-monotonic for the amount of supplemental light as a function of the illuminance of the ambient light.

In some implementations, the first threshold can be greater than about 100 lux and the second threshold can be less than about 500 lux. In some implementations, the first threshold can be greater than about 150 lux and the second threshold can be less than about 300 lux. The amount of supplemental light can be approximately the same amount on average when the illuminance of the ambient light is between the first and second thresholds. For example, the amount of supplemental light can be in a range from about 20 nits to about 30 nits when the illuminance of the ambient light is between the first and second thresholds.

In some implementations, the first threshold can be approximately equal to the second threshold. In some other implementations, the amount of supplemental light can have a peak value for illuminance of the ambient light that is above the first threshold and below the second threshold. The peak value of the supplemental light can correspond to the maximum light that can be provided by the auxiliary light source. For example, the peak value of the supplemental light can be in a range from about 20 nits to about 30 nits.

In some implementations, the amount of supplemental light can remain approximately the same on average when the illuminance of the ambient light is below a third threshold that is less than the first threshold. For example, the amount of supplemental light can be in a range from about 5 nits to about 10 nits when the illuminance of the ambient light is below the third threshold. The third threshold can be less than about 50 lux. The amount of supplemental light also can be approximately zero when the illuminance of the ambient light is above a fourth threshold that is greater than the second threshold. The fourth threshold can be greater than about 800 lux.

In certain implementations, the controller can be configured to determine the amount of supplemental light based at least in part on content being displayed. Also, in some implementations, the controller can be configured to determine the amount of supplemental light based at least in part on viewer preferences. Furthermore, the controller can be configured to determine the amount of supplemental light based at least in part on at least one of a diffuse illuminance, a directed illuminance, a direction to the directed illuminance, and a location of a viewer.

In some implementations, the display device also can include a processor, for example, to process image data, and a memory device. The processor can be configured to communicate with the reflective display, and the memory device can be configured to communicate with the processor. Certain implementations of the display device further can include a driver circuit configured to send at least one signal to the reflective display. The display device also can include a driver controller configured to send at least a portion of the image data to the driver circuit. In addition, the display device can include an image source module configured to send the image data to the processor. The image source module can include at least one of a receiver, transceiver, and transmitter. Furthermore, the display device can include an input device configured to receive input data and to communicate the input data to the processor.

Another innovative aspect of the subject matter described in this disclosure can be implemented in a display device including means for providing supplemental light to a reflective display, means for determining an illuminance of ambient light illuminating the reflective display, and means for adjusting the supplemental light means. The adjusting means can be configured to determine an amount of supplemental light based at least in part on the determined illuminance of the ambient light. For example, the amount of supplemental light can remain substantially the same on average or substantially increase on average in response to increasing illuminance of the ambient light when the illuminance of the ambient light is below a first threshold. The amount of supplemental light also can substantially decrease on average in response to increasing illuminance of the ambient light when the illuminance of the ambient light is above a second threshold that is greater than or equal to the first threshold.

As an example, for at least some illuminances below the first threshold, the amount of supplemental light can increase with increasing illuminance of the ambient light by a rate in a range from about 0 nit/lux to about 0.05 nit/lux. As another example, for at least some illuminances above the second threshold, the amount of supplemental light can decrease with increasing illuminance of the ambient light by a rate in a range from about 0.01 nit/lux to about 0.05 nit/lux.

In various implementations of the display device, the reflective display can include interferometric modulators. In certain implementations, the means for providing supplemental light can include a front-light. In some implementations, the means for determining an illuminance can include a light sensor. Furthermore, the adjusting means can be configured to determine the amount of supplemental light based at least in part on at least one of content being displayed, viewer preferences, a diffuse illuminance, a directed illuminance, a direction to the directed illuminance, and a location of a viewer.

Another innovative aspect of the subject matter described in this disclosure can be implemented in a method of controlling supplemental lighting of a reflective display. As an example, the method can include determining by a light sensor an illuminance of ambient light illuminating the reflective display and automatically adjusting an auxiliary light source to provide an amount of supplemental light to the reflective display based at least in part on the illuminance of the ambient light. In some implementations, adjusting the auxiliary light source can include maintaining substantially the same amount of supplemental light on average or substantially increasing on average the amount of supplemental light in response to increasing illuminance of the ambient light when the illuminance of the ambient light is below a first threshold. Adjusting the auxiliary light source also can include substantially decreasing on average the amount of supplemental light in response to increasing illuminance of the ambient light when the illuminance of the ambient light is above a second threshold that is greater than or equal to the first threshold.

In some implementations, the method can also include accessing a LUT or a formula that provides the amount of supplemental light to be provided. For example, the LUT or the formula can be based on a model that is non-monotonic for the amount of supplemental light as a function of the illuminance of the ambient light. In some implementations, maintaining substantially the same amount of supplemental light on average or substantially increasing on average can include increasing the amount of supplemental light with increasing illuminance of the ambient light by a rate in a range from about 0 nit/lux to about 0.05 nit/lux when the illuminance of the ambient light is below the first threshold. Also, substantially decreasing on average can include decreasing the amount of supplemental light with increasing illuminance of the ambient light by a rate in a range from about 0.01 nit/lux to about 0.05 nit/lux when the illuminance of the ambient light is above the second threshold. In some implementations, the first threshold can be approximately equal to the second threshold.

Another innovative aspect of the subject matter described in this disclosure can be implemented in a non-transitory tangible computer storage medium having stored thereon instructions for controlling supplemental lighting of a reflective display of a display device. The instructions, when executed by a computing system, can cause the computing system to perform operations. As an example, the operations can include receiving from a computer-readable medium a determined illuminance of ambient light illuminating a reflective display, and determining an amount of supplemental light to provide to the reflective display based at least in part on the illuminance of the ambient light. For example, the amount of supplemental light can remain substantially the same on average or substantially increase on average in response to increasing illuminance of the ambient light when the illuminance of the ambient light is below a first threshold. In addition, the amount of supplemental light can substantially decrease on average in response to increasing illuminance of the ambient light when the illuminance of the ambient light is above a second threshold that is greater than or equal to the first threshold.

For at least some illuminances below the first threshold, the amount of supplemental light can increase with increasing illuminance of the ambient light by a rate in a range from about 0 nit/lux to about 0.05 nit/lux. For at least some illuminances above the second threshold, the amount of supplemental light can decrease with increasing illuminance of the ambient light by a rate in a range from about 0.01 nit/lux to about 0.05 nit/lux. In some implementations, the first threshold can be approximately equal to the second threshold.

In some implementations of the non-transitory computer storage medium, the operations further can include transmitting a supplemental lighting adjustment to a light source configured to provide light to the reflective display. The supplemental lighting adjustment can be based at least in part on the amount of supplemental light. In some implementations, the operations further can include accessing a LUT or a formula that provides the amount of supplemental light to be provided. The LUT or the formula can be based on a model that is non-monotonic for the amount of supplemental light as a function of the illuminance of the ambient light.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1:
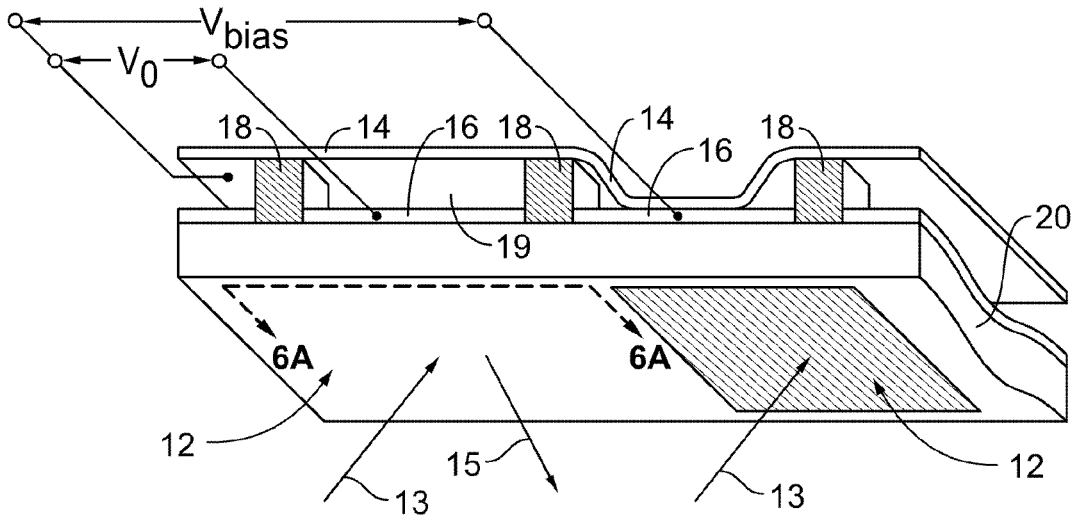
FIG. 1 shows an example of an isometric view depicting two adjacent pixels in a series of pixels of an interferometric modulator (IMOD) display device.

The following detailed description is directed to certain implementations for the purposes of describing the innovative aspects. However, the teachings herein can be applied in a multitude of different ways. The described implementations may be implemented in any device that is configured to display an image, whether in motion (e.g., video) or stationary (e.g., still image), and whether textual, graphical or pictorial. More particularly, it is contemplated that the implementations may be implemented in or associated with a variety of electronic devices such as, but not limited to, mobile telephones, multimedia Internet enabled cellular telephones, mobile television receivers, wireless devices, smartphones, bluetooth devices, personal data assistants (PDAs), wireless electronic mail receivers, hand-held or portable computers, netbooks, notebooks, smartbooks, tablets, printers, copiers, scanners, facsimile devices, GPS receivers/navigators, cameras, MP3 players, camcorders, game consoles, wrist watches, clocks, calculators, television monitors, flat panel displays, electronic reading devices (e.g., e-readers), computer monitors, auto displays (e.g., odometer display, etc.), cockpit controls and/or displays, camera view displays (e.g., display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (e.g., electromechanical systems (EMS), MEMS and non-MEMS), aesthetic structures (e.g., display of images on a piece of jewelry) and a variety of electromechanical systems devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes, and electronic test equipment. Thus, the teachings are not intended to be limited to the implementations depicted solely in the Figures, but instead have wide applicability as will be readily apparent to a person having ordinary skill in the art.

In some implementations, a display device can be fabricated using a display and a set of display elements such as spatial light modulating elements (e.g., interferometric modulators). The display device can use ambient light as a light source such that the image displayed on the display can be affected by the illuminance of the ambient light. In various implementations, the display device can include a sensor system to determine the illuminance of the ambient light. The display device also can include a controller to adjust an auxiliary light source to provide additional illumination (e.g., above the ambient lighting conditions) to at least some of the display elements. The amount of supplemental light can be based at least in part on the determined illuminance to control the brightness of the image to be displayed. For example, the amount of supplemental light can be based on an "inverted-V" illumination model. In one inverted-V model, the amount of supplemental light increases as ambient illuminance increases up to typical home lighting levels, and then the amount of supplemental light decreases for larger amounts of ambient illuminance (e.g., office or outdoor conditions). In some implementations, the amount of supplemental light also can be based on an illumination model based at least in part on the content (e.g., text, image, or video) being displayed, viewer preferences, a diffuse illuminance, a directed illuminance, a direction to the directed illuminance, or a location of the viewer.

Particular implementations of the subject matter described in this disclosure can be used to realize one or more of the following potential advantages. For example, various implementations are configured to produce an energy-efficient display device. For example, the display device can determine how much, if any, additional lighting can be added to the display device based at least in part on the illuminance of the ambient light to provide a display device of low power consumption that also provides an acceptable comfort level of brightness for viewers of the display. This determination can be used to adjust the brightness of the display to produce a default "green" mode. Certain implementations also allow further adjustment of the brightness of the display based on viewer preference. In certain implementations, the display device further can determine how much, if any, additional lighting can be added to the display device based at least in part on measured diffuse and/or directed illuminance of the ambient light, and/or the direction of the ambient light, and/or the measured, assumed, or estimated location of the viewer of the device to provide a brighter image on a display. Various implementations also may provide an improved or optimized viewing experience based at least in part on the content being displayed (e.g., whether the content is a text, an image, or a video).

An example of a suitable EMS or MEMS device, to which the described implementations may apply, is a reflective display device. Reflective display devices can incorporate interferometric modulators (IMODs) to selectively absorb and/or reflect light incident thereon using principles of optical interference. IMODs can include an absorber, a reflector that is movable with respect to the absorber, and an optical resonant cavity defined between the absorber and the reflector. The reflector can be moved to two or more different positions, which can change the size of the optical resonant cavity and thereby affect the reflectance of the interferometric modulator. The reflectance spectrums of IMODs can create fairly broad spectral bands which can be shifted across the visible wavelengths to generate different colors. The position of the spectral band can be adjusted by changing the thickness of the optical resonant cavity, i.e., by changing the position of the reflector.

FIG. 1 shows an example of an isometric view depicting two adjacent pixels in a series of pixels of an interferometric modulator (IMOD) display device. The IMOD display device includes one or more interferometric MEMS display elements. In these devices, the pixels of the MEMS display elements can be in either a bright or dark state. In the bright ("relaxed," "open" or "on") state, the display element reflects a large portion of incident visible light, e.g., to a user. Conversely, in the dark ("actuated," "closed" or "off") state, the display element reflects little incident visible light. In some implementations, the light reflectance properties of the on and off states may be reversed. MEMS pixels can be configured to reflect predominantly at particular wavelengths allowing for a color display in addition to black and white.

The IMOD display device can include a row/column array of IMODs. Each IMOD can include a pair of reflective layers, i.e., a movable reflective layer and a fixed partially reflective layer, positioned at a variable and controllable distance from each other to form an air gap (also referred to as an optical gap or cavity). The movable reflective layer may be moved between at least two positions. In a first position, i.e., a relaxed position, the movable reflective layer can be positioned at a relatively large distance from the fixed partially reflective layer. In a second position, i.e., an actuated position, the movable reflective layer can be positioned more closely to the partially reflective layer. Incident light that reflects from the two layers can interfere constructively or destructively depending on the position of the movable reflective layer, producing either an overall reflective or non-reflective state for each pixel. In some implementations, the IMOD may be in a reflective state when unactuated, reflecting light within the visible spectrum, and may be in a dark state when unactuated, reflecting light outside of the visible range (e.g., infrared light). In some other implementations, however, an IMOD may be in a dark state when unactuated, and in a reflective state when actuated. In some implementations, the introduction of an applied voltage can drive the pixels to change states. In some other implementations, an applied charge can drive the pixels to change states.

The depicted portion of the pixel array in FIG. 1 includes two adjacent interferometric modulators 12. In the IMOD 12 on the left (as illustrated), a movable reflective layer 14 is illustrated in a relaxed position at a predetermined distance from an optical stack 16, which includes a partially reflective layer. The voltage $V_0$ applied across the IMOD 12 on the left is insufficient to cause actuation of the movable reflective layer 14. In the IMOD 12 on the right, the movable reflective layer 14 is illustrated in an actuated position near or adjacent the optical stack 16. The voltage $V_{bias}$ applied across the IMOD 12 on the right is sufficient to maintain the movable reflective layer 14 in the actuated position.

In FIG. 1, the reflective properties of pixels 12 are generally illustrated with arrows 13 indicating light incident upon the pixels 12, and light 15 reflecting from the pixel 12 on the left. Although not illustrated in detail, it will be understood by a person having ordinary skill in the art that most of the light 13 incident upon the pixels 12 will be transmitted through the transparent substrate 20, toward the optical stack 16. A portion of the light incident upon the optical stack 16 will be transmitted through the partially reflective layer of the optical stack 16, and a portion will be reflected back through the transparent substrate 20. The portion of light 13 that is transmitted through the optical stack 16 will be reflected at the movable reflective layer 14, back toward (and through) the transparent substrate 20. Interference (constructive or destructive) between the light reflected from the partially reflective layer of the optical stack 16 and the light reflected from the movable reflective layer 14 will determine the wavelength(s) of light 15 reflected from the pixel 12.

The optical stack 16 can include a single layer or several layers. The layer(s) can include one or more of an electrode layer, a partially reflective and partially transmissive layer and a transparent dielectric layer. In some implementations, the optical stack 16 is electrically conductive, partially transparent and partially reflective, and may be fabricated, for example, by depositing one or more of the above layers onto a transparent substrate 20. The electrode layer can be formed from a variety of materials, such as various metals, for example indium tin oxide (ITO). The partially reflective layer can be formed from a variety of materials that are partially reflective, such as various metals, e.g., chromium (Cr), semiconductors, and dielectrics. The partially reflective layer can be formed of one or more layers of materials, and each of the layers can be formed of a single material or a combination of materials. In some implementations, the optical stack 16 can include a single semi-transparent thickness of metal or semiconductor which serves as both an optical absorber and conductor, while different, more conductive layers or portions (e.g., of the optical stack 16 or of other structures of the IMOD) can serve to bus signals between IMOD pixels. The optical stack 16 also can include one or more insulating or dielectric layers covering one or more conductive layers or a conductive/absorptive layer.

In some implementations, the layer(s) of the optical stack 16 can be patterned into parallel strips, and may form row electrodes in a display device as described further below. As will be understood by one having skill in the art, the term "patterned" is used herein to refer to masking as well as etching processes. In some implementations, a highly conductive and reflective material, such as aluminum (Al), may be used for the movable reflective layer 14, and these strips may form column electrodes in a display device. The movable reflective layer 14 may be formed as a series of parallel strips of a deposited metal layer or layers (orthogonal to the row electrodes of the optical stack 16) to form columns deposited on top of posts 18 and an intervening sacrificial material deposited between the posts 18. When the sacrificial material is etched away, a defined gap 19, or optical cavity, can be formed between the movable reflective layer 14 and the optical stack 16. In some implementations, the spacing between posts 18 may be approximately 1-1000 um, while the gap 19 may be less than 10,000 Angstroms (Å).

In some implementations, each pixel of the IMOD, whether in the actuated or relaxed state, is essentially a capacitor formed by the fixed and moving reflective layers. When no voltage is applied, the movable reflective layer 14 remains in a mechanically relaxed state, as illustrated by the pixel 12 on the left in FIG. 1, with the gap 19 between the movable reflective layer 14 and optical stack 16. However, when a potential difference, e.g., voltage, is applied to at least one of a selected row and column, the capacitor formed at the intersection of the row and column electrodes at the corresponding pixel becomes charged, and electrostatic forces pull the electrodes together. If the applied voltage exceeds a threshold, the movable reflective layer 14 can deform and move near or against the optical stack 16. A dielectric layer (not shown) within the optical stack 16 may prevent shorting and control the separation distance between the layers 14 and 16, as illustrated by the actuated pixel 12 on the right in FIG. 1. The behavior is the same regardless of the polarity of the applied potential difference. Though a series of pixels in an array may be referred to in some instances as "rows" or "columns," a person having ordinary skill in the art will readily understand that referring to one direction as a "row" and another as a "column" is arbitrary. Restated, in some orientations, the rows can be considered columns, and the columns considered to be rows. Furthermore, the display elements may be evenly arranged in orthogonal rows and columns (an "array"), or arranged in non-linear configurations, for example, having certain positional offsets with respect to one another (a "mosaic"). The terms "array" and "mosaic" may refer to either configuration. Thus, although the display is referred to as including an "array" or "mosaic," the elements themselves need not be arranged orthogonally to one another, or disposed in an even distribution, in any instance, but may include arrangements having asymmetric shapes and unevenly distributed elements.

Figure 2:
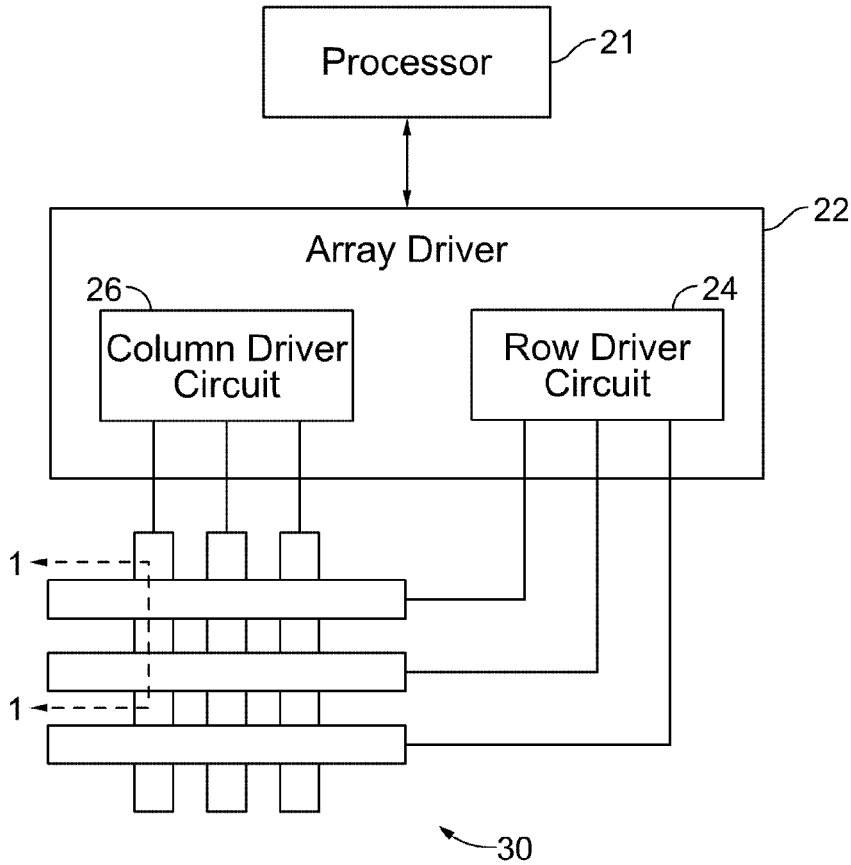
FIG. 2 shows an example of a system block diagram illustrating an electronic device incorporating a 3×3 interferometric modulator display.

FIG. 2 shows an example of a system block diagram illustrating an electronic device incorporating a 3×3 interferometric modulator display. The electronic device includes a processor 21 that may be configured to execute one or more software modules. In addition to executing an operating system, the processor 21 may be configured to execute one or more software applications, including a web browser, a telephone application, an email program, or any other software application.

The processor 21 can be configured to communicate with an array driver 22. The array driver 22 can include a row driver circuit 24 and a column driver circuit 26 that provide signals to, e.g., a display array or panel 30. The cross section of the IMOD display device illustrated in FIG. 1 is shown by the lines 1-1 in FIG. 2. Although FIG. 2 illustrates a 3×3 array of IMODs for the sake of clarity, the display array 30 may contain a very large number of IMODs, and may have a different number of IMODs in rows than in columns, and vice versa.

Figures 3, 4:
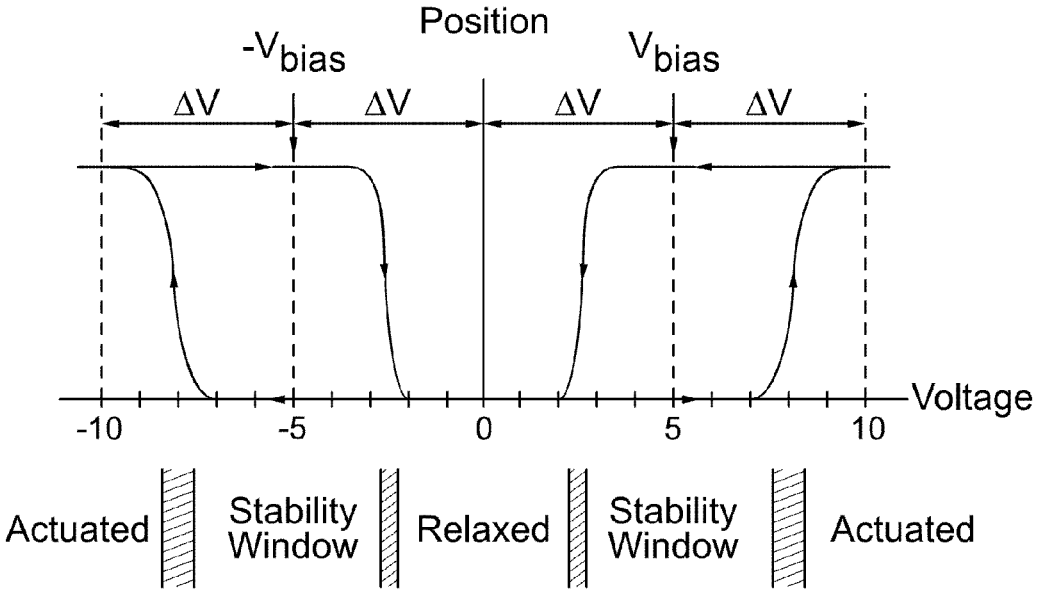
FIG. 3 shows an example of a diagram illustrating movable reflective layer position versus applied voltage for the interferometric modulator of FIG. 1.
FIG. 4 shows an example of a table illustrating various states of an interferometric modulator when various common and segment voltages are applied.

FIG. 3 shows an example of a diagram illustrating movable reflective layer position versus applied voltage for the interferometric modulator of FIG. 1. For MEMS interferometric modulators, the row/column (i.e., common/segment) write procedure may take advantage of a hysteresis property of these devices as illustrated in FIG. 3. An interferometric modulator may require, for example, about a 10-volt potential difference to cause the movable reflective layer, or mirror, to change from the relaxed state to the actuated state. When the voltage is reduced from that value, the movable reflective layer maintains its state as the voltage drops back below, e.g., 10-volts, however, the movable reflective layer does not relax completely until the voltage drops below 2-volts. Thus, a range of voltage, approximately 3 to 7-volts, as shown in FIG. 3, exists where there is a window of applied voltage within which the device is stable in either the relaxed or actuated state. This is referred to herein as the "hysteresis window" or "stability window." For a display array 30 having the hysteresis characteristics of FIG. 3, the row/column write procedure can be designed to address one or more rows at a time, such that during the addressing of a given row, pixels in the addressed row that are to be actuated are exposed to a voltage difference of about 10-volts, and pixels that are to be relaxed are exposed to a voltage difference of near zero volts. After addressing, the pixels are exposed to a steady state or bias voltage difference of approximately 5-volts such that they remain in the previous strobing state. In this example, after being addressed, each pixel sees a potential difference within the "stability window" of about 3-7-volts. This hysteresis property feature enables the pixel design, e.g., illustrated in FIG. 1, to remain stable in either an actuated or relaxed pre-existing state under the same applied voltage conditions. Since each IMOD pixel, whether in the actuated or relaxed state, is essentially a capacitor formed by the fixed and moving reflective layers, this stable state can be held at a steady voltage within the hysteresis window without substantially consuming or losing power. Moreover, essentially little or no current flows into the IMOD pixel if the applied voltage potential remains substantially fixed.

In some implementations, a frame of an image may be created by applying data signals in the form of "segment" voltages along the set of column electrodes, in accordance with the desired change (if any) to the state of the pixels in a given row. Each row of the array can be addressed in turn, such that the frame is written one row at a time. To write the desired data to the pixels in a first row, segment voltages corresponding to the desired state of the pixels in the first row can be applied on the column electrodes, and a first row pulse in the form of a specific "common" voltage or signal can be applied to the first row electrode. The set of segment voltages can then be changed to correspond to the desired change (if any) to the state of the pixels in the second row, and a second common voltage can be applied to the second row electrode. In some implementations, the pixels in the first row are unaffected by the change in the segment voltages applied along the column electrodes, and remain in the state they were set to during the first common voltage row pulse. This process may be repeated for the entire series of rows, or alternatively, columns, in a sequential fashion to produce the image frame. The frames can be refreshed and/or updated with new image data by continually repeating this process at some desired number of frames per second.

The combination of segment and common signals applied across each pixel (that is, the potential difference across each pixel) determines the resulting state of each pixel. FIG. 4 shows an example of a table illustrating various states of an interferometric modulator when various common and segment voltages are applied. As will be readily understood by one having ordinary skill in the art, the "segment" voltages can be applied to either the column electrodes or the row electrodes, and the "common" voltages can be applied to the other of the column electrodes or the row electrodes.

As illustrated in FIG. 4 (as well as in the timing diagram shown in FIG. 5B), when a release voltage $VC_{REL}$ is applied along a common line, all interferometric modulator elements along the common line will be placed in a relaxed state, alternatively referred to as a released or unactuated state, regardless of the voltage applied along the segment lines, i.e., high segment voltage $VS_H$ and low segment voltage $VS_L$. In particular, when the release voltage $VC_{REL}$ is applied along a common line, the potential voltage across the modulator (alternatively referred to as a pixel voltage) is within the relaxation window (see FIG. 3, also referred to as a release window) both when the high segment voltage $VS_H$ and the low segment voltage $VS_L$ are applied along the corresponding segment line for that pixel.

When a hold voltage is applied on a common line, such as a high hold voltage $VC_{HOLD_H}$ or a low hold voltage $VC_{HOLD_L}$, the state of the interferometric modulator will remain constant. For example, a relaxed IMOD will remain in a relaxed position, and an actuated IMOD will remain in an actuated position. The hold voltages can be selected such that the pixel voltage will remain within a stability window both when the high segment voltage $VS_H$ and the low segment voltage $VS_L$ are applied along the corresponding segment line. Thus, the segment voltage swing, i.e., the difference between the high $VS_H$ and low segment voltage $VS_L$, is less than the width of either the positive or the negative stability window.

When an addressing, or actuation, voltage is applied on a common line, such as a high addressing voltage $VC_{ADD_H}$ or a low addressing voltage $VC_{ADD_L}$, data can be selectively written to the modulators along that line by application of segment voltages along the respective segment lines. The segment voltages may be selected such that actuation is dependent upon the segment voltage applied. When an addressing voltage is applied along a common line, application of one segment voltage will result in a pixel voltage within a stability window, causing the pixel to remain unactuated. In contrast, application of the other segment voltage will result in a pixel voltage beyond the stability window, resulting in actuation of the pixel. The particular segment voltage which causes actuation can vary depending upon which addressing voltage is used. In some implementations, when the high addressing voltage $VC_{ADD_H}$ is applied along the common line, application of the high segment voltage $VS_H$ can cause a modulator to remain in its current position, while application of the low segment voltage $VS_L$ can cause actuation of the modulator. As a corollary, the effect of the segment voltages can be the opposite when a low addressing voltage $VC_{ADD_L}$ is applied, with high segment voltage $VS_H$ causing actuation of the modulator, and low segment voltage $VS_L$ having no effect (i.e., remaining stable) on the state of the modulator.

In some implementations, hold voltages, address voltages, and segment voltages may be used which always produce the same polarity potential difference across the modulators. In some other implementations, signals can be used which alternate the polarity of the potential difference of the modulators. Alternation of the polarity across the modulators (that is, alternation of the polarity of write procedures) may reduce or inhibit charge accumulation which could occur after repeated write operations of a single polarity.

Figure 5A:
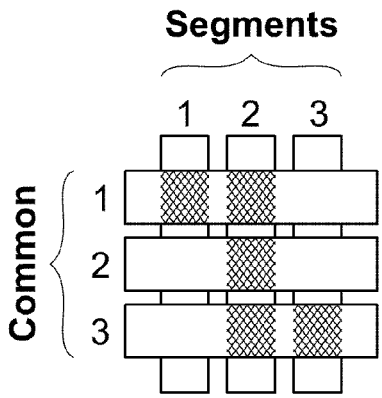
FIG. 5A shows an example of a diagram illustrating a frame of display data in the 3×3 interferometric modulator display of FIG. 2.
Figure 5B:
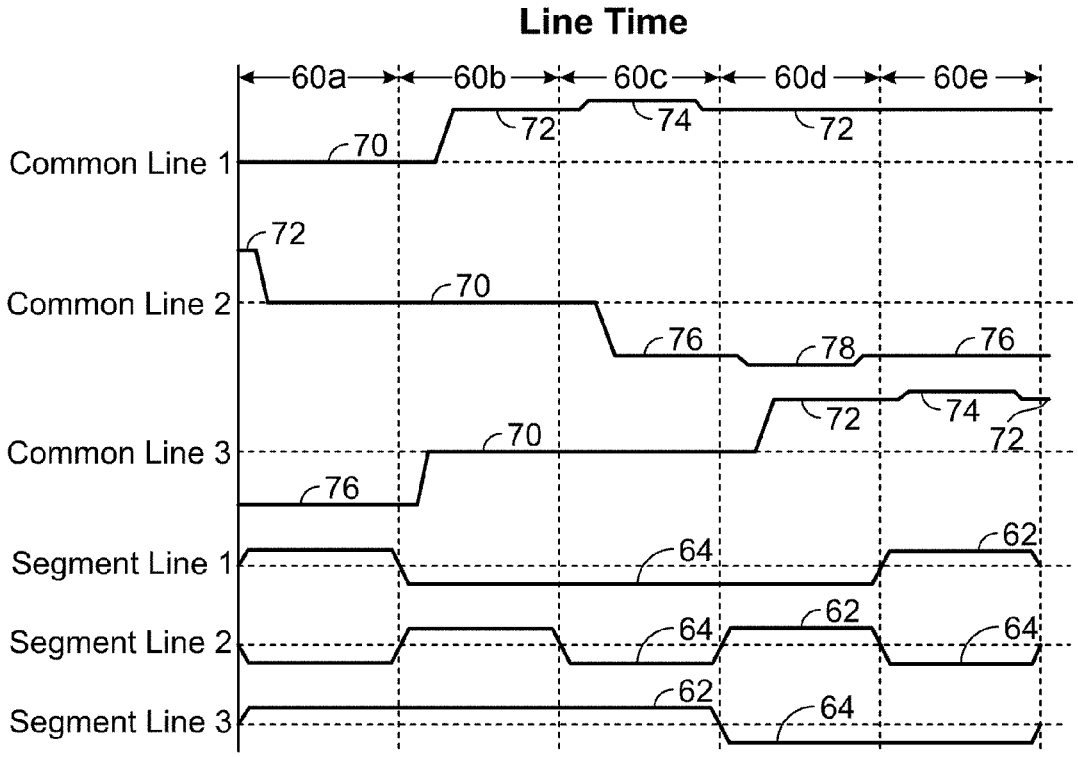
FIG. 5B shows an example of a timing diagram for common and segment signals that may be used to write the frame of display data illustrated in FIG. 5A.

FIG. 5A shows an example of a diagram illustrating a frame of display data in the 3×3 interferometric modulator display of FIG. 2. FIG. 5B shows an example of a timing diagram for common and segment signals that may be used to write the frame of display data illustrated in FIG. 5A. The signals can be applied to the, e.g., 3×3 array of FIG. 2, which will ultimately result in the line time 60*e* display arrangement illustrated in FIG. 5A. The actuated modulators in FIG. 5A are in a dark-state, i.e., where a substantial portion of the reflected light is outside of the visible spectrum so as to result in a dark appearance to, e.g., a viewer. Prior to writing the frame illustrated in FIG. 5A, the pixels can be in any state, but the write procedure illustrated in the timing diagram of FIG. 5B presumes that each modulator has been released and resides in an unactuated state before the first line time 60*a*.

During the first line time 60*a*: a release voltage 70 is applied on common line 1; the voltage applied on common line 2 begins at a high hold voltage 72 and moves to a release voltage 70; and a low hold voltage 76 is applied along common line 3. Thus, the modulators (common 1, segment 1), (1,2) and (1,3) along common line 1 remain in a relaxed, or unactuated, state for the duration of the first line time 60*a*, the modulators (2,1), (2,2) and (2,3) along common line 2 will move to a relaxed state, and the modulators (3,1), (3,2) and (3,3) along common line 3 will remain in their previous state. With reference to FIG. 4, the segment voltages applied along segment lines 1, 2 and 3 will have no effect on the state of the interferometric modulators, as none of common lines 1, 2 or 3 are being exposed to voltage levels causing actuation during line time 60*a* (i.e., $VC_{REL}$—relax and $VC_{HOLD_L}$—stable).

During the second line time 60*b*, the voltage on common line 1 moves to a high hold voltage 72, and all modulators along common line 1 remain in a relaxed state regardless of the segment voltage applied because no addressing, or actuation, voltage was applied on the common line 1. The modulators along common line 2 remain in a relaxed state due to the application of the release voltage 70, and the modulators (3,1), (3,2) and (3,3) along common line 3 will relax when the voltage along common line 3 moves to a release voltage 70.

During the third line time 60*c*, common line 1 is addressed by applying a high address voltage 74 on common line 1. Because a low segment voltage 64 is applied along segment lines 1 and 2 during the application of this address voltage, the pixel voltage across modulators (1,1) and (1,2) is greater than the high end of the positive stability window (i.e., the voltage differential exceeded a predefined threshold) of the modulators, and the modulators (1,1) and (1,2) are actuated. Conversely, because a high segment voltage 62 is applied along segment line 3, the pixel voltage across modulator (1,3) is less than that of modulators (1,1) and (1,2), and remains within the positive stability window of the modulator; modulator (1,3) thus remains relaxed. Also during line time 60*c*, the voltage along common line 2 decreases to a low hold voltage 76, and the voltage along common line 3 remains at a release voltage 70, leaving the modulators along common lines 2 and 3 in a relaxed position.

During the fourth line time 60*d*, the voltage on common line 1 returns to a high hold voltage 72, leaving the modulators along common line 1 in their respective addressed states. The voltage on common line 2 is decreased to a low address voltage 78. Because a high segment voltage 62 is applied along segment line 2, the pixel voltage across modulator (2,2) is below the lower end of the negative stability window of the modulator, causing the modulator (2,2) to actuate. Conversely, because a low segment voltage 64 is applied along segment lines 1 and 3, the modulators (2,1) and (2,3) remain in a relaxed position. The voltage on common line 3 increases to a high hold voltage 72, leaving the modulators along common line 3 in a relaxed state.

Finally, during the fifth line time 60*e*, the voltage on common line 1 remains at high hold voltage 72, and the voltage on common line 2 remains at a low hold voltage 76, leaving the modulators along common lines 1 and 2 in their respective addressed states. The voltage on common line 3 increases to a high address voltage 74 to address the modulators along common line 3. As a low segment voltage 64 is applied on segment lines 2 and 3, the modulators (3,2) and (3,3) actuate, while the high segment voltage 62 applied along segment line 1 causes modulator (3,1) to remain in a relaxed position. Thus, at the end of the fifth line time 60*e*, the 3×3 pixel array is in the state shown in FIG. 5A, and will remain in that state as long as the hold voltages are applied along the common lines, regardless of variations in the segment voltage which may occur when modulators along other common lines (not shown) are being addressed.

In the timing diagram of FIG. 5B, a given write procedure (i.e., line times 60*a*-60*e*) can include the use of either high hold and address voltages, or low hold and address voltages. Once the write procedure has been completed for a given common line (and the common voltage is set to the hold voltage having the same polarity as the actuation voltage), the pixel voltage remains within a given stability window, and does not pass through the relaxation window until a release voltage is applied on that common line. Furthermore, as each modulator is released as part of the write procedure prior to addressing the modulator, the actuation time of a modulator, rather than the release time, may determine the necessary line time. Specifically, in implementations in which the release time of a modulator is greater than the actuation time, the release voltage may be applied for longer than a single line time, as depicted in FIG. 5B. In some other implementations, voltages applied along common lines or segment lines may vary to account for variations in the actuation and release voltages of different modulators, such as modulators of different colors.

Figure 6A:
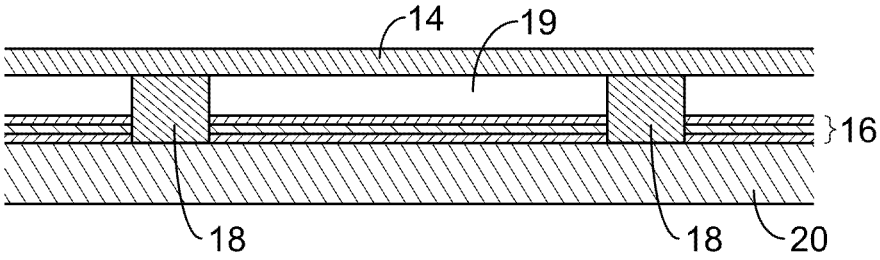
FIG. 6A shows an example of a partial cross-section of the interferometric modulator display of FIG. 1.
Figure 6B:
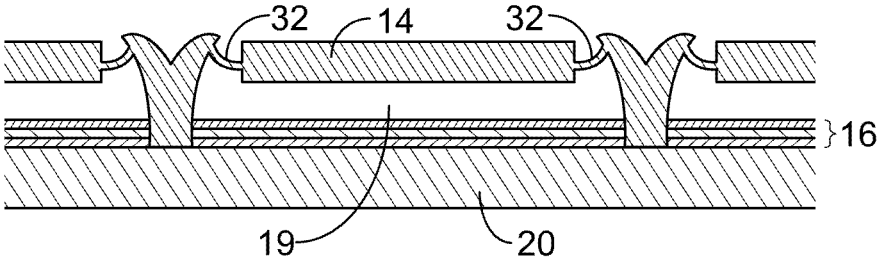
FIGS. 6B-6E show examples of cross-sections of varying implementations of interferometric modulators.
Figure 6C:
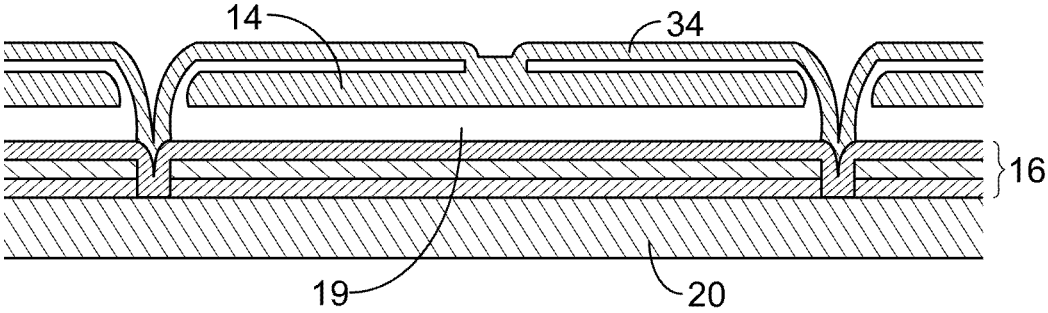

The details of the structure of interferometric modulators that operate in accordance with the principles set forth above may vary widely. For example, FIGS. 6A-6E show examples of cross-sections of varying implementations of interferometric modulators, including the movable reflective layer 14 and its supporting structures. FIG. 6A shows an example of a partial cross-section of the interferometric modulator display of FIG. 1, where a strip of metal material, i.e., the movable reflective layer 14 is deposited on supports 18 extending orthogonally from the substrate 20. In FIG. 6B, the movable reflective layer 14 of each IMOD is generally square or rectangular in shape and attached to supports at or near the corners, on tethers 32. In FIG. 6C, the movable reflective layer 14 is generally square or rectangular in shape and suspended from a deformable layer 34, which may include a flexible metal. The deformable layer 34 can connect, directly or indirectly, to the substrate 20 around the perimeter of the movable reflective layer 14. These connections are herein referred to as support posts. The implementation shown in FIG. 6C has additional benefits deriving from the decoupling of the optical functions of the movable reflective layer 14 from its mechanical functions, which are carried out by the deformable layer 34. This decoupling allows the structural design and materials used for the reflective layer 14 and those used for the deformable layer 34 to be optimized independently of one another.

Figure 6D:
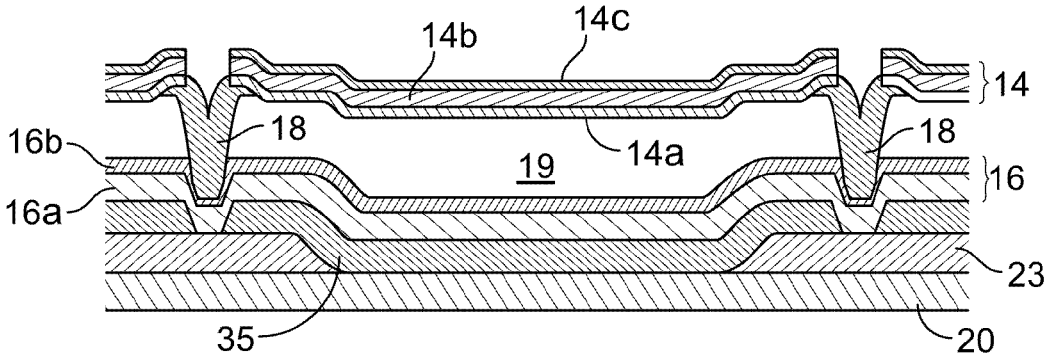

FIG. 6D shows another example of an IMOD, where the movable reflective layer 14 includes a reflective sub-layer 14*a*. The movable reflective layer 14 rests on a support structure, such as support posts 18. The support posts 18 provide separation of the movable reflective layer 14 from the lower stationary electrode (i.e., part of the optical stack 16 in the illustrated IMOD) so that a gap 19 is formed between the movable reflective layer 14 and the optical stack 16, for example when the movable reflective layer 14 is in a relaxed position. The movable reflective layer 14 also can include a conductive layer 14*c*, which may be configured to serve as an electrode, and a support layer 14*b*. In this example, the conductive layer 14*c* is disposed on one side of the support layer 14*b*, distal from the substrate 20, and the reflective sub-layer 14*a* is disposed on the other side of the support layer 14*b*, proximal to the substrate 20. In some implementations, the reflective sub-layer 14*a* can be conductive and can be disposed between the support layer 14*b* and the optical stack 16. The support layer 14*b* can include one or more layers of a dielectric material, for example, silicon oxynitride (SiON) or silicon dioxide ($SiO_2$). In some implementations, the support layer 14*b* can be a stack of layers, such as, for example, a $SiO_2$/SiON/$SiO_2$ tri-layer stack. Either or both of the reflective sub-layer 14*a* and the conductive layer 14*c* can include, e.g., an aluminum (Al) alloy with about 0.5% copper (Cu), or another reflective metallic material. Employing conductive layers 14*a*, 14*c* above and below the dielectric support layer 14*b* can balance stresses and provide enhanced conduction. In some implementations, the reflective sub-layer 14*a* and the conductive layer 14*c* can be formed of different materials for a variety of design purposes, such as achieving specific stress profiles within the movable reflective layer 14.

As illustrated in FIG. 6D, some implementations also can include a black mask structure 23. The black mask structure 23 can be formed in optically inactive regions (e.g., between pixels or under posts 18) to absorb ambient or stray light. The black mask structure 23 also can improve the optical properties of a display device by inhibiting light from being reflected from or transmitted through inactive portions of the display, thereby increasing the contrast ratio. Additionally, the black mask structure 23 can be conductive and be configured to function as an electrical bussing layer. In some implementations, the row electrodes can be connected to the black mask structure 23 to reduce the resistance of the connected row electrode. The black mask structure 23 can be formed using a variety of methods, including deposition and patterning techniques. The black mask structure 23 can include one or more layers. For example, in some implementations, the black mask structure 23 includes a molybdenum-chromium (MoCr) layer that serves as an optical absorber, a spacer layer (e.g., $SiO_2$), and an aluminum alloy that serves as a reflector and a bussing layer, with a thickness in the range of about 30-80 Å, 500-1000 Å, and 500-6000 Å, respectively. The one or more layers can be patterned using a variety of techniques, including photolithography and dry etching, including, for example, carbon tetrafluoromethane ($CF_4$) and/or oxygen ($O_2$) for the MoCr and $SiO_2$ layers and chlorine ($Cl_2$) and/or boron trichloride ($BCl_3$) for the aluminum alloy layer. In some implementations, the black mask 23 can be an etalon or interferometric stack structure. In such interferometric stack black mask structures 23, the conductive absorbers can be used to transmit or bus signals between lower, stationary electrodes in the optical stack 16 of each row or column. In some implementations, a spacer layer 35 can serve to generally electrically isolate the absorber layer 16*a* from the conductive layers in the black mask 23.

Figure 6E:
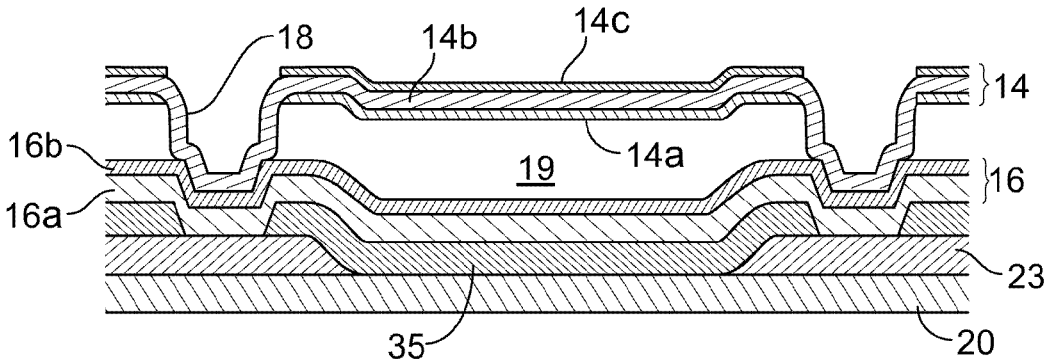

FIG. 6E shows another example of an IMOD, where the movable reflective layer 14 is self supporting. In contrast with FIG. 6D, the implementation of FIG. 6E does not include support posts 18. Instead, the movable reflective layer 14 contacts the underlying optical stack 16 at multiple locations, and the curvature of the movable reflective layer 14 provides sufficient support that the movable reflective layer 14 returns to the unactuated position of FIG. 6E when the voltage across the interferometric modulator is insufficient to cause actuation. The optical stack 16, which may contain a plurality of several different layers, is shown here for clarity including an optical absorber 16*a*, and a dielectric 16*b*. In some implementations, the optical absorber 16*a* may serve both as a fixed electrode and as a partially reflective layer.

In implementations such as those shown in FIGS. 6A-6E, the IMODs function as direct-view devices, in which images are viewed from the front side of the transparent substrate 20, i.e., the side opposite to that upon which the modulator is arranged. In these implementations, the back portions of the device (that is, any portion of the display device behind the movable reflective layer 14, including, for example, the deformable layer 34 illustrated in FIG. 6C) can be configured and operated upon without impacting or negatively affecting the image quality of the display device, because the reflective layer 14 optically shields those portions of the device. For example, in some implementations a bus structure (not illustrated) can be included behind the movable reflective layer 14 which provides the ability to separate the optical properties of the modulator from the electromechanical properties of the modulator, such as voltage addressing and the movements that result from such addressing. Additionally, the implementations of FIGS. 6A-6E can simplify processing, such as, e.g., patterning.

Figure 7:
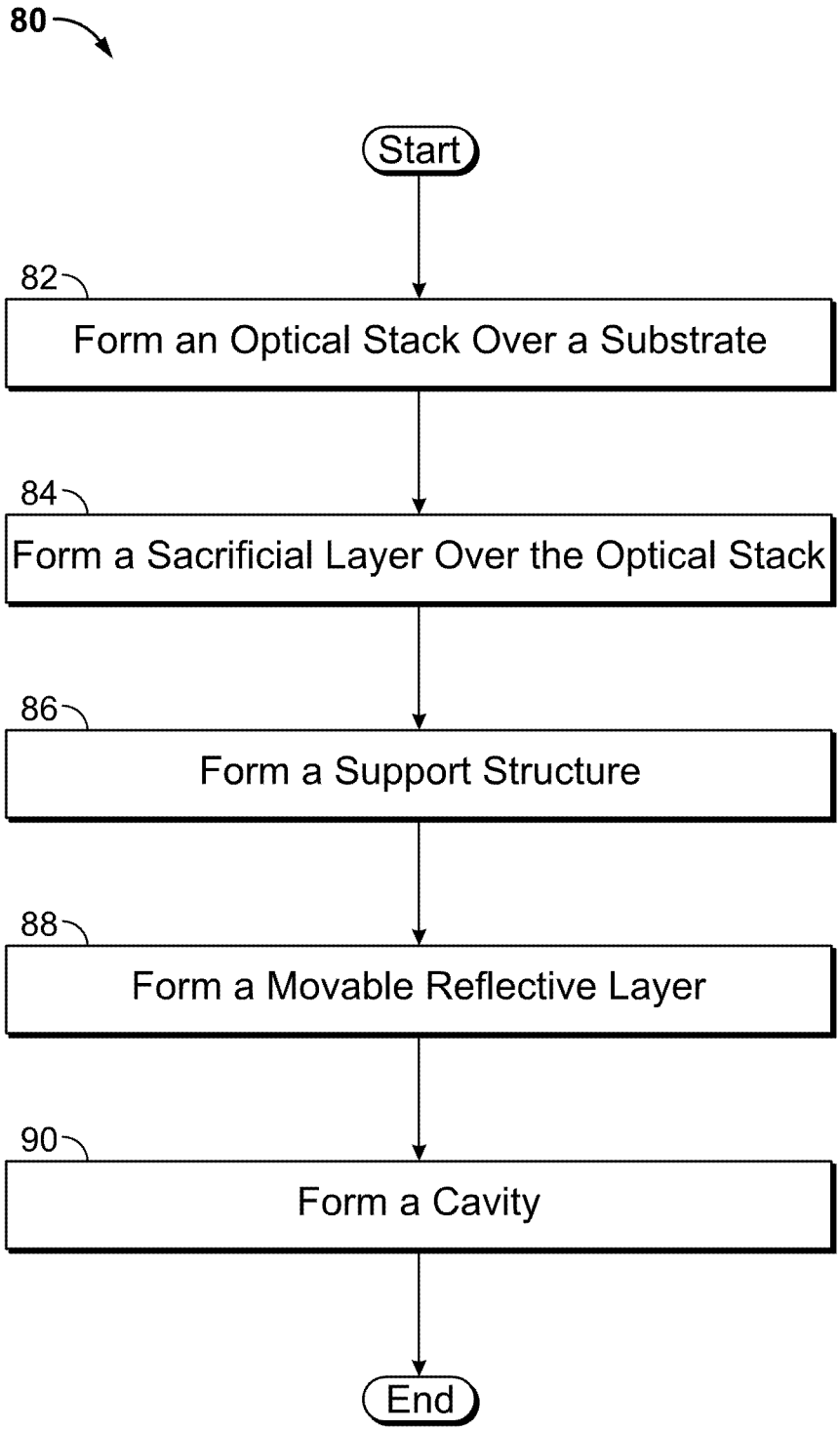
FIG. 7 shows an example of a flow diagram illustrating a manufacturing process for an interferometric modulator.
Figure 8A:
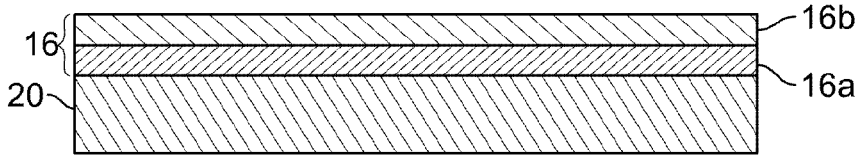
FIGS. 8A-8E show examples of cross-sectional schematic illustrations of various stages in a method of making an interferometric modulator.

FIG. 7 shows an example of a flow diagram illustrating a manufacturing process 80 for an interferometric modulator, and FIGS. 8A-8E show examples of cross-sectional schematic illustrations of corresponding stages of such a manufacturing process 80. In some implementations, the manufacturing process 80 can be implemented to manufacture, e.g., interferometric modulators of the general type illustrated in FIGS. 1 and 6, in addition to other blocks not shown in FIG. 7. With reference to FIGS. 1, 6 and 7, the process 80 begins at block 82 with the formation of the optical stack 16 over the substrate 20. FIG. 8A illustrates such an optical stack 16 formed over the substrate 20. The substrate 20 may be a transparent substrate such as glass or plastic, it may be flexible or relatively stiff and unbending, and may have been subjected to prior preparation processes, e.g., cleaning, to facilitate efficient formation of the optical stack 16. As discussed above, the optical stack 16 can be electrically conductive, partially transparent and partially reflective and may be fabricated, for example, by depositing one or more layers having the desired properties onto the transparent substrate 20. In FIG. 8A, the optical stack 16 includes a multilayer structure having sub-layers 16*a* and 16*b*, although more or fewer sub-layers may be included in some other implementations. In some implementations, one of the sub-layers 16*a*, 16*b* can be configured with both optically absorptive and conductive properties, such as the combined conductor/absorber sub-layer 16*a*. Additionally, one or more of the sub-layers 16*a*, 16*b* can be patterned into parallel strips, and may form row electrodes in a display device. Such patterning can be performed by a masking and etching process or another suitable process known in the art. In some implementations, one of the sub-layers 16*a*, 16*b* can be an insulating or dielectric layer, such as sub-layer 16*b* that is deposited over one or more metal layers (e.g., one or more reflective and/or conductive layers). In addition, the optical stack 16 can be patterned into individual and parallel strips that form the rows of the display.

Figure 8B:
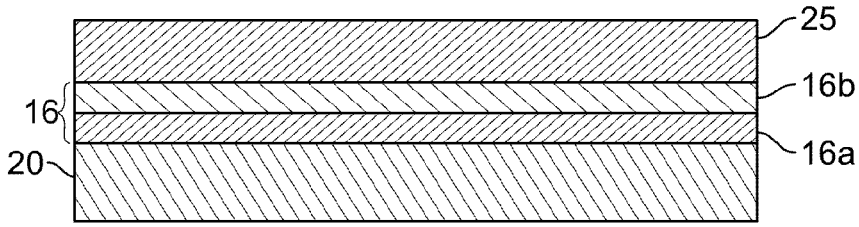

The process 80 continues at block 84 with the formation of a sacrificial layer 25 over the optical stack 16. The sacrificial layer 25 is later removed (e.g., at block 90) to form the cavity 19 and thus the sacrificial layer 25 is not shown in the resulting interferometric modulators 12 illustrated in FIG. 1. FIG. 8B illustrates a partially fabricated device including a sacrificial layer 25 formed over the optical stack 16. The formation of the sacrificial layer 25 over the optical stack 16 may include deposition of a xenon difluoride ($XeF_2$)-etchable material such as molybdenum (Mo) or amorphous silicon (a-Si), in a thickness selected to provide, after subsequent removal, a gap or cavity 19 (see also FIGS. 1 and 8E) having a desired design size. Deposition of the sacrificial material may be carried out using deposition techniques such as physical vapor deposition (PVD, e.g., sputtering), plasma-enhanced chemical vapor deposition (PECVD), thermal chemical vapor deposition (thermal CVD), or spin-coating.

Figure 8C:
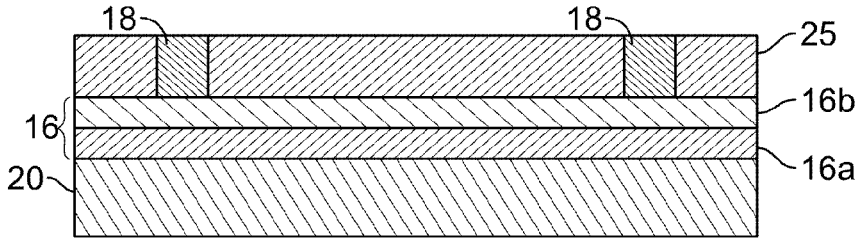

The process 80 continues at block 86 with the formation of a support structure e.g., a post 18 as illustrated in FIGS. 1, 6 and 8C. The formation of the post 18 may include patterning the sacrificial layer 25 to form a support structure aperture, then depositing a material (e.g., a polymer or an inorganic material, e.g., silicon oxide) into the aperture to form the post 18, using a deposition method such as PVD, PECVD, thermal CVD, or spin-coating. In some implementations, the support structure aperture formed in the sacrificial layer can extend through both the sacrificial layer 25 and the optical stack 16 to the underlying substrate 20, so that the lower end of the post 18 contacts the substrate 20 as illustrated in FIG. 6A. Alternatively, as depicted in FIG. 8C, the aperture formed in the sacrificial layer 25 can extend through the sacrificial layer 25, but not through the optical stack 16. For example, FIG. 8E illustrates the lower ends of the support posts 18 in contact with an upper surface of the optical stack 16. The post 18, or other support structures, may be formed by depositing a layer of support structure material over the sacrificial layer 25 and patterning portions of the support structure material located away from apertures in the sacrificial layer 25. The support structures may be located within the apertures, as illustrated in FIG. 8C, but also can, at least partially, extend over a portion of the sacrificial layer 25. As noted above, the patterning of the sacrificial layer 25 and/or the support posts 18 can be performed by a patterning and etching process, but also may be performed by alternative etching methods.

Figure 8D:
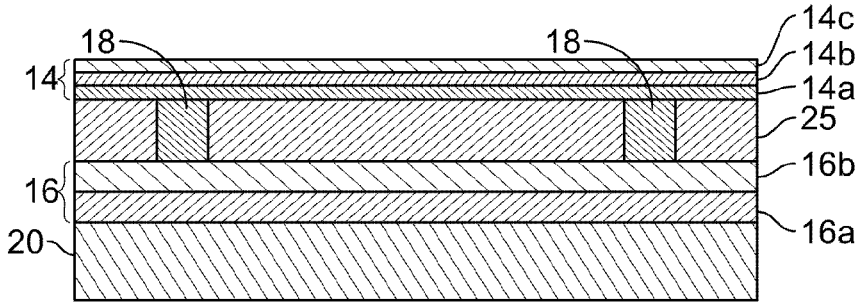
Figure 8E:
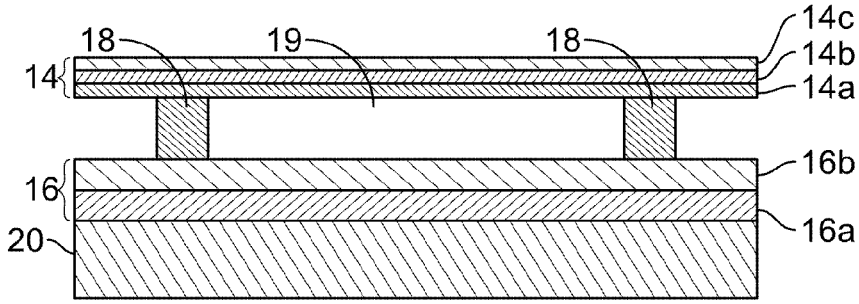

The process 80 continues at block 88 with the formation of a movable reflective layer or membrane such as the movable reflective layer 14 illustrated in FIGS. 1, 6 and 8D. The movable reflective layer 14 may be formed by employing one or more deposition steps, e.g., reflective layer (e.g., aluminum, aluminum alloy) deposition, along with one or more patterning, masking, and/or etching steps. The movable reflective layer 14 can be electrically conductive, and referred to as an electrically conductive layer. In some implementations, the movable reflective layer 14 may include a plurality of sub-layers 14*a*, 14*b*, 14*c* as shown in FIG. 8D. In some implementations, one or more of the sub-layers, such as sub-layers 14*a*, 14*c*, may include highly reflective sub-layers selected for their optical properties, and another sub-layer 14*b* may include a mechanical sub-layer selected for its mechanical properties. Since the sacrificial layer 25 is still present in the partially fabricated interferometric modulator formed at block 88, the movable reflective layer 14 is typically not movable at this stage. A partially fabricated IMOD that contains a sacrificial layer 25 may also be referred to herein as an "unreleased" IMOD. As described above in connection with FIG. 1, the movable reflective layer 14 can be patterned into individual and parallel strips that form the columns of the display.

The process 80 continues at block 90 with the formation of a cavity, e.g., cavity 19 as illustrated in FIGS. 1, 6 and 8E. The cavity 19 may be formed by exposing the sacrificial material 25 (deposited at block 84) to an etchant. For example, an etchable sacrificial material such as Mo or amorphous Si may be removed by dry chemical etching, e.g., by exposing the sacrificial layer 25 to a gaseous or vaporous etchant, such as vapors derived from solid $XeF_2$ for a period of time that is effective to remove the desired amount of material, typically selectively removed relative to the structures surrounding the cavity 19. Other etching methods, e.g. wet etching and/or plasma etching, also may be used. Since the sacrificial layer 25 is removed during block 90, the movable reflective layer 14 is typically movable after this stage. After removal of the sacrificial material 25, the resulting fully or partially fabricated IMOD may be referred to herein as a "released" IMOD.

Because reflective displays, e.g., some displays including interferometric modulators, can use ambient light as a light source, the images displayed may be directly influenced by the illuminance of the ambient light. For example, under a low illuminance of ambient light, e.g., in a dark room, the display can appear dim. When illuminated with a high illuminance of ambient light, e.g., under bright sunlight, the display can appear bright. In addition, because reflective displays may be specular reflective displays, the image displayed also can be affected by the direction of the ambient light. Therefore, in some implementations, supplemental lighting can be provided to reflective displays to enhance their performance or improve viewer experience. Some examples of an illumination model usable to control supplemental lighting are discussed in details below, which can provide an optimal level of supplemental lighting under various ambient lighting conditions to enhance the performance of the reflective displays without significantly compromising the energy efficiency of the reflective displays.

Figure 9A:
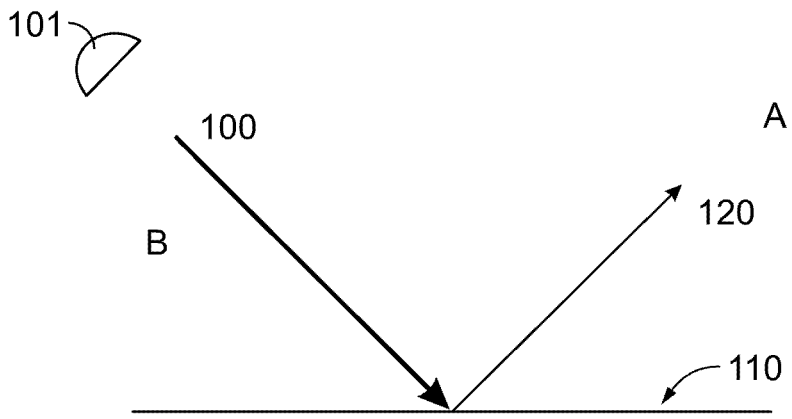
FIG. 9A illustrates an example of specular reflectance on a display surface.

FIG. 9A illustrates an example of specular reflectance on a display surface. In specular reflectance, the incoming light 100 from directed lighting 101 (e.g., directional light coming from one or more light sources such as the sun, a room light, etc.) is reflected from the display surface 110 in a single direction 120. The reflectance from the display surface 110 can appear the brightest in the direction 120 of specular reflectance. Because incoming light 100 is reflected in a certain direction 120 under directed lighting 101, the specular reflective display can look different in different directions. For example, when a viewer looks at the display surface 110 from point A (direction 120 of specular reflectance), the display surface 110 can appear relatively bright. However, when a viewer looks at the display surface 110 at point B (not in a direction 120 of specular reflection), the display surface 110 can appear relatively dim.

Figure 9B:
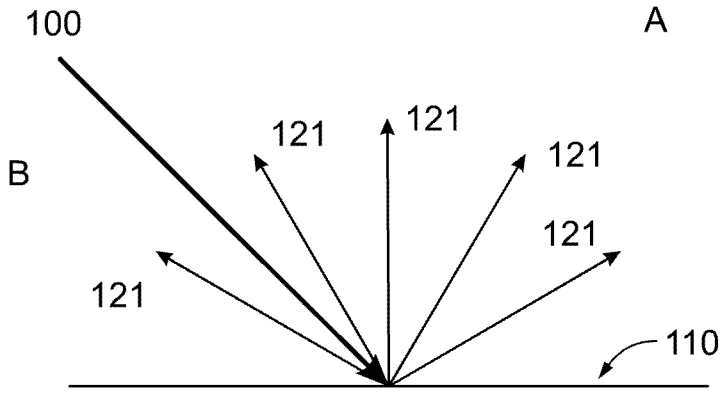
FIG. 9B illustrates an example of Lambertian reflectance on a display surface.

FIG. 9B illustrates an example of Lambertian reflectance on a display surface 110. In Lambertian reflectance, the incoming light 100 is reflected from the display surface 110 in substantially all directions 121 and the apparent brightness of the display surface 110 appears substantially the same regardless of the angle of view. For example, the display surface 110 has substantially the same brightness when observing the display surface 110 from point A or from point B.

Figure 9C:
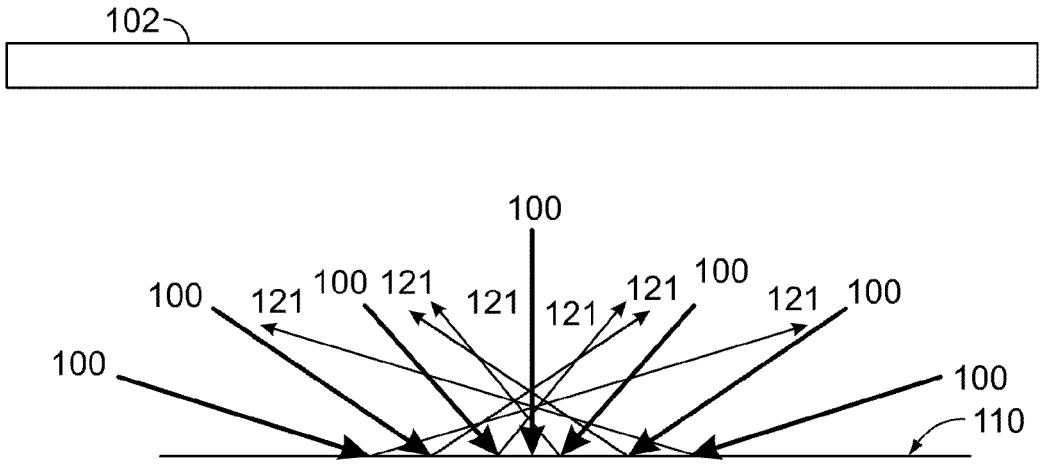
FIG. 9C illustrates an example of a reflective display surface illuminated with diffuse lighting.

FIG. 9C illustrates an example of a reflective display surface 110 illuminated with diffuse lighting 102. As illustrated in FIG. 9C, when the reflective display surface 110 is illuminated with diffuse lighting 102 (e.g., light coming from substantially all directions above the surface 110), the incoming diffuse light 100 is reflected in substantially all directions 121 and thus, the brightness of the display surface 110 may look substantially the same in all directions (above the display surface 110) regardless of the viewer's location (e.g., the reflective display has Lambertian reflectance characteristics under diffuse lighting conditions). For certain implementations, all directions above the display surface 110 can include a range of solid angles up to and including $2\pi$ steradian. A steradian can be defined as the solid angle subtended at the center of a unit sphere by a unit area on the unit sphere's surface. A sphere subtends a solid angle of $4\pi$ steradian. Thus, all directions above the display surface 110 can have a solid angle of up to about half a sphere, e.g., up to and including $2\pi$ steradian.

Figure 9D:
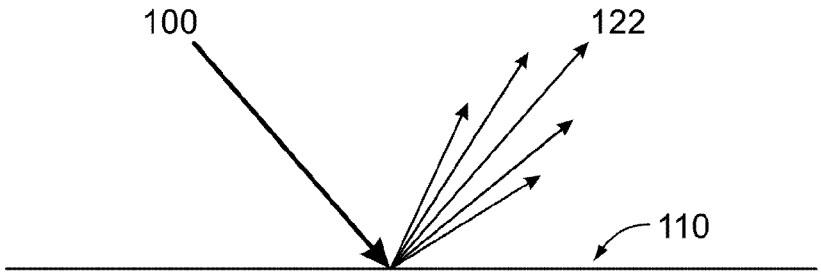
FIG. 9D illustrates an example of reflectance in-between specular reflectance and Lambertian reflectance.

Reflective displays also can exhibit characteristics in-between specular reflectance and Lambertian reflectance. FIG. 9D illustrates an example of reflectance in-between specular reflectance and Lambertian reflectance. As shown in FIG. 9D, the incoming light 100 scatters or reflects at a range of angles around a direction 122 (which may in some implementations be the specular direction). A surface 110 also can have a combination of the reflectance characteristics illustrated in FIGS. 9A-9D, e.g., reflectance from a surface 110 under diffuse and directed lighting conditions. The appearance (e.g., brightness) of the surface 110 can depend on factors including the amount(s) of diffuse and directed lighting, the angle(s) from which the directed lighting is received by the surface, the direction at which the surface 110 is viewed, and so forth.

Figure 10:
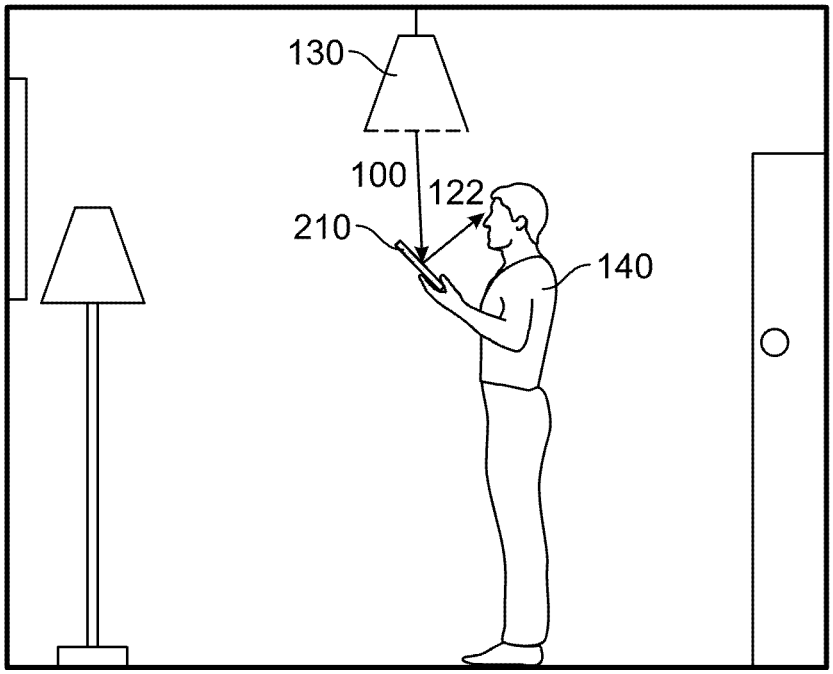
FIG. 10 illustrates an example of directed lighting at a high angle and above the viewer.

A "display with gain" can be one that can exhibit specular reflectance and characteristics in-between specular reflectance and Lambertian reflectance, e.g., light reflected into a range of angles less than $2\pi$ steradian. When such a display has a substantial directed component resulting in specular reflectance, there can be an opportunity for the display to "gain" brightness. If the light source is within some angular range off of the normal to the display surface, then the user may be able to take advantage of the gain. FIG. 10 illustrates an example of directed lighting 130 at a high angle and above the viewer 140. As shown in FIG. 10, the incoming light 100 from the directed lighting 130 illuminates the display 210 such that the incoming light 100 can reflect from the display 210 toward a direction 122. For portable displays such as in, e.g., cellular telephones, viewers naturally tend to hold the display 210 so that the directed light 122 is reflected toward their eyes, and the display 210 appears relatively bright. Thus, a display 210 with gain (or the directed lighting 130) can be adjusted such that the direction 122 of reflected light with the highest brightness is directed into the eyes of the viewer 140.

Figure 11:
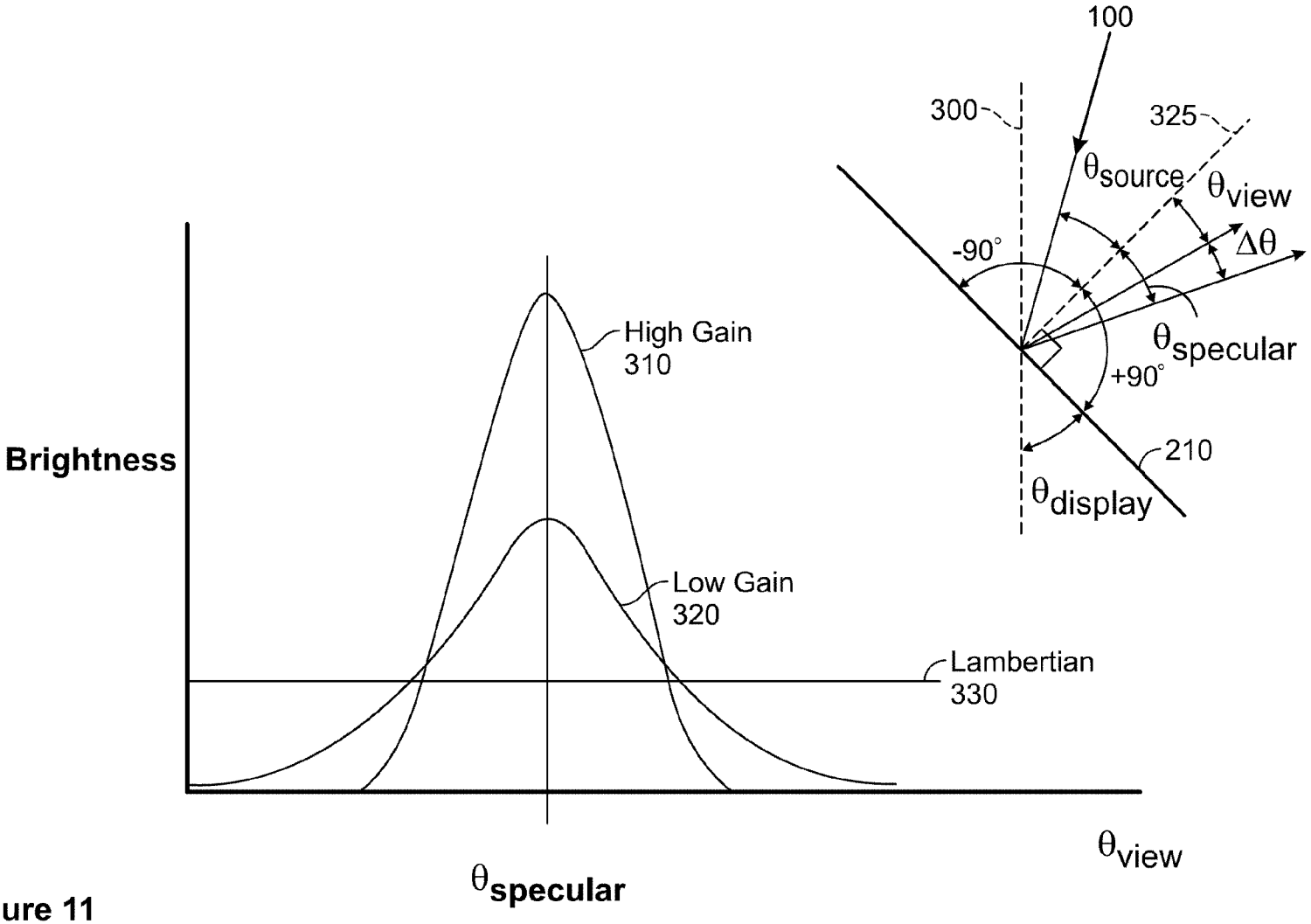
FIG. 11 is a graphical diagram of the brightness of a display as a function of the angle of view off the specular direction for examples of displays with high gain, low gain, and Lambertian characteristics.

FIG. 11 is a graphical diagram of the brightness of a display as a function of the angle of view off the specular direction for examples of displays with high gain, low gain, and Lambertian characteristics. The angle of view can vary from about −90° to about +90° off the normal direction 325. The brightness of a display can be expressed as a luminance measured in units of candela/$m^2$ (sometimes called a "nit"). Trace 310 illustrates a display with relatively high gain, while trace 320 illustrates a display with relatively low gain. In these examples, the two traces 310 and 320 are bell shaped and can have maximum brightness at the angle of view, e.g., in a direction of specular reflection. The trace 310 illustrating relatively high gain has a maximum brightness that is larger than the trace 320 illustrating relatively low gain. As discussed above, a viewer 140 can adjust a display 210 with gain to take advantage of the maximum brightness by, e.g., orienting the display 210 so that the direction of maximum brightness (or a direction of brighter reflection) points toward the viewer's eyes. For example, the display 210 can be adjusted at an angle, $\theta_{display}$, (e.g., measured relative to the vertical direction 300), to adjust the angle of view, $\theta_{view}$, in relation to the angle, $\theta_{source}$, of a light source 100. For example, in certain implementations, the angle, $\theta_{specular}$, of specular reflection off the normal direction 325 can approximately equal the angle, $\theta_{source}$, of a light source 100 off the normal direction 325. In these implementations, the angle of view off the specular direction, $\Delta\theta$, can be expressed as $\theta_{specular}-\theta_{view}$. The brightness of the display 210 can be a function of the angle off the specular direction, $\Delta\theta$, as shown, e.g., in FIG. 11.

Under conditions of high illuminance of diffuse lighting, e.g., a bright cloudy day, certain implementations of a reflective display 210 can appear relatively bright. Illuminance (in units of lux or lumens per square meter) is a measure of the luminous flux incident on a unit area of a surface. Under conditions of lower illuminance of diffuse lighting, e.g., a dark cloudy day, certain implementations of a reflective display can appear relatively dim. As discussed above, certain types of displays under diffuse lighting conditions can have Lambertian reflectance characteristics. As depicted in trace 330 in FIG. 11, the example display with Lambertian characteristics can appear substantially the same, e.g., has substantially the same brightness, even as the angle of view varies from about −90° to about +90°.

If the lighting is relatively uniform, some types of display 210 may not have the advantage of "gain" over a Lambertian display. In addition, because the light is spread in a wide range of directions under diffuse lighting conditions, for the same illuminance of light, a display illuminated with diffuse lighting may appear dimmer than when illuminated with directed lighting. Accordingly, various implementations of a display device may use the device and methods described herein to differentiate between illumination with diffuse lighting and with directed lighting to determine and control an additional amount of light that can be provided to the display device via an auxiliary light source, e.g., such as a front-light or back-light.

Figure 12:
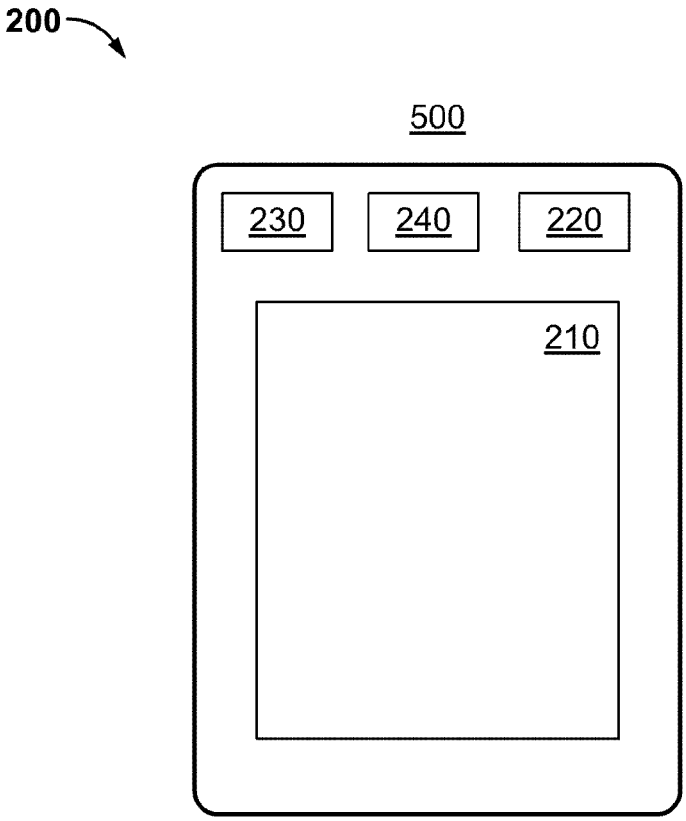
FIG. 12 illustrates an example implementation of a display device.

FIG. 12 illustrates an example implementation of a display device 200. The display device 200 can include a display 210, and an auxiliary light source 220 configured to provide supplemental light to the display 210 based at least in part on one or more illumination models as described herein. For example, the display device 200 can provide front-light luminance to a reflective display based at least in part on an illumination model, e.g., FIGS. 18A-18D described below. The display device 200 further can include a sensor system 230 configured to determine, e.g., measure, illuminance of ambient light 500 illuminating the display 210. The display device 200 further can include a controller 240 in communication with the sensor system 230. The controller 240, e.g. including control electronics, can be configured to adjust the auxiliary light source 220 to provide an amount of supplemental light to the display 210. The amount of supplemental light can be based at least in part on the illuminance determined by the sensor system 230.

In certain implementations, the display device 200 can include a display 210 such as those discussed herein, including displays for cellular telephones, mobile television receivers, wireless devices, smartphones, bluetooth devices, personal data assistants (PDAs), wireless electronic mail receivers, hand-held or portable computers, netbooks, notebooks, smartbooks, GPS receivers/navigators, cameras and camera view displays, MP3 players, camcorders, game consoles, wrist watches, clocks, calculators, electronic reading devices (e.g., e-readers), DVD players, CD players, or any electronic device. The shape of the display 210 can be, e.g., rectangular, but other shapes, such as square or oval also can be used. The display 210 can be made of glass, or plastic, or other material. In various implementations, the display 210 includes a reflective display, e.g., displays including reflective interferometric modulators as discussed herein or liquid crystal elements. In some other implementations, the display 210 includes a transflective display or an emissive display.

The display device 200 can include an auxiliary light source 220 configured to provide supplemental light to the display 210. In some implementations, the auxiliary light source 220 can include a front-light, e.g., for a reflective display. In some other implementations, the auxiliary light source 220 can include a back-light, e.g., for emissive or transflective displays. The auxiliary light source 220 can be any type of light source, e.g., a light emitting diode (LED). In some implementations, a light guide (not shown) can be used to receive light from the light source 220 and guide the light to one or more portions of the display 210.

In the implementation shown in FIG. 12, the sensor system 230 can be configured to measure a diffuse illuminance of the ambient light 500 from a wide range of directions and/or configured to measure a directed illuminance of the ambient light 500 from a relatively narrow range of directions. Some implementations as described herein may utilize a sensor system 230 configured to measure an illuminance, e.g., a diffuse illuminance or a directed illuminance of the ambient light 500. Some other implementations as described herein may utilize a sensor system 230 configured to measure both a diffuse illuminance and a directed illuminance of the ambient light 500. The diffuse illuminance can be a measure of the illuminance of the ambient light 500 arriving at the sensor system 230 from a wide range of angles, for example, light arriving at the display 210 from directions subtending a solid angle of up to about a steradians. The directed illuminance can be a measure of the illuminance of the ambient light 500 arriving at the sensor system 230 from directions subtending a solid angle less than $2\pi$ steradians, e.g., light arriving at the sensor system 230 from one or more relatively narrow cones of angles as will be described further below. In some implementations, the directed illuminance can be a measure of the illuminance of the ambient light 500 arriving at the sensor system 230 from directions subtending a solid angle much less than about $2\pi$ steradians. For example, in various implementations, the cone may have an angular (full) width in a range from about 5 degrees to about 60 degrees, e.g., about 5 degrees to about 15 degrees, from about 15 degrees to about 30 degrees, from about 30 to about 45 degrees, from about 45 degrees to about 60 degrees, or some other range of angular widths.

Figure 13A:
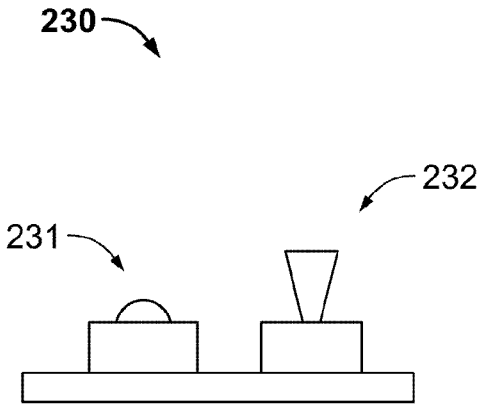
FIG. 13A illustrates an example sensor system that includes a diffuse light sensor and a directed light sensor.
Figure 13B:
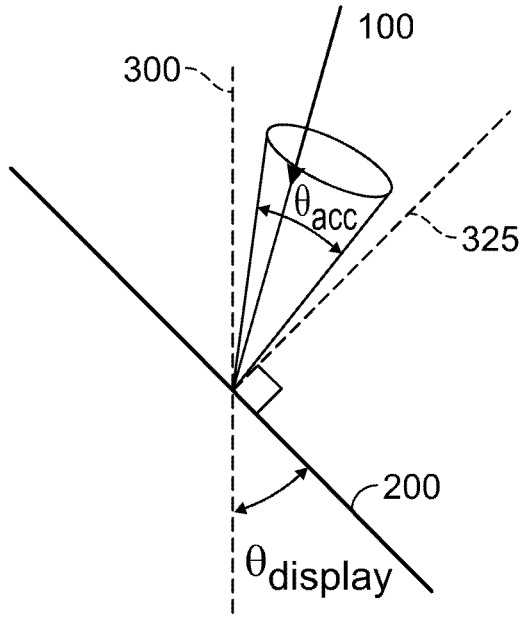
FIG. 13B illustrates an example of an acceptance angle, $\theta_{acc}$, for an example directed light sensor.

FIG. 13A illustrates an example sensor system 230 that includes a diffuse light sensor 231 and a directed light sensor 232. The diffuse light sensor 231 can be configured to measure the diffuse illuminance. In some implementations, the diffuse light sensor 231 can be an omnidirectional light sensor, e.g. an incidence meter, which senses light from a wide range of directions (e.g., light from substantially all directions incident on the sensor). The directed light sensor 232 can be configured to measure the directed illuminance. FIG. 13B illustrates an example of an acceptance angle, $\theta_{acc}$, for an example directed light sensor 232. For example, the directed light sensor 232 may be sensitive to light coming from a direction within a cone having an acceptance angle, $\theta_{acc}$, of, for example, about 10 degrees, about 15 degrees, about 20 degrees, about 25 degrees, about 30 degrees, about 35 degrees, about 40 degrees, about 45 degrees, about 50 degrees, about 55 degrees, about 60 degrees, or some other angle. The directed light sensor 232 can measure light received from a cone having an acceptance angle in a range from about 5 degrees to about 15 degrees, from about 15 degrees to about 30 degrees, from about 30 degrees to about 45 degrees, from about 45 degrees to about 60 degrees, or some other range of angular widths The sensor system 230 can include organic or nanoparticle sensors. The sensor system 230 also can include photodiodes, phototransistors, and/or photoresistors.

Figure 13C:
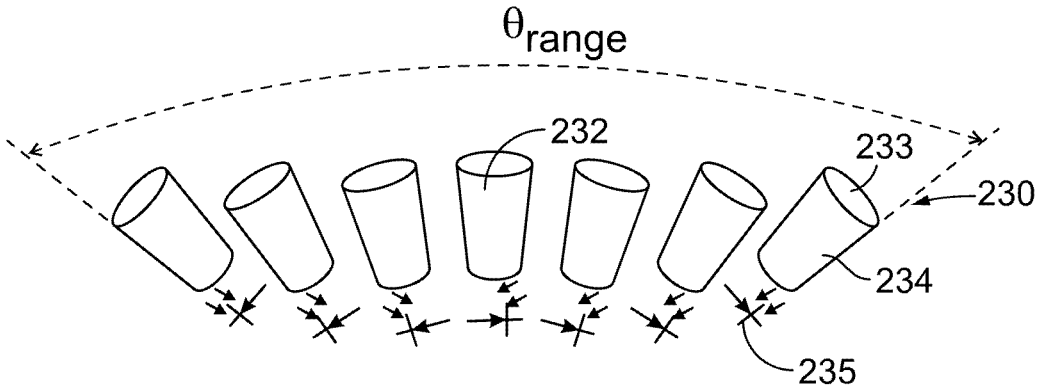
FIG. 13C illustrates an example sensor system that includes a plurality of directed light sensors.

FIG. 13C illustrates an example sensor system 230 that includes a plurality of directed light sensors 232. Each of the directed light sensors 232 can point in a particular direction and can be sensitive to light received from a cone subtending a solid angle less than $2\pi$ steradians, and in some implementations much less than about $2\pi$ steradians. In some implementations, the directions of light sensitivity of one or more of the directed light sensors 232 may at least partially overlap, which may provide a degree of redundancy in case of failure of one of the sensors 232. In some other implementations, the directions of light sensitivity of one or more of the directed light sensors 232 may at least partially overlap to allow a measurement of the angular location of the directed light source through interpolation of measurements from two or more of the directed light sensors 232. In some implementations, the plurality of directed light sensors 232 can be arranged so that directed light sources disposed over a relatively wide range, $\theta_{range}$, of angles relative to the directed light sensors 232 (e.g., up to about $2\pi$ steradians) can be measured. For example, the linear array of sensors 232 shown in FIG. 13C can measure directed light sources in a range, $\theta_{range}$, of angles of up to about 120 degrees, up to about 140 degrees, or up to about 160 degrees along the line of the array. In some other implementations, the directed light sensors 232 can be arranged to be sensitive to directed light sources coming from expected or anticipated directions relative to the display device 200.

In some cases, each of the directed light sensors 232 may be sensitive to light coming from directions within a cone having an acceptance angle of, for example, about 5 degrees, about 10 degrees, about 15 degrees, about 20 degrees, about 25 degrees, about 30 degrees, about 35 degrees, about 40 degrees, about 45 degrees, about 50 degrees, about 55 degrees, about 60 degrees, or some other angle. In other cases, the directed light sensors 232 may be sensitive to light coming from directions within a cone having different angles, e.g., one directed light sensor can be sensitive to about 40 degrees, while another directed light sensor can be sensitive to about 30 degrees. In some implementations, directed light sensors 232 with a narrower acceptance angle can be arranged at locations of anticipated directed illuminance. In some other implementations, directed light sensors 232 with a narrower acceptance angle can be arranged to overlap directed light sensors 232 with a wider acceptance angle to allow a measurement of the angular location of the directed light source through interpolation of measurements from the directed light sensor 232 with a narrower acceptance angle and the directed light sensor 232 with a wider acceptance angle. In some implementations, the plurality of directed light sensors 232 can be used with a diffuse sensor 231, for example, as shown in FIG. 13A. In some other implementations, the diffuse illuminance can be measured by the plurality of directed light sensors 232, for example, the average of the illuminances measured by each of the directed light sensors 232 weighted based on the respective angle of acceptance for each of the directed light sensors 232. In various implementations, the plurality of sensors 232 may be disposed in a linear array as shown in FIG. 13C or in a two-dimensional array (e.g., a 4×4 or 5×5 array). The plurality of directed light sensors 232 can be formed in some implementations as a number of apertures 233 or a number of tubes 234 combined with photosensors 235 or a photosensor array. For example, an array of apertures 233 can be formed in a portion of the cover of the display device 200 and a photosensor 235 can be disposed below each of the apertures 233. An aperture 233 can be formed as an elongated opening pointing in a particular direction, and the size and/or opening angle of the aperture 233 can be used to limit reception of light (by the photosensor 235 or photosensor array) to a particular range of angles. Various implementations also can include a lens to limit the acceptance angle of an aperture 233.

Figure 13D:
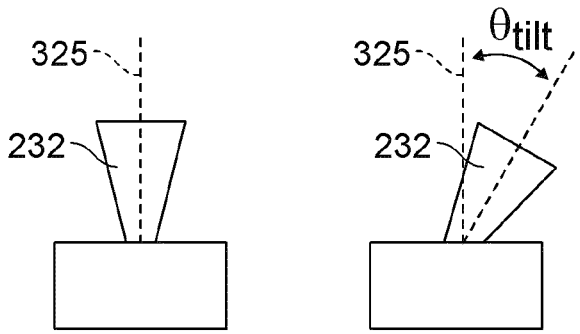
FIG. 13D illustrates an example sensor system that includes a single directed light sensor.

FIG. 13D illustrates an example sensor system that includes a single directed light sensor 232. As shown on the left of FIG. 13D, the directed light sensor 232 can measure the directed illuminance in a first position. The directed light sensor 232 can tilt to collect light from multiple directions. For example, as shown on the right of FIG. 13D, the directed light sensor 232 can tilt to measure the directed illuminance in a second position. In various implementations, the directed light sensor 232 can tilt an angle, $\theta_{tilt}$, from about ±90 degrees from the normal direction 325. The directed illuminance can be measured by the directed light sensor 232 at different tilt angles, $\theta_{tilt}$. The diffuse illuminance also can be determined by the directed light sensor 232, for example, the average of the illuminances measured by the directed light sensor 232 for all of the measured illuminances weighted based on the respective angle of acceptance for each of different tilt angles, $S_{tilt}$. The display device 200 may include an actuator (not shown) that can automatically tilt the sensor 232.

As shown in FIG. 12, the display device 200 can further include a controller 240 in communication with the sensor system 230. The controller 240, e.g. including control electronics, can be configured to adjust the auxiliary light source 220 to provide an amount of supplemental light, if any, to the display 210 based at least in part on the determined illuminance. In certain implementations, the determined illuminance of the ambient light 500 can include a diffuse illuminance. In other implementations, the determined illuminance also can include a directed illuminance.

The controller 240 can receive the determination of the illuminance from a computer-readable storage medium (e.g., a memory device in communication with the controller 240). The controller 240 can transmit a supplemental lighting adjustment to add to the display 210 to the light source 220. The lighting adjustment can be based at least in part on the amount of supplemental light determined by the controller 240. For example, as will be described further herein, the amount of supplemental light can remain substantially the same on average or can substantially increase on average in response to increasing illuminance of the ambient light 500 when the illuminance of the ambient light 500 is below a first threshold. Also as will be described herein, the amount of supplemental light can substantially decrease on average in response to increasing illuminance of the ambient light 500 when the illuminance of the ambient light 500 is above a second threshold that is greater than or equal to the first threshold.

In some implementations, the controller 240 can be configured to access a lookup table (LUT) or a formula that provides the amount of supplemental light to be provided. The LUT or formula can be based on a model that is non-monotonic for the amount of supplemental light as a function of the illuminance of the ambient light 500 (see, e.g., the example illumination models shown in FIGS. 18B-18D). The LUT or formula also can be based on a model that is based at least in part on the content (e.g., text, image, or video) being displayed. In some implementations, the controller 240 may transmit the supplemental lighting adjustment to a lighting controller configured to adjust the light source 220.

In certain implementations, the illumination model can provide a default illumination model which can be adjusted based on viewer preferences. For example, as will be described herein, the illumination models may be based on average to a majority of viewers. To accommodate for differences in viewer preferences, some implementations of the display device 200 further can include a user interface with which a viewer can adjust the amount of supplemental light provided to the reflective display 210 by the auxiliary light source 220. The user interface can be in a variety of forms similar to the input device 48 described below with reference to FIG. 20B, e.g., a knob, a keypad, a button, a switch, a rocker, a touch-sensitive screen, a pressure- or heat-sensitive membrane, or a microphone. In some such implementations, a viewer can operate the user interface to adjust the amount of supplemental lighting provided to the reflective display 210 by the auxiliary light source 220.

In addition, certain implementations of the display device 200 can store (e.g., on the memory device in communication with the controller 240) the viewer adjusted preference for an ambient lighting condition. The viewer preference for the lighting condition can be used to adjust the default illumination model to provide a viewer illumination model. Upon use of the display device 200 in a different or same ambient lighting condition, certain implementations can update the viewer preference model. Thus, in these implementations, the controller 240 can be configured to optionally access the viewer preference model that provides the amount of supplemental light to be provided. In addition, in some implementations, as described herein, the illumination model can be based at least in part on a directed illuminance and/or a diffuse illuminance, and/or a direction to a directed ambient light source, and/or a location of the viewer. In addition, in some implementations, the controller 240 can override a default illumination model and adjust the auxiliary light source 220 to substantially match the ambient light 500. The controller 240 in some implementations can enable closed loop behavior based on the sensor system 230 to further adjust the auxiliary light source 220.

An example method to determine a lighting condition based at least in part on the measured directed illuminance and the measured diffuse illuminance of the ambient light 500 can be based at least in part on the ratio of the measured directed light to the measured diffuse light and on the measured illuminance of ambient light (e.g., ambient illuminance measured in lux). The controller 240 can determine how much, if any, extra lighting is desired and can set the auxiliary light source 220 to the determined additional lighting amount.

Figure 14A:
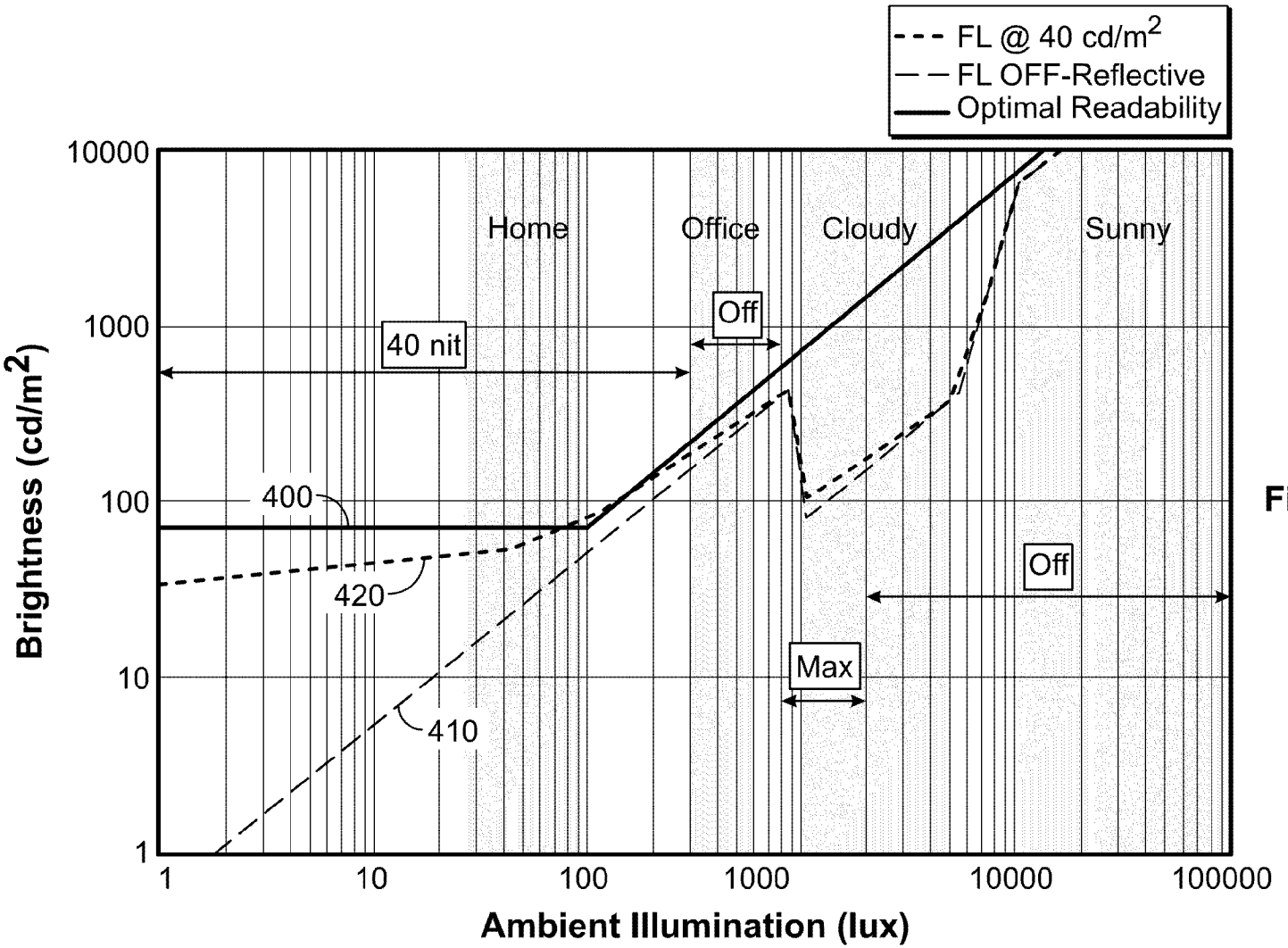
FIG. 14A shows example experimental results and an example illumination model for an example display device.

FIG. 14A shows example experimental results and an example illumination model for an example display device. The vertical axis is brightness of the display (measured in units of candela per square meter or "nits"), and the horizontal axis shows the conditions of ambient illumination (in units of lux or lumens per square meter). Trace 400 illustrates an estimate of the optimal readability, e.g., optimal visual acuity, for an example display device 200. Trace 410 illustrates the example display device 200 with the auxiliary light source set to zero. Trace 420 illustrates an example display device 200 with the auxiliary light source set at 40 nits. Under conditions of high illuminance, e.g., sunny and/or bright cloudy conditions, no additional lighting may be desired, so the auxiliary light source 220 can be set to zero (or a sufficiently small value). For conditions of less diffuse illuminance, e.g., dark cloudy conditions, additional lighting may be desired, so the auxiliary light source 220 can be set to a value up to or equal to the maximum amount of light that can be produced by the light source 220. For conditions of highly directed illuminance, e.g., an office environment, no additional lighting may be desired, so the auxiliary light source 220 can be set to zero (or a sufficiently small value). For conditions of less directed illuminance, e.g., home environment, additional lighting may be desired, so the auxiliary light source 220 can be set to a value sufficient to provide a display that is readily viewable under the ambient lighting conditions. As shown in FIG. 14A, by providing an amount of supplemental light to some implementations of the display device 200, the brightness of the display device 200 can approach the condition of optimal readability, e.g., trace 400. In the example illumination model shown in FIG. 14A, this value of supplemental illumination is 40 nits. The example supplemental illumination model shown in FIG. 14A may save energy because it can optimize between brightness and power usage. Thus, certain implementations can provide a sufficiently bright display under a wide range of ambient illumination conditions. In addition, the battery life for battery-powered display devices 200 may be prolonged.

Figure 14B:
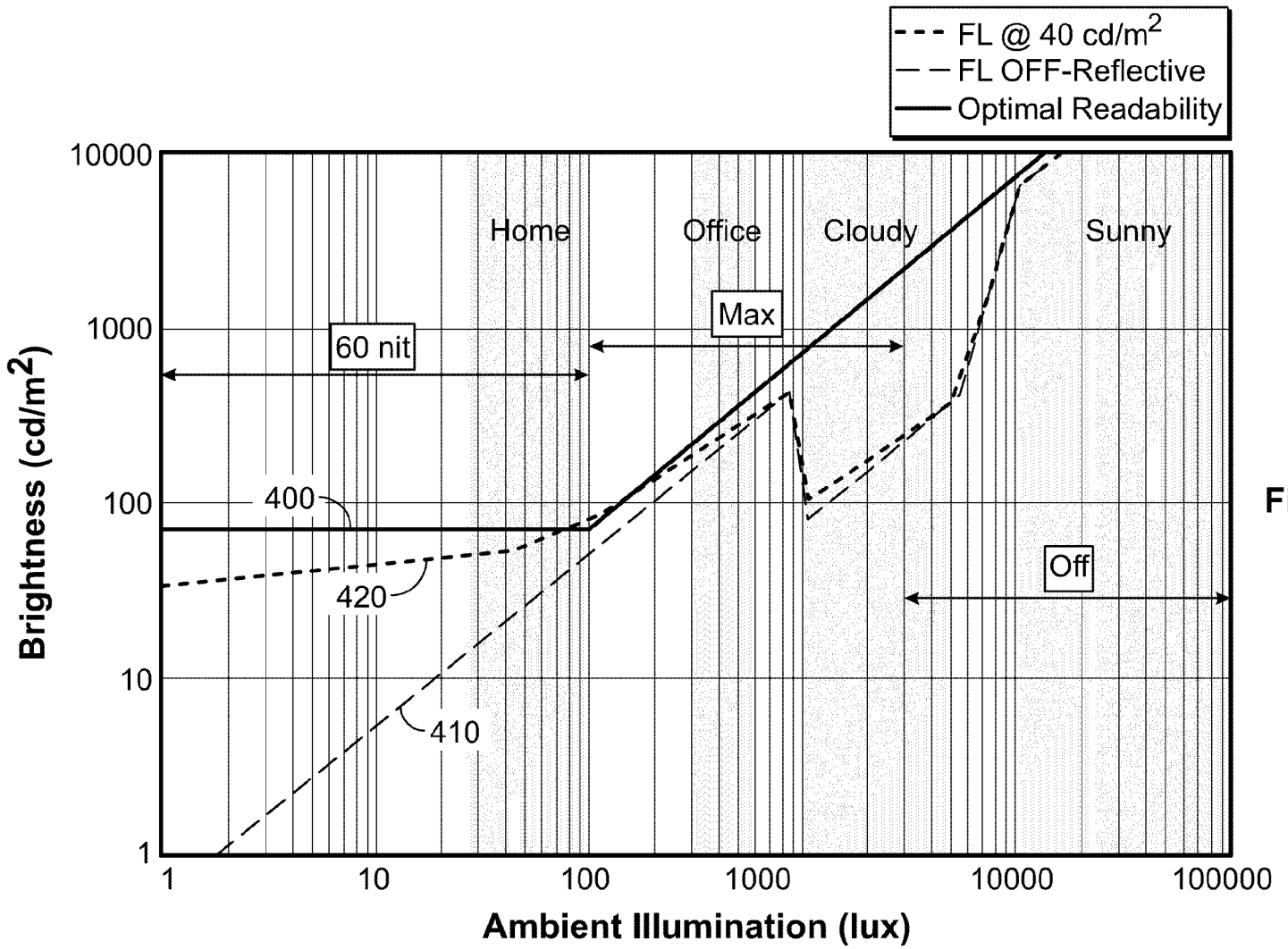
FIG. 14B shows example experimental results and an example illumination model for an example reflective display device that appears relatively bright compared to a reflective display device without use of a front-light source.

FIG. 14B shows example experimental results and an example illumination model for an example reflective display device that appears relatively bright compared to a reflective display device without use of a front-light source. Similar to the example discussed with reference to FIG. 14A, under conditions of high illuminance, e.g., sunny and/or bright cloudy conditions, the auxiliary light source 220 can be set to zero (or a sufficiently small value) because little or no additional lighting may be desired. Also, similar to the example shown in FIG. 14A, under conditions of less diffuse illuminance, e.g., dark cloudy conditions, the auxiliary light source 220 can be set to a value up to or equal to the maximum amount of light that can be produced by the light source 220. For conditions of highly directed illuminance, e.g., office environments, additional lighting may be desired for a bright display, so the auxiliary light source 220 can be set to a value up to or equal to the maximum amount of light that can be produced by the light source 220. For conditions of less directed illuminance, e.g., home environments, more additional lighting may also be desired, so the auxiliary light source 220 can be set to a higher value, e.g., 60 nits, than determined for the display of FIG. 14A. Because the display device of FIG. 14B can use more supplemental light than the display device of FIG. 14A, the display device of FIG. 14B can appear brighter than the display device of FIG. 14A. However, by using less supplemental light, the display device of FIG. 14A can consume less power, save energy, and have prolonged battery life as compared to the display device of FIG. 14B. The example auxiliary illumination models described with reference to FIGS. 14A and 14B are intended as illustrative and not limiting. In some other implementations of the display device 200, other auxiliary illumination models can be used.

Figure 15A:
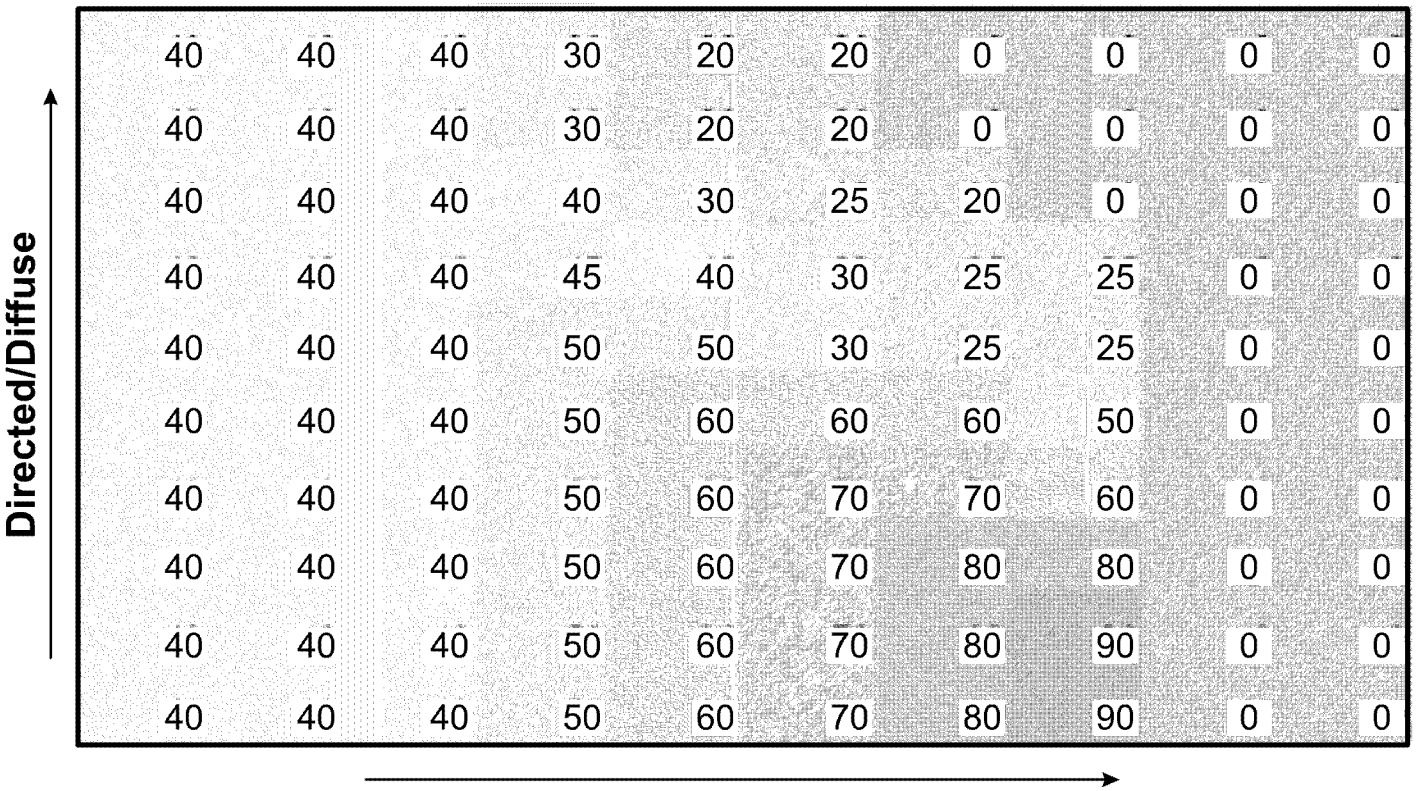
FIG. 15A illustrates an example lookup table that can be used in some implementations to determine an amount of supplemental light to add to a display device.

FIG. 15A illustrates an example lookup table that can be used in some implementations to determine an amount of supplemental light to add to a display device 200. For example, the example lookup table of FIG. 15A can be used in certain implementations that utilize a sensor system 230 that can determine both a diffuse illuminance and a directed illuminance of the ambient light 500. A lookup table can be generated in some implementations based at least in part on experimental data, e.g., FIGS. 14A and 14B. The x-coordinate of the lookup table can represent the illuminance of the ambient light (e.g., the illuminance of the diffuse component of the ambient light). The y-coordinate can represent the ratio of the amount of directed light to the amount of diffuse light. The value in the example lookup table at any x-y coordinate is the amount of auxiliary light to be added to the display (in nits). In this example, extra lighting may be desired for very low illuminance ambient light (represented by "40" within the lookup table, e.g., home environments), while not desired for very high illuminance ambient light irrespective of the ratio of directed light to diffuse light (represented by "0" within the lookup table, e.g., sunny conditions or office environments for an efficient display). In between these two extremes, for the same illuminance conditions (e.g., lux) of ambient light, it may be desired to have more additional light when the display device 200 is illuminated with a lower ratio of directed light to diffuse light than with a higher ratio of directed light to diffuse light (represented by higher values at the bottom of the table, e.g., dark cloudy conditions, compared to lower values at the top of the table, e.g., home environments).

In certain implementations, a diffuse sensor 231 can measure the diffuse illuminance, e.g., the x-coordinate. A directed sensor 232 can measure the directed illuminance. Using the measured diffuse illuminance and the measured directed illuminance, the controller 240 can determine a ratio of the measured directed illuminance to the measured diffuse illuminance, e.g., the y-coordinate. The controller 240 may then use a lookup table that may be generally similar to the one described above to determine how much auxiliary light to add to the display device 200 based at least in part on the amount of ambient light (e.g., diffuse illuminance) and the ratio of directed light to diffuse ambient light (e.g., proportion of directed illuminance to diffuse illuminance).

In some other implementations, the controller 240 may use a formula (or algorithm) to determine how to adjust the auxiliary light source 220 of the display device 200. For example, the amount of diffuse light and the amount of directed light may be some of the inputs to the formula. In some implementations, the formula may also depend on the measured (or estimated or assumed) position(s) of some or all of the directed light source(s). The formula may result in adjusted auxiliary light levels very similar or identical to those illustrated in FIG. 15A, or different.

Figure 15B:
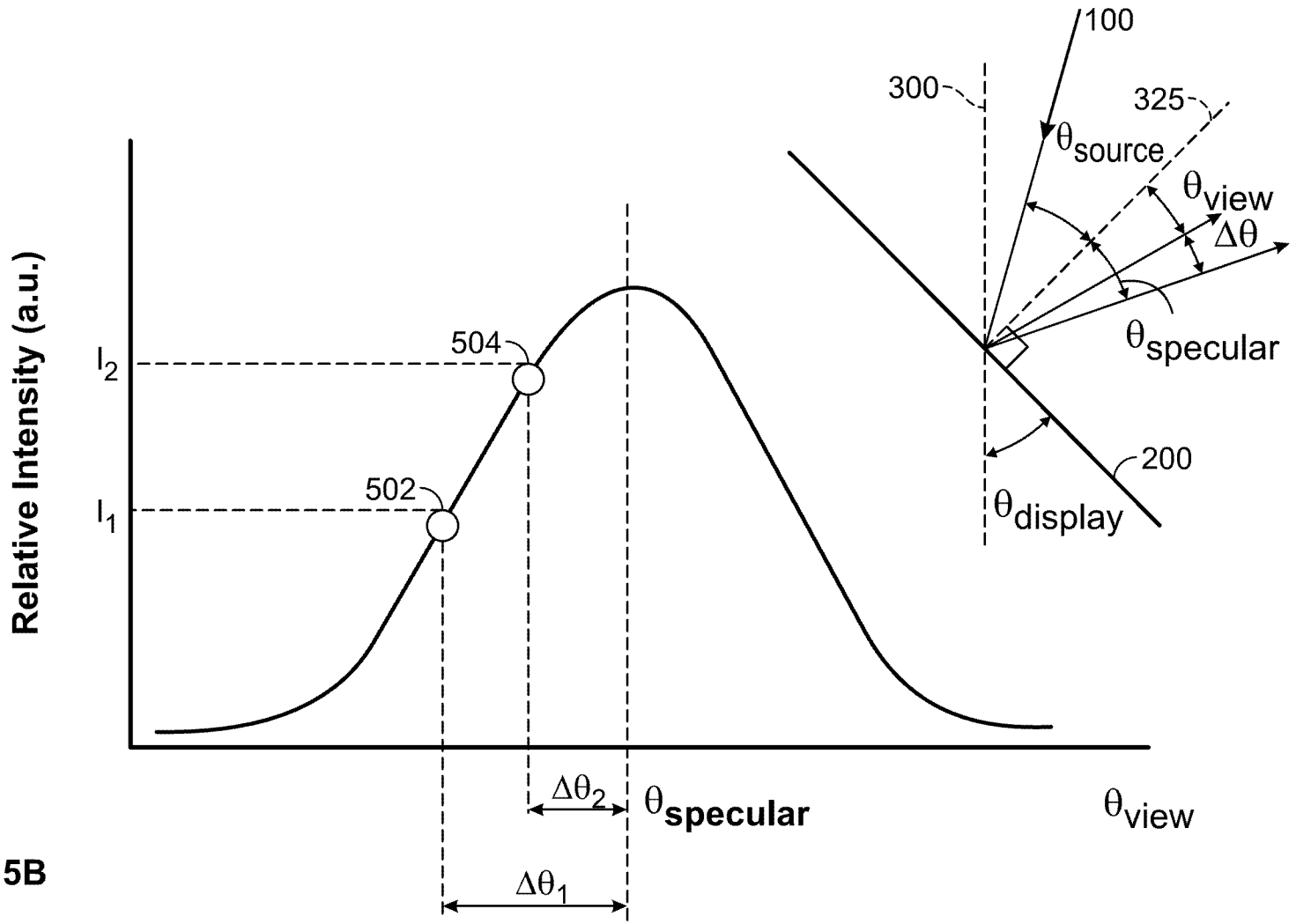
FIG. 15B is a graphical diagram of the relative intensity (in arbitrary units) as a function of the angle of view off the specular direction for a display device with gain.

FIG. 15B is a graphical diagram of the relative intensity (in arbitrary units) as a function of the angle of view off the specular direction for a display device with gain. As described above, the angle off the specular direction, $\Delta\theta$, can be expressed as $\theta_{specular}-\theta_{view}$. In some displays with gain, a directed light source positioned at a larger angle off the specular (e.g., with larger $\Delta\theta$) may tend to contribute less relative intensity to a viewer than a directed light source positioned at a smaller angle off the specular (e.g., with smaller $\Delta\theta$). FIG. 15B illustrates an example in which there are two directed light sources 502 and 504. In other examples, a different number of directed light sources may be present such as, e.g., none, one, three, or more. The directed light source 502 positioned at $\Delta\theta_1$ off the specular direction has an intensity of $I_1$, and the directed light source 504 positioned at $\Delta\theta_2$ off the specular has an intensity of $I_2$, which is larger than $I_1$ in this example because $\Delta\theta_2<\Delta\theta_1$. In the example shown in FIG. 15B, the intensity, I, of the display device 200 as observed by a viewer can be expressed as the sum of $I_1$, $I_2$, and $I_{diffuse}$, where $I_{diffuse}$ is the intensity of the diffuse illuminance.

In some implementations, a general formula for determining the intensity I of the display device 200 with $N_s$ directed light sources can be expressed as $$I = \sum_{k=1}^{N_s} I_k(\Delta\theta_k) + I_{diffuse}, \tag{1}$$

where $I_k(\Delta\theta_k)$ is the intensity from each of the $N_s$ directed light sources located at angles $\Delta\theta_k$. The intensity $I_k$ may be generally similar to the example intensity curves shown in FIGS. 11 and 15B, in various implementations. The summation on the right hand side of this equation can be an estimate of the total directed illumination, $I_{directed}$. By determining how bright the display device 200 appears (e.g., the intensity I), the amount of desired supplemental light can be determined, in various implementations, based at least in part on one or more of: I, $I_{directed}$, $I_{diffuse}$, $I_{directed}/I_{diffuse}$, and so forth.

Although the above examples provide a lookup table and formula for an example of a reflective display (e.g., additional lighting for ambient light with low illuminance), a lookup table and/or formula can be provided for emissive or transflective displays. For example, although an emissive LCD may use a back-light as a light source, if ambient light reflects into a viewer's eyes, a lookup table or formula can provide how to adjust the back-light to keep the contrast low, e.g., how much additional light to increase to the display when the ambient light has high illuminance or how much light to decrease from the display when the ambient light has low illuminance. For example, emissive displays, e.g., a transmissive liquid crystal display with a back-light or a direct-emission organic light emitting diode (OLED) type, can be affected by the illuminance of the ambient light. If the brightness of the back-light is substantially constant, the brightness of the display can also be substantially constant. However, when used in an environment where the ambient light has a low illuminance, e.g., intensity lower than the brightness of the back-light, the difference between the ambient light and the back-light output is high and the image of the display may appear overly bright. Conversely, when used in an environment where the ambient light has a high illuminance, e.g., intensity higher than the brightness of the back-light, the difference between the ambient light and the back-light output is low and the image on the display may appear too dim. In addition, the contrast between dark and light areas of the displayed image may be degraded, due to the contribution of ambient light reflected from the entire display surface. Increasing the back-light intensity in this case serves to selectively boost the intensity of the brighter areas of the image and maintain an acceptable contrast.

Thus, for certain implementations incorporating an emissive or transflective display, the sensor system 230 as described herein can detect the illuminance of the ambient light 500. In such implementations, the back-light intensity can be automatically adjusted, based at least in part on the illuminance of the ambient light 500. For example, when the illuminance of the ambient light 500 is low (e.g., measured in lux or lumens per square meter), the brightness of the back-light (e.g., measured in nits or candelas per square meter) can be adjusted to a lower amount to reduce the difference discussed above and conserve power. On the other hand, when the illuminance of the ambient light 500 is high, the brightness of the backlight can be adjusted to a higher amount to maintain acceptable contrast as discussed above.

Figure 16:
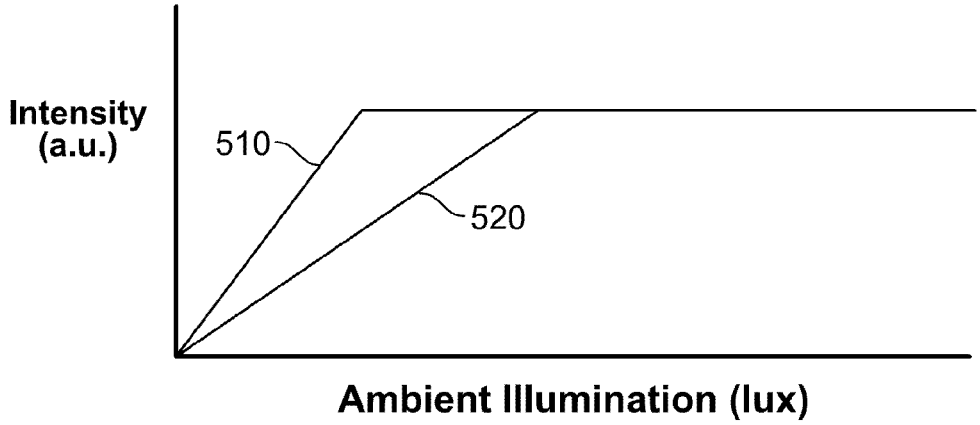
FIG. 16 illustrates two example illumination models for an emissive display device.

FIG. 16 illustrates two example illumination models for an emissive display device. Trace 510 and trace 520 represent two responses of the total back-light intensity (in arbitrary units) as a function of ambient illumination (measured in lux) for an emissive display device. In these examples, as the ambient illumination increases, the intensity of the back-light can be adjusted to increase the intensity of the display until the maximum value of the back-light is reached. Trace 510 represents a higher glare situation where the contrast is higher than the glare situation represented by trace 520. To overcome the higher glare, the back-light of the emissive display can be increased at a faster rate (e.g., following trace 510) than for the lower glare situation (e.g., following trace 520). By determining how bright the display device appears, the back-light can be adjusted to increase light to or decrease light from the display. Although traces 510 and 520 in FIG. 16 are linear, other substantially increasing curves, e.g., exponential or logarithmic curves, also can be used in some implementations.

When a directed ambient light source is near the display device 200, various implementations can locate the direction of the ambient light source by finding or estimating the direction of the brightest source of directed light. For example, the display device 200 can locate the direction of the ambient light source by weighing the illuminances of the light detected by the directed light sensor 232 coming from the different directions. For example, the direction may be determined as an estimated angle to the directed light source (e.g., measured via the example linear array shown in FIG. 13C) or as a pair of estimated angles (e.g., an altitude angle and azimuth angle relative to a 2-D sensor array). Based at least in part on the ratio of directed light to diffuse light, the illuminance of ambient light, and the direction of the directed light source, the controller 240 can be configured to adjust the auxiliary light source 220.

In yet another implementation, the display device 220 can determine the location of the presumed viewer when a directed light source is present. This implementation can include a back facing low-resolution camera (e.g., a wide-angle lens configured to image light onto a low resolution image sensor array) to determine the location of the viewer. The two-dimensional array of directed light sensors 232 as shown in FIG. 13C (which can act like a low-resolution camera) also can be used to detect viewer direction. For example, in some implementations, the viewer can be assumed to be a few degrees from normal relative to the display and tipped slightly backwards. In some implementations, the low-resolution camera can locate the viewer by locating a "dark spot" in front of the display, caused by the viewer blocking some of the ambient light from that direction.

In some cases, the controller 240 may assume the viewer has dynamically adjusted the display device 200 to the optimum (or close to the optimum) position so that the directed light source(s) reflect toward the viewer's eyes (e.g., by manually orienting the display in the viewer's hand). As shown in FIGS. 11 and 15B, the display device 200 can be adjusted at an angle, $\theta_{display}$, (e.g., measured relative to the vertical direction 300), to adjust the angle of view, $\theta_{view}$, in relation to the angle of a light source 100. In some implementations, the angle, $\theta_{display}$, of the display 200 can be assumed to be at about 45 degrees, or between about 43 degrees and about 47 degrees, or between about 40 degrees and about 50 degrees, or between about 35 degrees and about 55 degrees from the vertical position 300. When used indoors, the brightest angle of view can be assumed to be between about 15 degrees and about 30 degrees, or between about 17 degrees and about 28 degrees, or between about 20 degrees and about 25 degrees off the normal direction 325. When used outdoors, the brightest angle of view can be assumed to be between about 30 degrees and about 45 degrees, or between about 33 degrees and about 43 degrees, or between about 35 degrees and about 40 degrees off the normal direction 325. As shown in FIG. 13B, the acceptance angle, $\theta_{acc}$, for an example sensor system 230 can vary based on the direction of the display device 200. For example, if the angle of the display device 200, $\theta_{display}$, is at about a 45° angle from the vertical position 300, the acceptance angle, $\theta_{acc}$, for the sensor system can be about 40°.

Based, at least in part, on the ratio of directed light to diffuse light, the illuminance of ambient light, the direction(s) to the directed light source(s), and on the presumed, estimated, or measured location of the viewer with respect to the location of the directed light source(s), the controller 240 can be configured to adjust the auxiliary light source 220 accordingly. For example, as described above, some implementations may use formula (I) to determine the total, directed, and diffuse intensities.

Figure 17A:
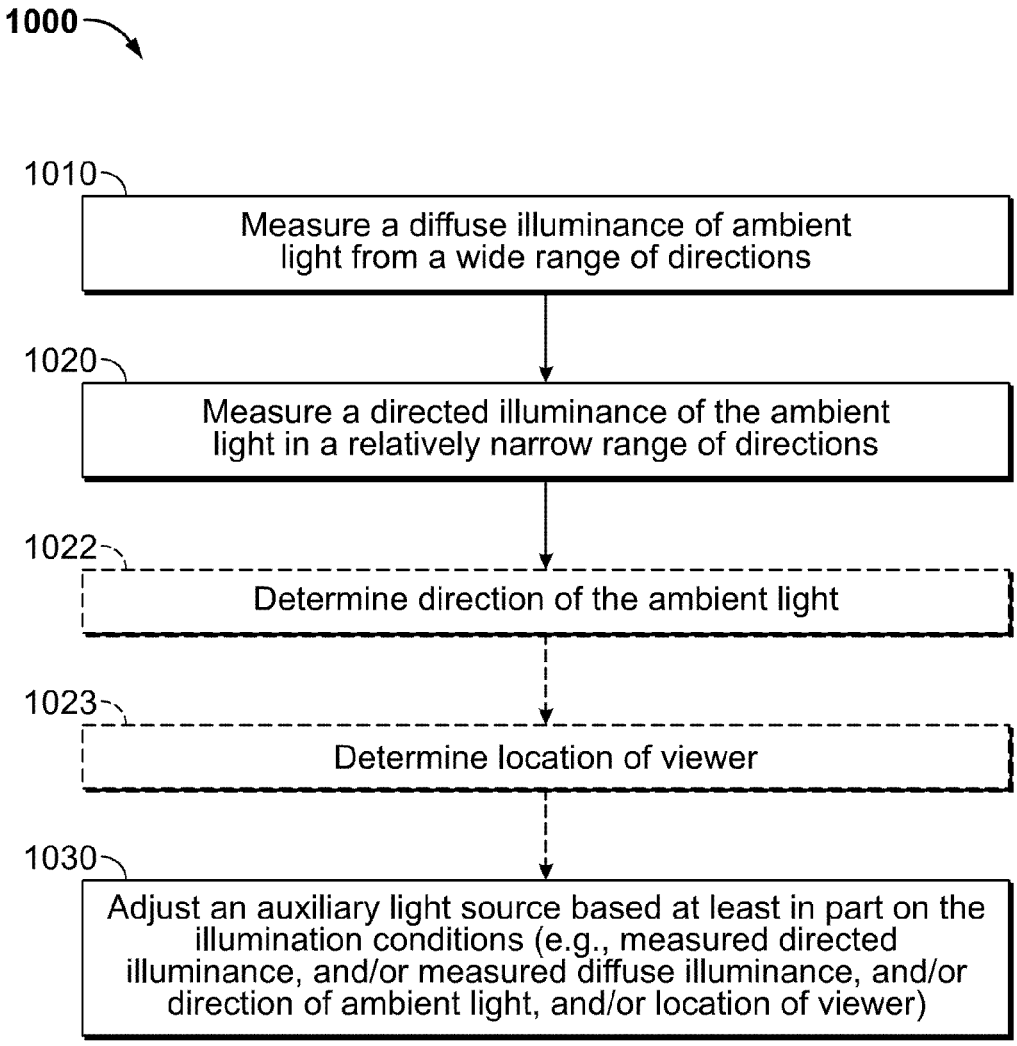
FIG. 17A illustrates an example method of controlling lighting of a display.

FIG. 17A illustrates an example method of controlling lighting of a display. In FIG. 17A, the method 1000 is compatible with various implementations of the display device 200 described herein that, for example, can utilize a sensor system 230 that can determine a diffuse illuminance and a directed illuminance of the ambient light 500. For example, the method 1000 can be implemented by the controller 240. The method 1000 includes measuring a diffuse illuminance of ambient light 500 from a wide range of directions as shown in block 1010. For example, the diffuse light sensor 231 can be used to make the measurement described in block 1010. The method 1000 further includes measuring a directed illuminance of the ambient light 500 from a relatively narrow range of directions as shown in block 1020. For example, the directed light sensor 232 can be used to make the measurement described in block 1020. As shown in block 1030, the method 1000 further includes adjusting an auxiliary light source 220 based at least in part on the illumination conditions (e.g., measured directed illuminance and/or the measured diffuse illuminance of the ambient light 500). For example, in some implementations, the controller 240 can determine additional lighting conditions based at least in part on the measurement of the directed illuminance and the measurement of the diffuse illuminance of the ambient light. The controller 240 can receive the measurements of the directed and diffuse illuminances from a computer-readable storage medium (e.g., a memory device in communication with the controller). The controller 240 can transmit a lighting adjustment to the light source 220 configured to provide light to the display 210. The lighting adjustment can be based at least in part on the additional lighting conditions determined by the controller 240. For example, the lighting adjustment may include an amount by which the illumination provided by the light source 220 is to be increased or decreased. In some implementations, the controller 240 may transmit the additional lighting conditions to a lighting controller configured to adjust the light source 220.

In some implementations, adjusting the auxiliary light source 220 is based at least in part on a ratio of the measured directed illuminance to the measured diffuse illuminance. As shown in FIG. 17A, the method 1000 also can include determining a direction of the ambient light 500 as shown in optional block 1022. Also as shown in FIG. 17A, the method 1000 also can include determining a location of the viewer of the display 210 as shown in optional block 1023. Thus, adjusting the auxiliary light source 220 as shown in block 1030 also can be based on a direction to a directed ambient light source and/or on a location of a viewer.

Figure 17B:
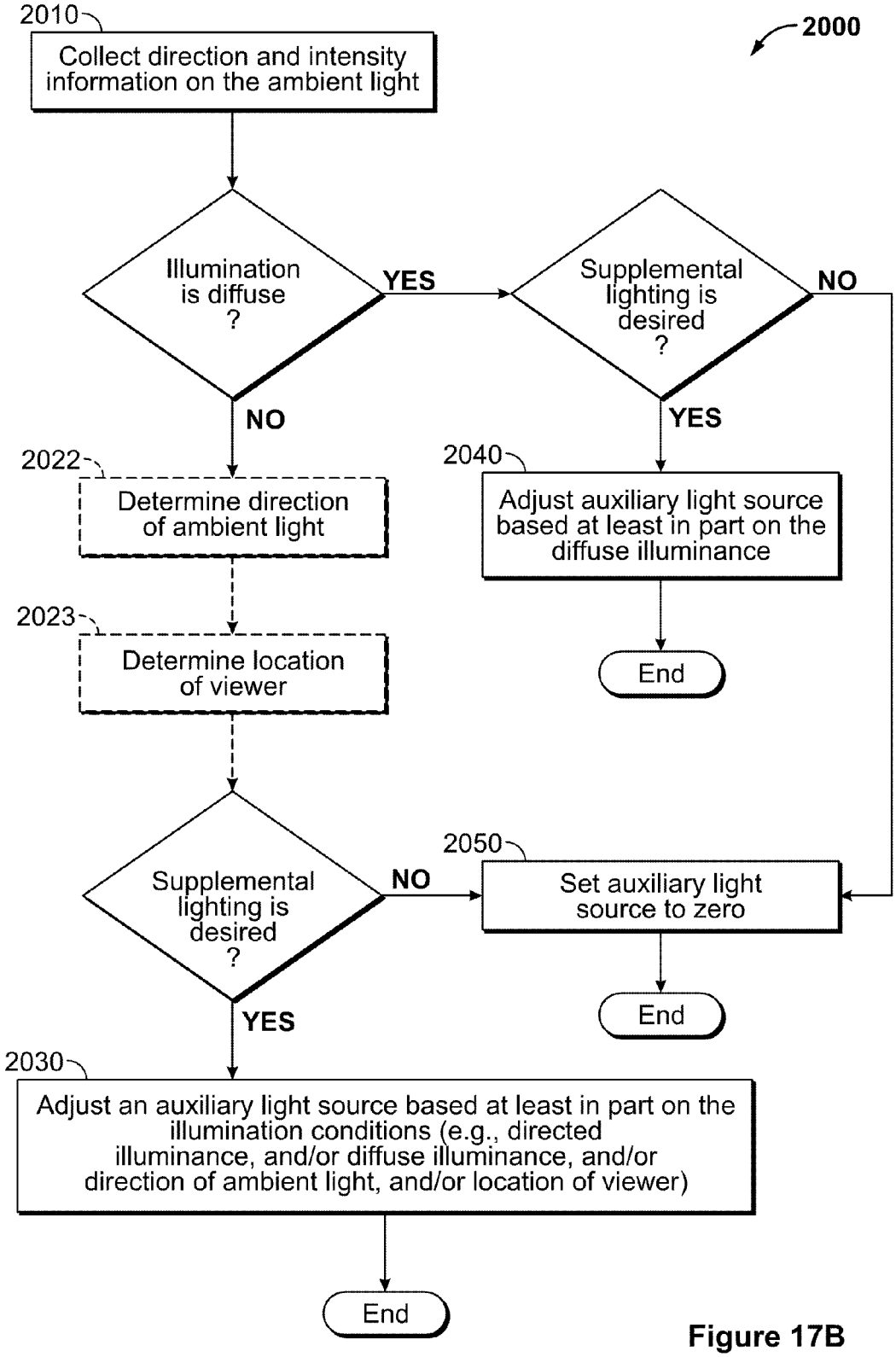
FIG. 17B illustrates another example method of controlling lighting of a display.

FIG. 17B illustrates another example method of controlling lighting of a display. The example method 2000 can be executed by the controller 240. As shown in block 2010, the method 2000 can include collecting direction and intensity information on the ambient light 500. Collecting direction and intensity information on the ambient light 500 can include collecting measured diffuse illuminance of ambient light 500 from a wide range of directions, e.g., as described in block 1010 of FIG. 17A. Collection of direction and intensity information on the ambient light 500 also can include collecting the measured directed illuminance of the ambient light 500 in a relatively narrow range of directions, e.g., as described in block 1020 of FIG. 17A. If the illumination of ambient light 500 is substantially diffuse, the brightness of the display surface may look substantially the same in all directions above the display surface (e.g., displaying Lambertian reflectance characteristics). If supplemental light is desired, some implementations of the method can include adjusting an auxiliary light source 220 based at least in part on the diffuse illuminance as shown in block 2040. For example, certain implementations of the method 2000 can include adjusting a front-light source for a reflective display based on an illumination model that is non-monotonic as will be discussed further below. As another example, which also will be discussed further below, certain implementations of the method 2000 can include adjusting a front-light source based on an illumination model where the amount of supplemental light remains substantially the same on average or substantially increases on average in response to increasing illuminance of the ambient light when the illuminance of the ambient light is below a first threshold. In such an example, adjusting a front-light source also can be based on an illumination model where the amount of supplemental light substantially decreases on average in response to increasing illuminance of the ambient light when the illuminance of the ambient light is above a second threshold that is greater than or equal to the first threshold. On the other hand, if supplemental light is not desired, some implementations can include setting the auxiliary light source to zero (or a sufficiently small value) as shown in block 2050.

If the illumination of ambient light 500 has a directed component, the display may exhibit specular reflectance and characteristics in-between specular reflectance and Lambertian reflectance, e.g., a display with gain. If supplemental light is desired, some implementations of the method can include adjusting an auxiliary light source 220 based at least in part on the directed illuminance and/or the diffuse illuminance of the ambient light as shown in block 2030. On the other hand, if supplemental light is not desired, some implementations can include setting the auxiliary light source 220 to zero (or a sufficiently small value) as shown in block 2050. In some implementations, the method 2000 also can include determining a direction of the ambient light 500 as shown in optional block 2022. In these implementations, adjusting the auxiliary light source 220 in block 2030 also can be based on the direction of the ambient light 500. In some implementations, the method 2000 can include determining a location of the viewer as shown in optional block 2023. In these implementations, adjusting the auxiliary light source 220 in block 2030 also can be based on the assumed, estimated, or measured location of the viewer.

Figure 18A:
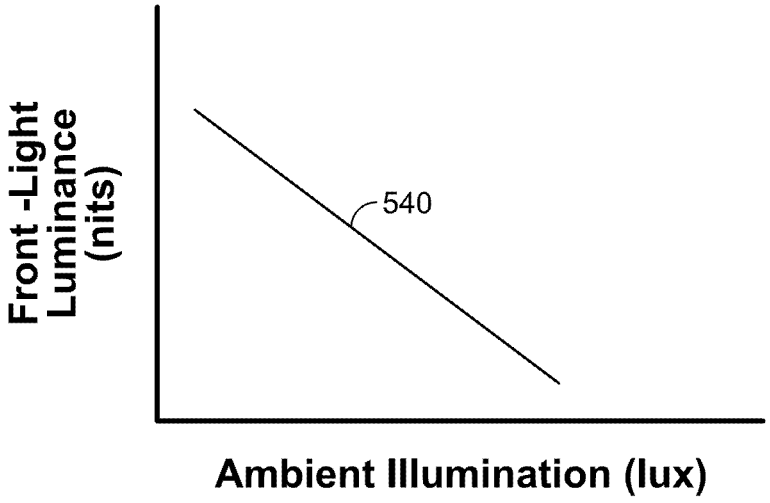
FIG. 18A illustrates an example illumination model for a reflective display.

Certain implementations can be based on one or more illumination models to provide energy-efficient display devices, e.g., "green" qualities of low power consumption that also provide an acceptable comfort level of brightness for viewers of the display. For example, certain implementations can include a front-light to provide supplemental light to a reflective display. These implementations also can include a sensor system to determine the illuminance (e.g., a diffuse illuminance, a directed illuminance, or both a diffuse illuminance and a directed illuminance) of the ambient light illuminating the reflective display. FIG. 18A illustrates an example illumination model for a reflective display. As shown in FIG. 18A, the example illumination model can be represented as the front-light luminance (e.g., the amount of supplemental light measured in units of nits added to the display luminance by a front-light) as a function of the ambient illumination (e.g., the amount of ambient lighting measured in units of lux). As shown by trace 540 of FIG. 18A, a simple illumination model for a reflective display might be to provide monotonically decreasing supplemental light as the ambient illumination increases. For example, under dark conditions where there is relatively little ambient lighting, the amount of supplemental light may be relatively high to compensate for the lack of much ambient light striking the display. As additional ambient light becomes available, the amount of supplemental light from a front-light can be monotonically decreased.

Figure 18B:
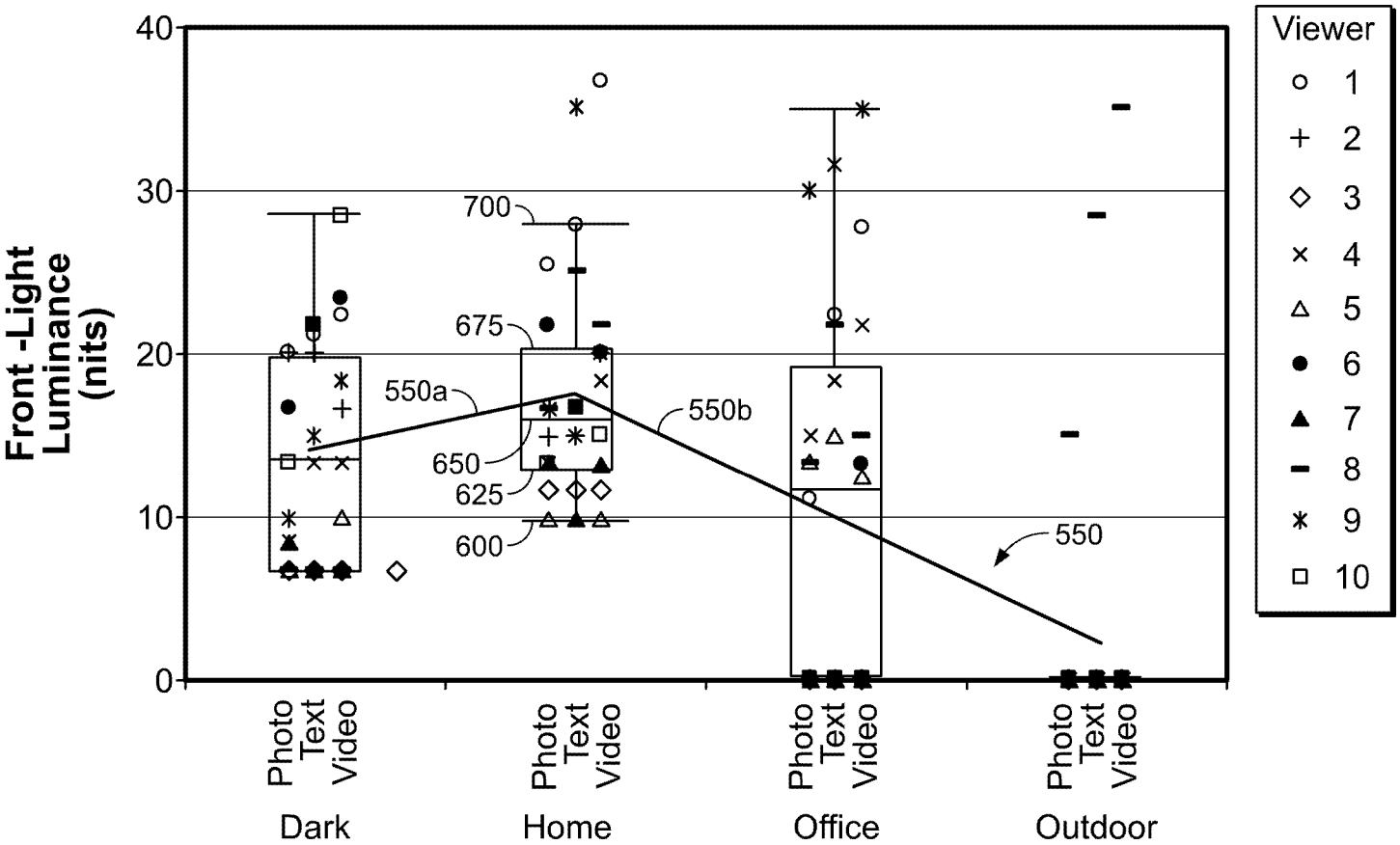
FIG. 18B is a graph that illustrates the results of a study of ten viewers who were asked to determine the amount of supplemental light for a reflective display that produced a display with an acceptable comfort level for a variety of media under a variety of lighting conditions (e.g., "dark", "home", "office", and "outdoor").

FIG. 18B is a graph that illustrates the results of a study of ten viewers who were asked to determine the amount of supplemental light for a reflective display that produced a display with an acceptable comfort level for a variety of media under a variety of lighting conditions (e.g., "dark", "home", "office", and "outdoor"). For this example study, a 5.7" diagonal, Extended Graphics Array (XGA) reflective display having a 0.5 mm thick front-light was used. The front-side of the display included a laminated 1.1 mm thick cover glass with anti-reflective and anti-glare (AR/AG) coatings. The ambient illumination (in lux) can correspond to the example lighting conditions shown in FIG. 18B. For example, approximately 0 lux can correspond to an example "dark" lighting condition, about 177 lux can correspond to an example "home" lighting condition, about 393 lux can correspond to an example "office" lighting condition, and about 977 lux can correspond to an example "outdoor" lighting condition. FIG. 18B illustrates the front-light luminance (e.g., the amount of supplemental light selected by each of the ten viewers in nits) as a function of the ambient illumination (e.g., the different lighting conditions). The responses for each of the ten viewers can be represented by the various symbols. The variety of media shown to the viewers included a color photograph, text, and a video.

Table 1 below shows the minima, maxima, and quantiles for the example results of the study shown in FIG. 18B. Table 2 below shows statistical parameters (including means and standard deviations) for the same results.

TABLE 1

Quantiles for Results of the Study shown in FIG. 18B.

| Condition | Minimum | 10% | 25% | Median | 75% | 90% | Maximum |
|---|---|---|---|---|---|---|---|
| Dark | 6.39 | 6.39 | 6.39 | 13.06 | 19.73 | 21.90 | 28.07 |
| Home | 9.72 | 9.72 | 12.64 | 15.56 | 20.15 | 27.29 | 36.41 |
| Office | 0 | 0 | 0 | 11.53 | 18.90 | 29.52 | 34.74 |
| Outdoor | 0 | 0 | 0 | 0 | 0 | 13.25 | 34.74 |

TABLE 2

Statistical Parameters for Results of the Study shown in Table 1.

| Condition | Number | Mean | Std Dev | Std Err Mean | Lower 95% | Upper 95% |
|---|---|---|---|---|---|---|
| Dark | 30 | 13.34 | 6.70 | 1.22 | 10.83 | 15.84 |
| Home | 30 | 17.28 | 6.90 | 1.26 | 14.71 | 19.86 |
| Office | 30 | 10.42 | 11.34 | 2.07 | 6.19 | 14.66 |
| Outdoor | 30 | 2.58 | 8.32 | 1.52 | −0.53 | 5.70 |

The example results are presented with box plots illustrated in FIG. 18B. Note that for ease of presentation, various features of the box plots in FIG. 18B will be described using reference numerals shown only with respect to the box plot for "home" illumination conditions. The corresponding features for the box plots for "dark," "office," and "outdoor" illumination conditions should be apparent from FIG. 18B. The box plots in FIG. 18B include a lower line 600 and an upper line 700 for the amount of desired supplemental lighting for each of the lighting conditions. Lines 600 and 700 can represent adjacent values, e.g., the smallest value in the data set above the lower inner fence and the largest value in the data set below the upper inner fence respectively. A fence can be defined as the value one step beyond the spread of the data, e.g., one step beyond the edges 625 and 675 (or "hinges") of the box. A step can be, e.g., as used in this example, 1.5 times the difference between the edges 625 and 675 of the box (e.g., 1.5 times the H-spread, which can be the difference between the upper and lower hinges). Lines 600 and 700 can help identify outliers in the data. For example in this study, for "home" and "outdoor" conditions, the points larger than the upper adjacent values, e.g., points lying above the upper line 700, can be considered as outliers. For "dark" and "office" conditions in this study, there appear to be no outliers, e.g., the data falls within the adjacent values represented by lines 600 and 700. In other example studies, results can be presented or analyzed with a histogram or other tool for statistical presentation of data.

The box placed within the lower line 600 and the upper line 700 shows the amount of supplemental lighting at the 25th percentile and the 75th percentile of the data, with the bottom edge 625 of the box representing the 25th percentile and the top edge 675 of the box representing the 75th percentile. For example, in "home" conditions, 25% of the viewers in this study desired about 12.6 nits of supplemental lighting, while 75% desired about 20.1 nits of supplemental lighting. The horizontal line 650 within the box represents the 50th percentile (median). For example, the median amount of supplemental lighting in "home" lighting conditions was about 15.6 nits. Many viewers did not desire supplemental light under "outdoor" lighting conditions, e.g., greater than about 800 lux. For example, only one out of ten viewers (e.g., viewer 8 represented by the symbol "-") desired supplemental lighting in "outdoor" lighting conditions. Some viewers, e.g., 25% to about half of the viewers, did not desire supplemental light under "office" lighting conditions, e.g., greater than about 250 lux. As will be described herein, viewer preferences can be accommodated in certain implementations of display devices based on one or more illumination models.

Based on the above results, illumination models better than the simple one illustrated in FIG. 18A are developed. One example of such illumination models is shown by trace 550 in FIG. 18B. The general shape of the trace 550 is an "inverted-V" shape based on trace segments 550*a* and 550*b* connecting the study data at the mean (average). In contrast to the example illumination model shown in FIG. 18A, the results of the study described with reference to FIG. 18B show an unexpected result that the amount of supplemental light preferred by average viewers is non-monotonic and has a peak value, not in dark conditions (e.g., around 0 lux for this study), but rather in home conditions (e.g., around 177 lux for this study). The peak value in this study was about 17 nits (e.g., the value at the top of the "inverted-V") in home conditions, while the average in dark conditions was about 13 nits.

In this example illumination model, the amount of supplemental light increased for increasing levels of illuminance in the lower range of illuminances for "dark" and "home" lighting conditions (e.g., below about 177 lux), as shown by the trace segment 550*a* of trace 550. As mentioned, the amount of supplemental light increased to a peak value of about 17 nits of supplemental light for home conditions (e.g., at about 177 lux of ambient illumination). In the higher range of illuminances for "office" and "outdoor" lighting conditions (e.g., above about 177 lux), the amount of supplemental light decreased with increasing levels of ambient illuminance, as shown by the trace segment 550*b* of trace 550. In this study, as described above, many of the viewers did not select any supplemental lighting for outdoor lighting conditions. Therefore, in some illumination models, the amount of supplemental light can be set to zero above an upper illuminance threshold (e.g., about 500 lux in some cases).

Figure 18C:
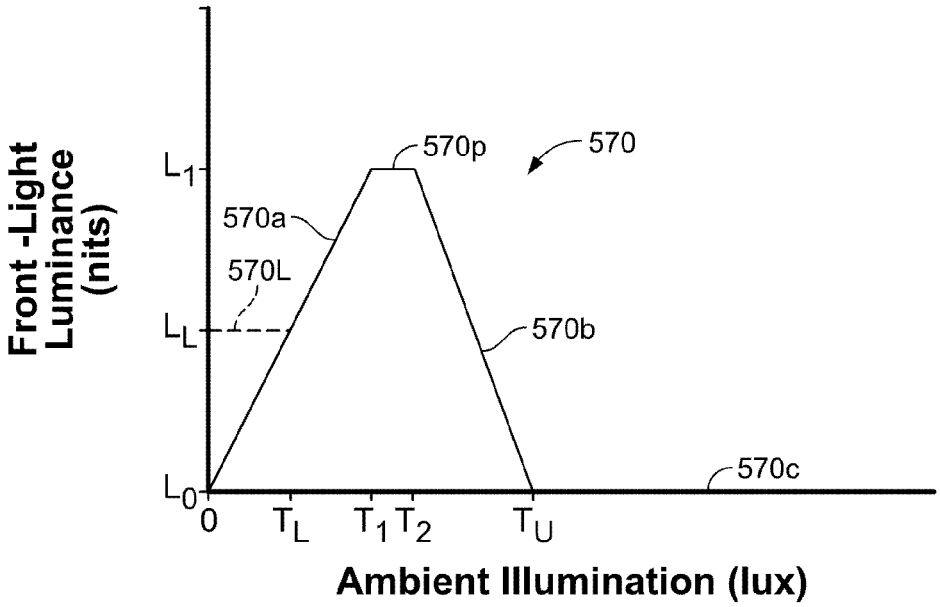
FIG. 18C illustrates an example illumination model for a reflective display.

FIG. 18C illustrates an example illumination model for a reflective display. The example illumination model of FIG. 18C shows some of the general characteristics of certain "inverted-V" illumination models. Trace 570 illustrates the front-light luminance (e.g., the amount of supplemental light in nits to provide to the reflective display) as a function of ambient illumination (e.g., the amount of ambient lighting in lux). As shown by trace segment 570*a* of trace 570, for at least some illuminances below a first threshold $T_1$ of ambient illumination, the amount of supplemental light can substantially increase on average in response to increasing illuminance of the ambient light. For example, $L_1$ represents the amount of supplemental light to add to the display when the ambient illumination is at the first threshold $T_1$. $L_0$ (0 nits in this example) represents the amount of supplemental light to add to the display when the ambient illumination is at about 0 lux. Although $L_0$ in FIG. 18C is shown to be 0 nits, $L_0$ can be any value less than $L_1$, e.g., from about 0 nits to $L_1$.

In this example illumination model, the amount of supplemental light can substantially increase on average from $L_0$ to a peak value of $L_1$ in response to increasing illuminance of the ambient light from about 0 to $T_1$. Substantially increase on average, as used herein, can mean that over a range of values, the amount of supplemental light for a portion of the range could decrease, but the amount of supplemental light on average increases over the range (e.g., the amount increases on average over the range and may, but need not, monotonically increase over the entire range). In some implementations, the first threshold $T_1$ can be between about 100 lux to about 300 lux, e.g., about 100 lux, about 200 lux, or about 300 lux. In some implementations, the first threshold $T_1$ can be between about 100 lux to about 200 lux, e.g., about 125 lux, about 150 lux, or about 175 lux. In addition, in some implementations, the first threshold $T_1$ can be between about 200 lux to about 300 lux, e.g., about 225 lux, about 250 lux, or about 275 lux. The amount supplemental light or the peak value of $L_1$ at $T_1$ can be between about 15 nits to about 35 nits, e.g., about 15 nits, about 20 nits, about 25 nits, about 30 nits, about 35 nits, or the maximum light that can be provided by the front-light.

The rate of increase of supplemental light with increasing ambient illuminances from 0 to $T_1$ for some implementations can be between about 0 nit/lux to about 0.05 nit/lux, e.g., about 0.01 nit/lux, about 0.013 nit/lux, about 0.02 nit/lux, about 0.023 nit/lux, about 0.03 nit/lux, about 0.033 nit/lux, about 0.04 nit/lux, about 0.043 nit/lux, or about 0.05 nit/lux. In some implementations, the rate of increase of supplemental light with increasing ambient illuminances from 0 to $T_1$ can be between about 0 nit/lux to about 1 nit/lux, e.g., about 0.06 nit/lux, about 0.07 nit/lux, about 0.08 nit/lux, about 0.09 nit/lux, or about 1 nit/lux. In certain implementations, trace segment 570*a* can be substantially linear as shown in FIG. 18C. In some other implementations, trace segment 570*a* can be any other substantially increasing shape, e.g., exponential or logarithmic curves. Trace segment 570*a* may, but need not, be monotonically increasing.

In various implementations, the amount of supplemental light at the peak value $L_1$ can be approximately the same on average, as shown by trace segment 570*p* of trace 570, when the illuminance of the ambient light is between the first threshold $T_1$ and a second threshold $T_2$. Approximately the same on average, as used herein, can mean that over a range of values, the amount of supplemental light for a portion of the range could increase or decrease, but the amount of supplemental light on average is approximately the same over the range.

As shown in FIG. 18C, the second threshold $T_2$ is greater than the first threshold $T_1$. For example, the first threshold $T_1$ can be greater than about 100 lux and the second threshold $T_2$ can be less than about 500 lux. As one example, $T_1$ can be about 150 lux and the second threshold $T_2$ can be about 300 lux. As another example, the first threshold $T_1$ can be greater than about 150 lux and the second threshold $T_2$ can be less than about 300 lux. As one example, $T_1$ can be about 175 lux and the second threshold $T_2$ can be about 225 lux. In these implementations, the amount of supplemental light can be approximately the same amount on average when the illuminance of the ambient light is between the first and second thresholds $T_1$ and $T_2$. For example, the amount of supplemental light 570*p* between the first and second thresholds $T_1$ and $T_2$ can remain approximately the same between about 15 nits to about 35 nits, e.g., about 15 nits, about 20 nits, about 25 nits, about 30 nits, about 35 nits, or the maximum light that can be provided by the front-light source.

In some other implementations, the amount of supplemental light 570*p* between the first and second thresholds $T_1$ and $T_2$ can include a single peak value at $L_1$. For example, the second threshold $T_2$ can be equal to the first threshold $T_1$. In some such illumination models, the location of the peak $T_1$=$T_2$ can be between about 100 lux to about 300 lux. For example, the first and second thresholds $T_1$ and $T_2$ can be about 100 lux, about 125 lux, about 150 lux, about 175 lux, about 200 lux, about 225 lux, about 250 lux, about 275 lux, or about 300 lux. In these implementations, the amount of supplemental light can reach the peak value $L_1$ for the illuminance of the ambient light. The peak value $L_1$, for example, can be between about 20 nits to about 40 nits, e.g., about 20 nits, about 25 nits, about 30 nits, about 35 nits, or about 40 nits. The peak value $L_1$ of the amount of supplemental light can in some instances correspond to the maximum light that can be provided by the front-light source.

Also as shown in FIG. 18C by trace segment 570*b* of trace 570, the amount of supplemental light can substantially decrease on average in response to increasing illuminance of the ambient light for at least some illuminances when the illuminance of the ambient light is above the second threshold $T_2$. For example, $L_1$ represents the amount of supplemental light to add to the display when the ambient illumination is at $T_2$ (the amount of supplemental light being the same as for $T_1$ in this example). $L_0$ represents the amount of supplemental light to add to the display (the amount of supplemental light being about 0 nits in this example) when the ambient illumination is at $T_U$, which is greater than $T_2$. The amount of supplemental light can substantially decrease on average from $L_1$ to $L_0$ in response to increasing illuminance of the ambient light from $T_2$ to $T_U$. Substantially decrease on average, as used herein, can mean that over a range of values, the amount of supplemental light for a portion of the range could increase, but the amount of supplemental light on average decreases over the range (e.g., the amount decreases on average over the range and may, but need not, monotonically decrease over the entire range).

In some implementations, the second threshold $T_2$ can be between about 100 lux to about 500 lux, e.g., about 100 lux, about 150 lux, about 200 lux, about 250 lux, about 300 lux, about 350 lux, about 400 lux, or about 500 lux. The amount supplemental light $L_1$ at $T_2$ can be between about 15 nits to about 35 nits, e.g., about 15 nits, about 20 nits, about 25 nits, about 30 nits, about 35 nits, or the maximum light that can be provided by the front-light. $T_U$ can be any value greater than $T_2$.

The rate of decrease for certain implementations can be between about 0.01 nit/lux to about 0.05 nit/lux, e.g., about 0.01 nit/lux, about 0.02 nit/lux, about 0.03 nit/lux, about 0.04 nit/lux, or about 0.05 nit/lux. In some implementations, the rate of decrease above the second threshold $T_2$ can be the same as the rate of increase below the first threshold $T_1$. In some other implementations, the rate of decrease above second threshold $T_2$ can be different than the rate of increase below the first threshold $T_1$. In certain implementations, trace segment 570*b* can be substantially linear as shown in FIG. 18C. In certain other implementations, trace segment 570*b* can be any other shape that is substantially decreasing. Trace segment 570*b* may, but need not, be monotonically decreasing. As shown in FIG. 18C, the amount of supplemental lighting in some illumination models can decrease to about 0 nits for $L_0$ at $T_U$. Although $L_0$ at $T_U$ can be 0 nits, $L_0$ can be any value less than $L_1$, e.g., from 0 nits to $L_1$. Certain models, e.g., as shown by trace 570, can be non-monotonic in shape for the amount of supplemental light as a function of the illuminance of the ambient light. For example in the model shown in FIG. 18C, the amount of supplemental light increases for increasing levels of ambient illumination between about 0 and $T_1$ and the amount of supplemental light decreases for increasing levels of ambient illumination between about $T_2$ and $T_U$.

In some implementations, as shown in FIG. 18C, $T_U$ in the illumination model 570 can represent an upper threshold greater than the second threshold $T_2$. The upper threshold $T_U$ can be between about 600 nits to about 1000 nits, e.g., about 600 nits, about 650 nits, about 700 nits, about 750 nits, about 800 nits, about 850 nits, or greater. Since, as discussed above, certain viewers may find that the reflective display may not need an additional amount of supplemental light at high illuminances, the illumination model may include an upper threshold $T_U$, above which the amount of supplemental light provided to the display 210 remains approximately the same on average at about 0 nits as shown by trace segment 570*c*. In other implementations, the amount of supplemental light when the illuminance of the ambient light is greater than the upper threshold $T_U$, can be non-zero, e.g., between about 0 nits to about 5 nits. For example, in some implementations, the amount of supplemental light when the illuminance of the ambient light is greater than the upper threshold $T_U$, can be about 1 nit, about 1.5 nits, about 2 nits, about 2.5 nits, about 3 nits, about 3.5 nits, about 4 nits, about 4.5 nits, or about 5 nits.

In some implementations, as shown by dashed trace segment 570L in FIG. 18C, the illumination model may include a relatively flat portion at low illumination levels. For example, the illumination model can include a lower threshold $T_L$ less than the first threshold $T_1$. In implementations having a lower threshold $T_L$, the amount of supplemental light to provide to the display can be substantially the same on average at luminance $L_L$ as shown by the dashed trace segment 570L when the illuminance of the ambient light is below the lower threshold $T_L$. The luminance $L_L$ can be between about 0 nits and $L_1$. For example, in some illumination models, $L_L$ equals $L_1$, and the amount of supplemental light added to the display is generally constant for illuminances below the threshold $T_2$, and the amount of supplemental light substantially decreases for illuminances above the threshold $T_2$. In some implementations, there may be no lower threshold $T_L$. In other words, $T_L$ can be about 0 lux and $L_L$ can be about 0 nits. Thus, although $L_L$ is shown as a positive amount of supplemental light in FIG. 18C, $L_L$ also can be zero. In various implementations, $L_L$ can be between about 0 nits to about 30 nits, e.g., about 0 nits, about 5 nits, about 10 nits, about 15 nits, about 20 nits, about 25 nits, or about 30 nits.

Figure 18D:
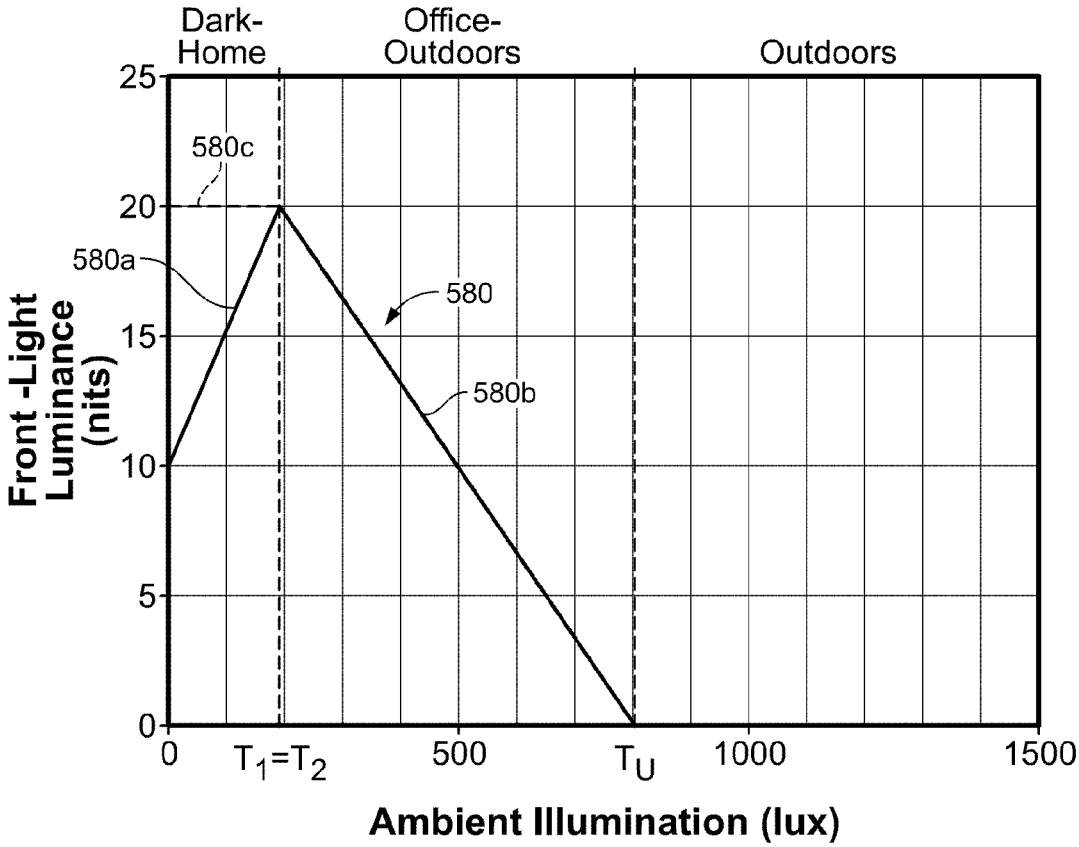
FIG. 18D illustrates another example illumination model for a reflective display.

FIG. 18D illustrates another example illumination model for a reflective display. This example illumination model also is generally representative of an "inverted-V" model. For example, trace 580 illustrates the amount of supplemental light to add to a reflective display. The amount of supplemental light can substantially increase on average in response to increasing illuminance of the ambient light when the illuminance of the ambient light is below a first threshold $T_1$. As shown in FIG. 18D, the first threshold can be about 200 lux. The range from 0 to about 200 lux can represent complete darkness or very low ambient illuminance. Home lighting, which in some cases represents the light from a single, low wattage source, e.g., 60 watts or 75 watts, can fall within this range. As shown by trace segment 580*a*, the amount of supplemental light can substantially increase on average with increasing illuminance of the ambient light when the illuminance of the ambient light is below, e.g., 200 lux. For example, trace segment 580*a* increases from about 10 nits to about 20 nits between 0 lux to about 200 lux of ambient light, or about a 0.05 nit/lux rate increase. As discussed above with respect to FIG. 18C, the amount of supplemental light also can decrease in response to increasing illuminances of ambient light when the illuminance of the ambient light is greater than a second threshold $T_2$.

FIG. 18D is an example where the second threshold $T_2$ is approximately equal to the first threshold $T_1$, e.g., at approximately 200 lux. The amount of supplemental light at $T_1$=$T_2$ can be about 20 nits in this example. In some implementations, this amount of supplemental light can be a peak value. In some implementations, this peak value may correspond to the maximum light that can be provided by the front-light source.

FIG. 18D illustrates an example where there is no lower threshold $T_L$, e.g., $T_L$ substantially equals 0 lux. At 0 lux of ambient illumination, the amount of supplemental lighting in this example is not at 0 nits, but at a non-zero value, e.g., about 10 nits. Also as shown in the example of FIG. 18D, the illumination model 580 can have an upper threshold $T_U$, e.g., at approximately 800 lux. The range from about 200 lux to about 800 lux can include office lighting conditions, which typically include multiple light sources (e.g., compact fluorescent lamp (CFL) fixtures), and some outdoor lighting conditions. As shown by trace segment 580*b*, the amount of supplemental light can substantially decrease on average from about 20 nits to about 0 nits for about 200 lux to about 800 lux of ambient illumination, or e.g., about a 0.033 nit/lux rate decrease. The range of greater than 800 lux can include outdoor lighting, e.g., a bright cloudy and/or a sunny environment. The amount of supplemental light in this range can be approximately zero when the illuminance of the ambient light is above this upper threshold T.

As shown by trace 580 in FIG. 18D, certain implementations can utilize a model that is non-monotonic for the amount of supplemental light as a function of the illuminance of the ambient light. For example in the model shown in FIG. 18D, the amount of supplemental light increases for increasing levels of ambient illumination below about 200 lux, reaches a peak value at about 200 lux, and decreases for increasing levels of ambient illumination above about 200 lux.

As shown by the dotted trace segment 580*c* in FIG. 18D, in certain implementations, the amount of supplemental light can remain substantially the same on average, e.g., at 20 nits in this example, from about 0 lux to the first threshold $T_1$ of ambient illumination. In other examples, the amount of supplemental light can remain substantially the same, e.g., between about 10 nits to about 30 nits. For example, the amount of supplemental light can substantially remain at about 10 nits, about 15 nits, about 25 nits, or about 30 nits when the ambient illumination is below the first threshold $T_1$. Another example illumination model may appear substantially similar in shape as in FIG. 18D, but with the amount of supplemental light starting at 20 nits at an ambient illumination of about 0 lux and boosting the low range of ambient illuminance, e.g., to about 30 nits for ambient illumination up to about 200 lux. In some other example illumination models, the amount of supplemental light can start at about 50 nits at an ambient illumination of about 0 lux and boost the low range of ambient illuminance, e.g., to about 65 nits to about 70 nits for ambient illumination up to about 175 to about 200 lux. In these such examples, the amount of supplemental light can substantially decrease and remain at about 60 nits for ambient illumination at about 400 lux and greater. Some of these implementations may provide a more optimal comfort level with an increase in power consumption.

Content may not significantly influence the amount of supplemental light, but it may be desired to have more supplemental light for text and video than for photographs, at least for some viewers. Thus, in some implementations, the controller 240 can be configured to determine the amount of supplemental light based at least in part on the content being displayed. For example, when a photographic image is being displayed, the controller 240 can determine the amount of supplemental light based at least in part on an illumination model providing a display with an acceptable comfort level for an image being displayed. When text is being displayed, the controller 240 also can determine the amount of supplemental light based at least in part on an illumination model providing a display with an acceptable comfort level for text being displayed. Furthermore, when a video is being displayed, the controller 240 can determine the amount of supplemental light based at least in part on an illumination model providing a display with an acceptable comfort level for video being displayed. In some implementations, illumination models for text content and/or video content may provide more supplemental light than an illumination model for a photographic image. Furthermore, the controller 240 of some implementations can be configured to determine the amount of supplemental light based at least in part on viewer preferences and/or directed illuminance and/or diffuse illuminance and/or a direction to a directed ambient light source and/or a location of the viewer.

FIGS. 18A-18D schematically show examples of illumination models that can be used with various implementations of display devices. These examples are intended to be illustrative and not limiting. For example, the traces, numerical values, ranges, and conditions are representative of these example illumination models, and in other illumination models, the traces, numerical values, ranges, and conditions may be different.

Figure 19:
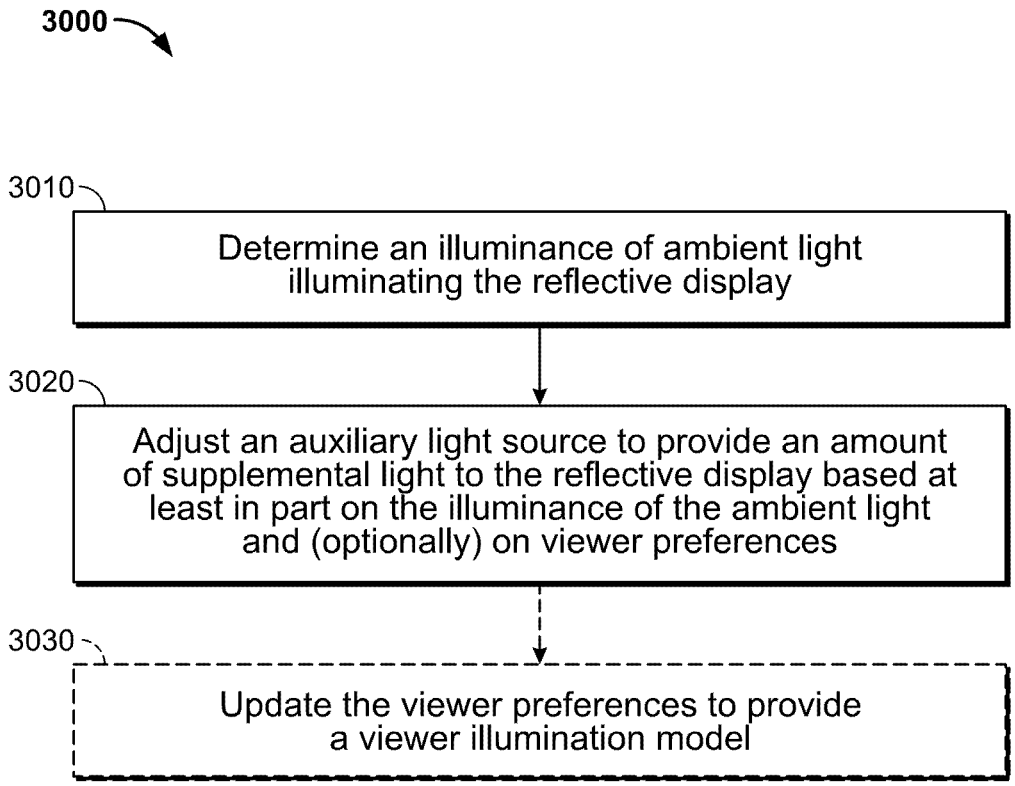
FIG. 19 illustrates an example method of controlling supplemental lighting of a reflective display.

FIG. 19 illustrates an example method of controlling supplemental lighting of a reflective display. In FIG. 19, the method 3000 can be used with various implementations of the display device 200 described herein. For example, the method 3000 can be implemented for a reflective display 210 by the controller 240. As shown in block 3010, the method 3000 includes determining an illuminance of ambient light 500 illuminating the reflective display 210. For example, the sensor system 230 can be used to make the determination described in block 3010. In some implementations, the sensor system 230 may determine a diffuse illuminance of the ambient light 500. In some other implementations, the sensor system 230 may determine a directed illuminance of the ambient light 500. Furthermore, in some implementations, the sensor system 230 may determine both a diffuse illuminance and a directed illuminance of the ambient light 500. As shown in block 3020, the method 3000 further can include adjusting an auxiliary light source 220 to provide an amount of supplemental light to the display 210 based at least in part on the illuminance of the ambient light 500 (see, e.g., FIGS. 18A-18D).

As an example, in some implementations, the adjustment can include substantially increasing on average the amount of supplemental light in response to increasing illuminance of the ambient light when the illuminance of the ambient light is below a first threshold $T_1$. As another example, the adjustment in some other implementations can include the amount of supplemental light remaining substantially the same on average in response to increasing illuminance of the ambient light when the illuminance of the ambient light is below the first threshold $T_1$. The adjustment also can include substantially decreasing on average the amount of supplemental light in response to increasing illuminance of the ambient light when the illuminance of the ambient light is above a second threshold $T_2$ that is greater than or equal to the first threshold $T_1$.

In some implementations, as shown in block 3020, adjusting an auxiliary light source 220 to provide an amount of supplemental light to the display 210 also can be based at least in part on content to be displayed. For example, when text is being displayed, adjusting an auxiliary light source 220 can include adjusting the amount of supplemental light by using an illumination model based at least in part on text content. When an image (or a video) is being displayed, adjusting an auxiliary light source 220 can include adjusting the amount of supplemental light by using an illumination model based at least in part on the image (or the video) content.

In some implementations, as shown in block 3020, adjusting an auxiliary light source 220 to provide an amount of supplemental light to the display 210 also can be based at least in part on viewer preferences. For example, adjusting an auxiliary light source 220 can include adjusting a user interface by the viewer to provide an amount of supplemental light by the auxiliary light source 220.

In addition, as shown in optional block 3030, the method 3000 further can include updating the viewer preferences to provide a viewer illumination model. The viewer illumination model can be stored (e.g., in a memory associated with the controller 240) and can be accessed to provide the amount of supplemental light to add to the display based on the ambient lighting conditions. In some implementations, a display device may include a default illumination model that can be updated by the viewer. As one example, the default illumination could be an "inverted-V" model (see, e.g., FIGS. 18B-18D). A particular viewer (e.g., viewer 8 represented by the symbol "-" in FIG. 18B) may desire more supplemental light in certain conditions (e.g., outdoor conditions) than is provided by the default illumination model (e.g., as shown by the trace 550 in FIG. 18B). The viewer could enter the viewer's preferences, and the controller 240 could store these updates to the illumination model to use in the future.

In some implementations, for example, as shown in the methods of FIGS. 17A and 17B for controlling lighting of a display, adjusting the auxiliary light source 220 also can be based at least in part on a measured directed illuminance and/or a measured diffuse illuminance, and/or a direction to a directed ambient light source, and/or a location of the viewer.

Figure 20A:
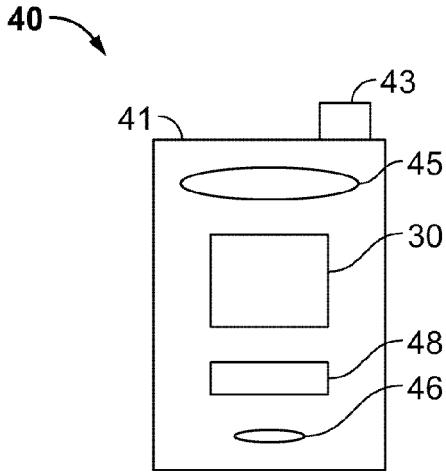
FIGS. 20A and 20B show examples of system block diagrams illustrating a display device that includes a plurality of interferometric modulators.
Figure 20B:
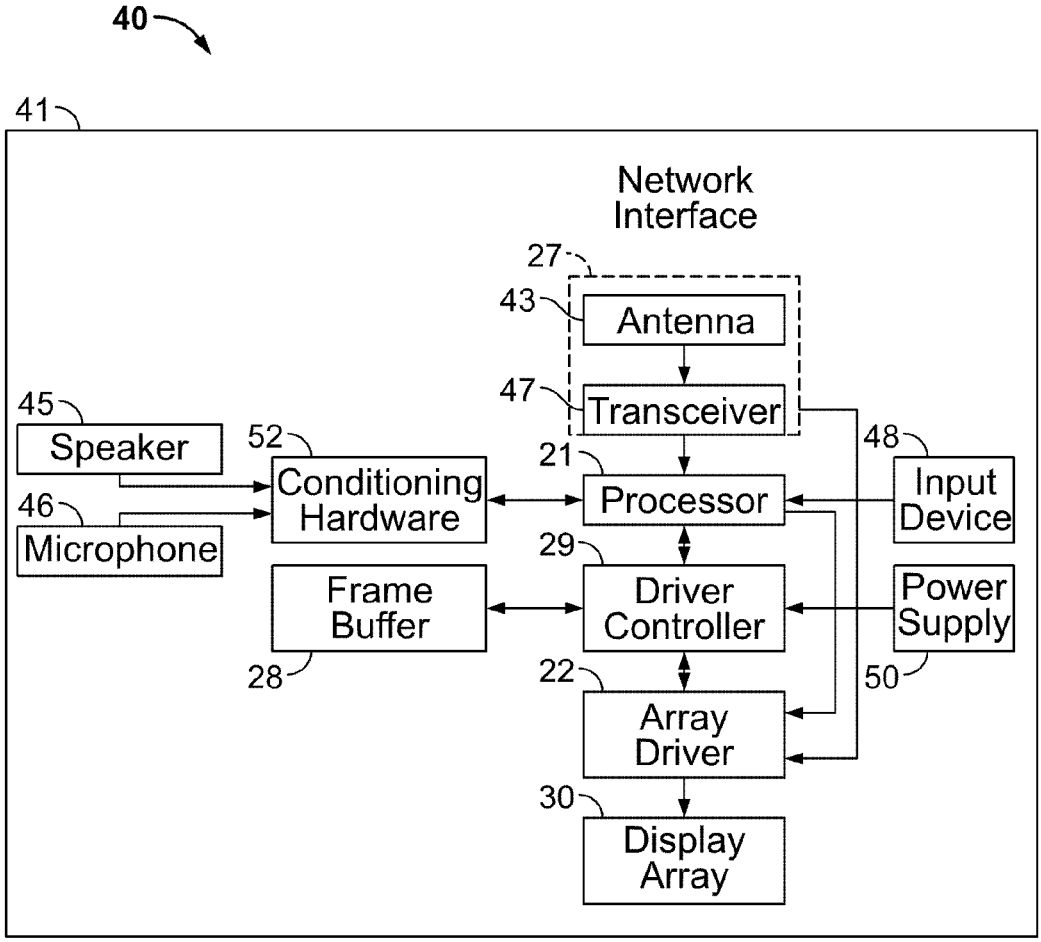

FIGS. 20A and 20B show examples of system block diagrams illustrating a display device 40 that includes a plurality of interferometric modulators. The display device 40 can be, for example, a cellular or mobile telephone. However, the same components of the display device 40 or slight variations thereof are also illustrative of various types of display devices such as televisions, e-readers and portable media players. The display device 200 (and components thereof) described with reference to FIG. 12 may be generally similar to the display device 40.

The display device 40 includes a housing 41, a display 30, an antenna 43, a speaker 45, an input device 48, and a microphone 46. The display 30 can include the various examples of the display 210 as described herein. The housing 41 can be formed from any of a variety of manufacturing processes, including injection molding, and vacuum forming. In addition, the housing 41 may be made from any of a variety of materials, including, but not limited to: plastic, metal, glass, rubber, and ceramic, or a combination thereof. The housing 41 can include removable portions (not shown) that may be interchanged with other removable portions of different color, or containing different logos, pictures, or symbols. As described herein, the housing 41 can include at least one aperture or tube combined with a photosensor to form a directed light sensor. The housing 41 also can include a plurality of apertures or tubes combined with photosensors to form a plurality of directed light sensors.

The display 30 may be any of a variety of displays, including a bi-stable or analog display, as described herein. The display 30 also can be configured to include a flat-panel display, such as plasma, EL, OLED, STN LCD, or TFT LCD, or a non-flat-panel display, such as a CRT or other tube device. In addition, the display 30 can include an interferometric modulator display, as described herein.

The components of the display device 40 are schematically illustrated in FIG. 20B. The display device 40 includes a housing 41 and can include additional components at least partially enclosed therein. For example, the display device 40 includes a network interface 27 that includes an antenna 43 which is coupled to a transceiver 47. The transceiver 47 is connected to a processor 21, which is connected to conditioning hardware 52. In certain implementations, the processor 21 can include the controller 240 or can function as the controller 240 described herein. Methods described herein, e.g., methods 1000, 2000, and 3000, can be executed via instructions by the processor 21. The conditioning hardware 52 may be configured to condition a signal (e.g., filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. A power supply 50 can provide power to all components as required by the particular display device 40 design.

The network interface 27 includes the antenna 43 and the transceiver 47 so that the display device 40 can communicate with one or more devices over a network. The network interface 27 also may have some processing capabilities to relieve, e.g., data processing requirements of the processor 21. The antenna 43 can transmit and receive signals. In some implementations, the antenna 43 transmits and receives RF signals according to the IEEE 16.11 standard, including IEEE 16.11 (a), (b), or (g), or the IEEE 802.11 standard, including IEEE 802.11a, b, g or n. In some other implementations, the antenna 43 transmits and receives RF signals according to the BLUETOOTH standard. In the case of a cellular telephone, the antenna 43 is designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), NEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G or 4G technology. The transceiver 47 can pre-process the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that is readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation, and gray-scale level.

The processor 21 can include a microcontroller, a central processing unit (CPU), or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a stand-alone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of pixels.

In some implementations, the driver controller 29, the array driver 22, and the display array 30 are appropriate for any of the types of displays described herein. For example, the driver controller 29 can be a conventional display controller or a bi-stable display controller (e.g., an IMOD controller). Additionally, the array driver 22 can be a conventional driver or a bi-stable display driver (e.g., an IMOD display driver). Moreover, the display array 30 can be a conventional display array or a bi-stable display array (e.g., a display including an array of IMODs). In some implementations, the driver controller 29 can be integrated with the array driver 22. Such an implementation is common in highly integrated systems such as cellular phones, watches and other small-area displays.

In some implementations, the input device 48 can be configured to allow, e.g., a user to control the operation of the display device 40. The input device 48 can include a keypad, such as a QWERTY keyboard or a telephone keypad, a button, a switch, a rocker, a touch-sensitive screen, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices as are well known in the art. For example, the power supply 50 can be a rechargeable battery, such as a nickel-cadmium battery or a lithium-ion battery. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

The various illustrative logics, logical blocks, modules, circuits and algorithm steps described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and steps described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. In some implementations, particular steps and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the lookup table, functions or formulas used to produce or use the lookup table or to produce values for the amount of auxiliary light may be stored on or transmitted over as one or more data structures or instructions or code on a computer-readable medium. The steps of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. The word "exemplary" is used exclusively herein to mean "serving as an example, instance, or illustration." Any implementation described herein as "exemplary" is not necessarily to be construed as preferred or advantageous over other implementations. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the IMOD as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. A display device comprising:

an auxiliary light source configured to provide supplemental light to a reflective display;

a sensor system configured to determine an illuminance of ambient light illuminating the reflective display; and a controller in communication with the sensor system, the controller configured to adjust the auxiliary light source to provide an amount of supplemental light to the reflective display based at least in part on the illuminance of the ambient light, wherein the amount of supplemental light:

remains substantially the same on average or substantially increases on average in response to increasing illuminance of the ambient light when the illuminance of the ambient light is below a first threshold, and substantially decreases on average in response to increasing illuminance of the ambient light when the illuminance of the ambient light is above a second threshold that is greater than or equal to the first threshold, wherein the amount of supplemental light has a peak value in a range from 20 nits to 30 nits for illuminance of the ambient light that is above the first threshold and below the second threshold.

2. The display device of claim 1, wherein the controller is configured to access a look-up table (LUT) or a formula that provides the amount of supplemental light to be provided.

3. The display device of claim 2, wherein the LUT or the formula is based on a model that is non-monotonic for the amount of supplemental light as a function of the illuminance of the ambient light.

4. The display device of claim 1, wherein the first threshold is approximately equal to the second threshold.

5. The display device of claim 1, wherein the first threshold is greater than about 100 lux and the second threshold is less than 500 lux.

6. The display device of claim 1, wherein the amount of supplemental light is approximately the same amount on average when the illuminance of the ambient light is between the first and second thresholds.

7. The display device of claim 6, wherein the amount of supplemental light is in a range from about 20 nits to about 30 nits when the illuminance of the ambient light is between the first and second thresholds.

8. The display device of claim 1, wherein the amount of supplemental light remains approximately the same on average when the illuminance of the ambient light is below a third threshold that is less than the first threshold.

9. The display device of claim 8, wherein the amount of supplemental light is in a range from 5 nits to 10 nits when the illuminance of the ambient light is below the third threshold.

10. The display device of claim 8, wherein the third threshold is less than 50 lux.

11. The display device of claim 1, wherein the peak value of the supplemental light corresponds to the maximum light that can be provided by the auxiliary light source.

12. The display device of claim 1, wherein the amount of supplemental light is approximately zero when the illuminance of the ambient light is above a fourth threshold that is greater than the second threshold.

13. The display device of claim 12, wherein the fourth threshold is greater than 800 lux.

14. The display device of claim 1, wherein for at least some illuminances below the first threshold, the amount of supplemental light increases with increasing illuminance of the ambient light by a rate in a range from 0 nit/lux to 0.05 nit/lux.

15. The display device of claim 1, wherein for at least some illuminances above the second threshold, the amount of supplemental light decreases with increasing illuminance of the ambient light by a rate in a range from 0.01 nit/lux to 0.05 nit/lux.

16. The display device of claim 1, wherein the controller is configured to determine the amount of supplemental light based at least in part on content being displayed.

17. The display device of claim 1, wherein the controller is configured to determine the amount of supplemental light based at least in part on viewer preferences.

18. The display device of claim 1, wherein the controller is configured to determine the amount of supplemental light based at least in part on at least one of a diffuse illuminance, a directed illuminance, a direction to the directed illuminance, and a location of a viewer.

19. The display device of claim 1, further comprising:

a processor that is configured to communicate with the reflective display, the processor being configured to process image data; and a memory device that is configured to communicate with the processor.

20. The display device of claim 19, further comprising:

a driver circuit configured to send at least one signal to the reflective display; and a driver controller configured to send at least a portion of the image data to the driver circuit.

21. The display device of claim 19, further comprising:

an image source module configured to send the image data to the processor.

22. The display device of claim 21, wherein the image source module includes at least one of a receiver, transceiver, and transmitter.

23. The display device of claim 19, further comprising:

an input device configured to receive input data and to communicate the input data to the processor.

24. A display device comprising:

means for providing supplemental light to a reflective display;

means for determining an illuminance of ambient light illuminating the reflective display; and means for adjusting the supplemental light means, the adjusting means configured to determine an amount of supplemental light based at least in part on the determined illuminance of the ambient light, wherein the amount of supplemental light:

remains substantially the same on average or substantially increases on average in response to increasing illuminance of the ambient light when the illuminance of the ambient light is below a first threshold, and substantially decreases on average in response to increasing illuminance of the ambient light when the illuminance of the ambient light is above a second threshold that is greater than or equal to the first threshold, wherein the amount of supplemental light has a peak value in a range from 20 nits to 30 nits for illuminance of the ambient light that is above the first threshold and below the second threshold.

25. The display device of claim 24, wherein the reflective display includes interferometric modulators, or the means for providing supplemental light includes a front-light, or the means for determining the illuminance includes a light sensor.

26. The display device of claim 24, wherein for at least some illuminances below the first threshold, the amount of supplemental light increases with increasing illuminance of the ambient light by a rate in a range from 0 nit/lux to 0.05 nit/lux.

27. The display device of claim 24, wherein for at least some illuminances above the second threshold, the amount of supplemental light decreases with increasing illuminance of the ambient light by a rate in a range from 0.01 nit/lux to 0.05 nit/lux.

28. The display device of claim 24, wherein the adjusting means is configured to determine the amount of supplemental light based at least in part on at least one of content being displayed, viewer preferences, a diffuse illuminance, a directed illuminance, a direction to the directed illuminance, and a location of a viewer.

29. A method of controlling supplemental lighting of a reflective display, the method comprising:

determining by a light sensor an illuminance of ambient light illuminating the reflective display; and automatically adjusting an auxiliary light source to provide an amount of supplemental light to the reflective display based at least in part on the illuminance of the ambient light, wherein the adjusting includes:

maintaining substantially the same amount of supplemental light on average or substantially increasing on average the amount of supplemental light in response to increasing illuminance of the ambient light when the illuminance of the ambient light is below a first threshold, and substantially decreasing on average the amount of supplemental light in response to increasing illuminance of the ambient light when the illuminance of the ambient light is above a second threshold that is greater than or equal to the first threshold, wherein the amount of supplemental light has a peak value in a range from 20 nits to 30 nits for illuminance of the ambient light that is above the first threshold and below the second threshold.

30. The method of claim 29, further comprising:

accessing a look-up table (LUT) or a formula that provides the amount of supplemental light to be provided, wherein the LUT or the formula is based on a model that is non-monotonic for the amount of supplemental light as a function of the illuminance of the ambient light.

31. The method of claim 29, wherein the first threshold is approximately equal to the second threshold.

32. The method of claim 29, wherein maintaining substantially the same amount of supplemental light on average or substantially increasing on average includes increasing the amount of supplemental light with increasing illuminance of the ambient light by a rate in a range from about 0 nit/lux to about 0.05 nit/lux when the illuminance of the ambient light is below the first threshold.

33. The method of claim 29, wherein substantially decreasing on average includes decreasing the amount of supplemental light with increasing illuminance of the ambient light by a rate in a range from about 0.01 nit/lux to 0.05 nit/lux when the illuminance of the ambient light is above the second threshold.

34. A non-transitory tangible computer storage medium having stored thereon instructions for controlling supplemental lighting of a reflective display of a display device, the instructions when executed by a computing system, causing the computing system to perform operations, the operations comprising:

receiving from a computer-readable medium a determined illuminance of ambient light illuminating the reflective display;

determining an amount of supplemental light to provide to the reflective display based at least in part on the illuminance of the ambient light, wherein the amount of supplemental light:

remains substantially the same on average or substantially increases on average in response to increasing illuminance of the ambient light when the illuminance of the ambient light is below a first threshold, and substantially decreases on average in response to increasing illuminance of the ambient light when the illuminance of the ambient light is above a second threshold that is greater than or equal to the first threshold, wherein the amount of supplemental light has a peak value in a range from 20 nits to 30 nits for illuminance of the ambient light that is above the first threshold and below the second threshold; and transmitting a supplemental lighting adjustment based at least in part on the amount of supplemental light to a light source configured to provide light to the reflective display.

35. The non-transitory tangible computer storage medium of claim 34, the operations further comprising:

accessing a look-up table (LUT) or a formula that provides the amount of supplemental light to be provided, wherein the LUT or the formula is based on a model that is non-monotonic for the amount of supplemental light as a function of the illuminance of the ambient light.

36. The non-transitory tangible computer storage medium of claim 34, wherein the first threshold is approximately equal to the second threshold.

37. The non-transitory tangible computer storage medium of claim 34, wherein for at least some illuminances below the first threshold, the amount of supplemental light increases with increasing illuminance of the ambient light by a rate in a range from 0 nit/lux to 0.05 nit/lux.

38. The non-transitory tangible computer storage medium of claim 34, wherein for at least some illuminances above the second threshold, the amount of supplemental light decreases with increasing illuminance of the ambient light by a rate in a range from 0.01 nit/lux to 0.05 nit/lux.

39. A display device comprising:

an auxiliary light source configured to provide supplemental light to a reflective display;

a sensor system configured to determine an illuminance of ambient light illuminating the reflective display; and a controller in communication with the sensor system, the controller configured to adjust the auxiliary light source to provide an amount of supplemental light to the reflective display based at least in part on the illuminance of the ambient light, wherein the amount of supplemental light:

remains substantially the same on average or substantially increases on average in response to increasing illuminance of the ambient light when the illuminance of the ambient light is below a first threshold, and substantially decreases on average in response to increasing illuminance of the ambient light when the illuminance of the ambient light is above a second threshold that is greater than or equal to the first threshold, wherein the amount of supplemental light is approximately the same amount on average and in a range from 20 nits to 30 nits when the illuminance of the ambient light is between the first and second thresholds.

40. The display device of claim 39, wherein the controller is configured to access a look-up table (LUT) or a formula that provides the amount of supplemental light to be provided.

41. The display device of claim 40, wherein the LUT or the formula is based on a model that is non-monotonic for the amount of supplemental light as a function of the illuminance of the ambient light.

42. The display device of claim 39, wherein the first threshold is greater than 100 lux and the second threshold is less than 500 lux.

43. The display device of claim 39, wherein for at least some illuminances below the first threshold, the amount of supplemental light increases with increasing illuminance of the ambient light by a rate in a range from 0 nit/lux to 0.05 nit/lux.

44. The display device of claim 39, wherein for at least some illuminances above the second threshold, the amount of supplemental light decreases with increasing illuminance of the ambient light by a rate in a range from 0.01 nit/lux to 0.05 nit/lux.

45. A non-transitory tangible computer storage medium having stored thereon instructions for controlling supplemental lighting of a reflective display of a display device, the instructions when executed by a computing system, causing the computing system to perform operations, the operations comprising:

receiving from a computer-readable medium a determined illuminance of ambient light illuminating the reflective display;

determining an amount of supplemental light to provide to the reflective display based at least in part on the illuminance of the ambient light, wherein the amount of supplemental light:

remains substantially the same on average or substantially increases on average in response to increasing illuminance of the ambient light when the illuminance of the ambient light is below a first threshold, and substantially decreases on average in response to increasing illuminance of the ambient light when the illuminance of the ambient light is above a second threshold that is greater than or equal to the first threshold, wherein the amount of supplemental light is approximately the same amount on average and in a range from 20 nits to 30 nits when the illuminance of the ambient light is between the first and second thresholds; and transmitting a supplemental lighting adjustment based at least in part on the amount of supplemental light to a light source configured to provide light to the reflective display.

46. The non-transitory tangible computer storage medium of claim 45, the operations further comprising:

accessing a look-up table (LUT) or a formula that provides the amount of supplemental light to be provided, wherein the LUT or the formula is based on a model that is non-monotonic for the amount of supplemental light as a function of the illuminance of the ambient light.

47. The non-transitory tangible computer storage medium of claim 45, wherein the first threshold is greater than 100 lux and the second threshold is less than 500 lux.

48. The non-transitory tangible computer storage medium of claim 45, wherein for at least some illuminances below the first threshold, the amount of supplemental light increases with increasing illuminance of the ambient light by a rate in a range from 0 nit/lux to 0.05 nit/lux.

49. The non-transitory tangible computer storage medium of claim 45, wherein for at least some illuminances above the second threshold, the amount of supplemental light decreases with increasing illuminance of the ambient light by a rate in a range from 0.01 nit/lux to 0.05 nit/lux.

50. A display device comprising:

an auxiliary light source configured to provide supplemental light to a reflective display;

a sensor system configured to determine an illuminance of ambient light illuminating the reflective display; and a controller in communication with the sensor system, the controller configured to adjust the auxiliary light source to provide an amount of supplemental light to the reflective display based at least in part on the illuminance of the ambient light, wherein the amount of supplemental light:

remains substantially the same on average or substantially increases on average in response to increasing illuminance of the ambient light when the illuminance of the ambient light is below a first threshold, and substantially decreases on average in response to increasing illuminance of the ambient light when the illuminance of the ambient light is above a second threshold that is greater than or equal to the first threshold, wherein the amount of supplemental light remains approximately the same on average and is in a range from 5 nits to 10 nits when the illuminance of the ambient light is below a third threshold that is less than the first threshold.

51. The display device of claim 50, wherein the controller is configured to access a look-up table (LUT) or a formula that provides the amount of supplemental light to be provided.

52. The display device of claim 51, wherein the LUT or the formula is based on a model that is non-monotonic for the amount of supplemental light as a function of the illuminance of the ambient light.

53. The display device of claim 50, wherein the first threshold is approximately equal to the second threshold.

54. The display device of claim 50, wherein the third threshold is less than 50 lux.

55. The display device of claim 50, wherein for at least some illuminances below the first threshold, the amount of supplemental light increases with increasing illuminance of the ambient light by a rate in a range from 0 nit/lux to 0.05 nit/lux.

56. The display device of claim 50, wherein for at least some illuminances above the second threshold, the amount of supplemental light decreases with increasing illuminance of the ambient light by a rate in a range from 0.01 nit/lux to 0.05 nit/lux.

57. A non-transitory tangible computer storage medium having stored thereon instructions for controlling supplemental lighting of a reflective display of a display device, the instructions when executed by a computing system, causing the computing system to perform operations, the operations comprising:

receiving from a computer-readable medium a determined illuminance of ambient light illuminating the reflective display;

determining an amount of supplemental light to provide to the reflective display based at least in part on the illuminance of the ambient light, wherein the amount of supplemental light:

remains substantially the same on average or substantially increases on average in response to increasing illuminance of the ambient light when the illuminance of the ambient light is below a first threshold, and substantially decreases on average in response to increasing illuminance of the ambient light when the illuminance of the ambient light is above a second threshold that is greater than or equal to the first threshold, wherein the amount of supplemental light remains approximately the same on average and is in a range from 5 nits to 10 nits when the illuminance of the ambient light is below a third threshold that is less than the first threshold; and transmitting a supplemental lighting adjustment based at least in part on the amount of supplemental light to a light source configured to provide light to the reflective display.

58. The non-transitory tangible computer storage medium of claim 57, the operations further comprising:

accessing a look-up table (LUT) or a formula that provides the amount of supplemental light to be provided, wherein the LUT or the formula is based on a model that is non-monotonic for the amount of supplemental light as a function of the illuminance of the ambient light.

59. The non-transitory tangible computer storage medium of claim 57, wherein the first threshold is approximately equal to the second threshold.

60. The non-transitory tangible computer storage medium of claim 57, wherein for at least some illuminances below the first threshold, the amount of supplemental light increases with increasing illuminance of the ambient light by a rate in a range from 0 nit/lux to 0.05 nit/lux.

61. The non-transitory tangible computer storage medium of claim 57, wherein for at least some illuminances above the second threshold, the amount of supplemental light decreases with increasing illuminance of the ambient light by a rate in a range from 0.01 nit/lux to 0.05 nit/lux.

* * * * *